US010395810B2

(12) United States Patent
Nakamura et al.

(10) Patent No.: US 10,395,810 B2
(45) Date of Patent: Aug. 27, 2019

(54) INDUCTOR

(71) Applicant: Shinko Electric Industries Co., Ltd., Nagano-shi, Nagano-ken (JP)

(72) Inventors: Atsushi Nakamura, Nagano (JP); Tsukasa Nakanishi, Nagano (JP); Kiyokazu Sato, Nagano (JP); Yasuyoshi Horikawa, Nagano (JP)

(73) Assignee: Shinko Electric Industries Co., Ltd., Nagano-shi (JP)

( * ) Notice: Subject to any disclaimer, the term of this patent is extended or adjusted under 35 U.S.C. 154(b) by 496 days.

(21) Appl. No.: 14/885,057

(22) Filed: Oct. 16, 2015

(65) Prior Publication Data

US 2016/0343499 A1 Nov. 24, 2016

(30) Foreign Application Priority Data

May 19, 2015 (JP) ..... 2015-101891

(51) Int. Cl.
*H01F 5/00* (2006.01)
*H01F 27/28* (2006.01)
*H01F 17/00* (2006.01)

(52) U.S. Cl.
CPC ..... *H01F 17/0033* (2013.01); *H01F 17/0013* (2013.01)

(58) Field of Classification Search
None
See application file for complete search history.

(56) References Cited

U.S. PATENT DOCUMENTS 7,907,044 B2 * 3/2011 Tada ..... H01F 17/0013 336/200
8,193,888 B2 * 6/2012 Tsuduki ..... H01F 17/0033 336/83
2002/0182374 A1 12/2002 Tung
2007/0040238 A1 2/2007 Yamasaki et al.
2007/0246253 A1 * 10/2007 Yakabe ..... H01L 21/486 174/264
2009/0236135 A1 9/2009 Ueda et al.
(Continued)

FOREIGN PATENT DOCUMENTS

CN 101540311 9/2009
CN 102403087 4/2012
(Continued)

OTHER PUBLICATIONS

Chinese Office Action with English Translation; CN 201510256308.7; dated Aug. 28, 2017; 6 pages.
(Continued)

*Primary Examiner* — Ronald Hinson
(74) *Attorney, Agent, or Firm* — Fish & Richardson P.C.

(57) ABSTRACT

An inductor includes a stacked body with a plurality of structural bodies that are stacked. Each of the plurality of structural bodies includes a wiring and an insulation layer formed on the wiring. The wirings of the plurality of structural bodies are connected in series to form a helical coil. The inductor further includes a through hole, which extends through the stacked body in a thickness direction of the stacked body, and a plurality of discrete insulation films, which are spaced apart from each other and cover surfaces of the wires of the plurality of structural bodies exposed from a surface of the stacked body.

21 Claims, 48 Drawing Sheets

(56) References Cited

U.S. PATENT DOCUMENTS

| | | | |
|---|---|---|---|
| 2012/0062348 | A1 | 3/2012 | Hashimoto |
| 2012/0188049 | A1 | 7/2012 | Matsuura |
| 2013/0113015 | A1 | 5/2013 | Kimura et al. |
| 2013/0176096 | A1 | 7/2013 | Takahashi |
| 2013/0222101 | A1 | 8/2013 | Ito et al. |
| 2013/0271251 | A1 | 10/2013 | Tseng et al. |
| 2014/0022041 | A1 | 1/2014 | Park et al. |
| 2014/0034373 | A1 | 2/2014 | Yoshikawa et al. |
| 2015/0054599 | A1 | 2/2015 | Kitajima |

FOREIGN PATENT DOCUMENTS

| | | |
|---|---|---|
| CN | 103107272 | 5/2013 |
| CN | 103377816 | 10/2013 |
| CN | 103578708 | 2/2014 |
| JP | H02-54205 | 4/1990 |
| JP | H10-032129 | 2/1998 |
| JP | 2001-313212 | 11/2001 |
| JP | 2003-168610 | 6/2003 |
| JP | 2005-085968 | 3/2005 |
| JP | 2007-053311 | 3/2007 |
| JP | 2012-248630 | 12/2012 |
| WO | WO 2013 164929 | 11/2013 |

OTHER PUBLICATIONS

Office Action; U.S. Appl. No. 15/196,462; dated Aug. 28, 2017; 7 pages.
Notification of Reasons for Rejection; JP Appln. No. 2015-101891; dated Dec. 4, 2018; 9 pages.
First Office Action; CN Application No. 2015106907708 with English Translation; dated May 7, 2019; 12 pages.

* cited by examiner

INDUCTOR

CROSS-REFERENCE TO RELATED APPLICATIONS

This application is based upon and claims the benefit of priority from prior Japanese Patent Application No. 2015-101891, filed on May 19, 2015, the entire contents of which are incorporated herein by reference.

FIELD

This disclosure relates to an inductor and a method for manufacturing an inductor.

BACKGROUND

Electronic devices such as computer games and cellular phones are becoming smaller and smaller. As a result, elements such as inductors mounted in such an electronic device also need to be smaller. One example of a known inductor mounted in such an electronic device uses a winding coil. For example, an inductor that uses a winding coil may be mounted in a power supply circuit of an electronic device (see Japanese Laid-Open Patent Publication No. 2003-168610).

SUMMARY

The limit to miniaturization of the inductor that uses a winding coil is considered to be approximately 1.6 mm×1.6 mm in planar shape. This is because there is a limit to the thickness of the winding. Further miniaturized of the inductor would decrease the proportion of the volume of the winding wiring relative to the total area of the inductor reduces, and a large inductance would not be obtained. Thus, the development of an inductor that can easily be miniaturized is desired.

One aspect of this disclosure is an inductor including a stacked body, a first through hole, and a plurality of first discrete insulation films. The stacked body includes a plurality of structural bodies that are stacked. Each of the plurality of structural bodies includes a wiring and an insulation layer formed on the wiring. The wirings of the plurality of the plurality of structural bodies that are adjacent in a stacking direction of the stacked body are connected in series to form a helical coil. The first through hole extends through the stacked body in the stacking direction. The plurality of first discrete insulation films are spaced apart from each other and cover surfaces of the wirings of the plurality of structural bodies that are exposed from a surface of the stacked body.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

Figure 1:
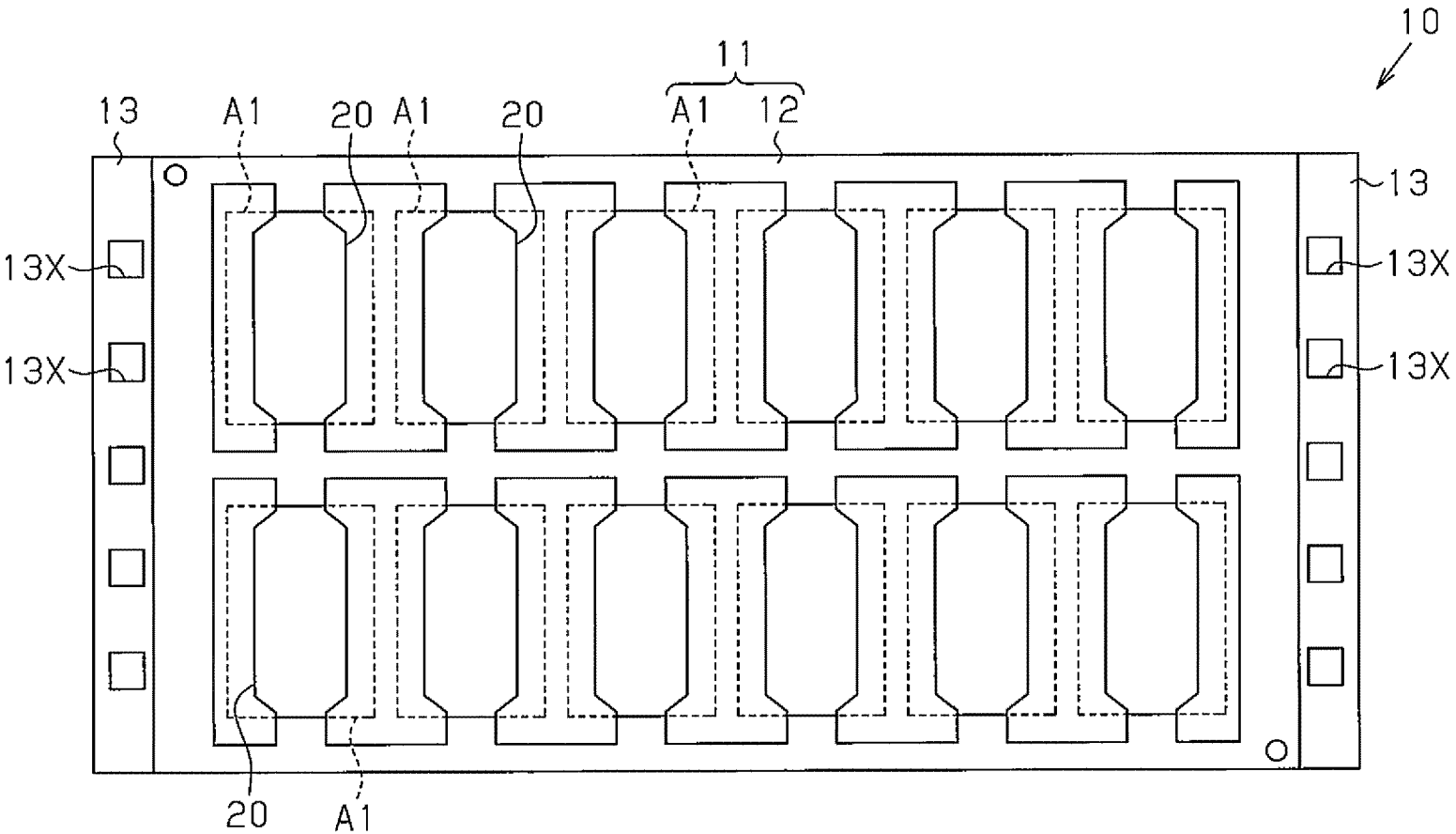
FIG. 1 is a schematic plan view illustrating a first embodiment of a coil substrate

Embodiments will hereinafter be described with reference to the accompanying drawings. In the drawings, elements are illustrated for simplicity and clarity and have not necessarily been drawn to scale. To facilitate understanding, hatching lines may not be illustrated or be replaced by shading in the cross-sectional drawings.

First Embodiment

A first embodiment will now be described with reference to FIGS. 1 to 31.

The structure of a coil substrate 10 will first be described.

As illustrated in FIG. 1, a coil substrate 10 is formed to have a substantially rectangular shape in a plan view, for example. The coil substrate 10 includes a block 11, and two outer frames 13 projecting toward an outer side from the block 11. The block 11 is, for example, formed to have a substantially rectangular shape in a plan view. The block 11 includes a plurality of individual regions A1 arranged in a matrix form (here, 2×6). The block 11 is ultimately cut along broken lines (each individual region A1) and singulated into individual unit coil substrates 20 (hereinafter simply referred to as the coil substrates 20). In other words, the block 11 includes the plurality of individual regions A1 each used as the coil substrate 20.

The plurality of individual regions A1 may be laid out at a predetermined interval as illustrated in FIG. 1 or may be laid out in contact with each other. The block 11 includes twelve individual regions A1 in the example illustrated in FIG. 1. However, the number of individual regions A1 is not particularly limited.

The block 11 includes a coupling portion 12 that couples the plurality of coil substrates 20. In other words, the coupling portion 12 supports the plurality of coil substrates 20 so as to surround the coil substrates 20.

The outer frames 13 are, for example, formed at the two end regions of the coil substrate 10. For example, the outer frames 13 project toward the outer side from the short sides of the block 11. Each outer frame 13 includes a plurality of sprocket holes 13X. The plurality of sprocket holes 13X are, for example, continuously arranged at substantially constant intervals in a short-side direction (vertical direction as viewed in FIG. 1) of the coil substrate 10. Each sprocket hole 13X has a substantially rectangular shape in a plan view, for example. The sprocket holes 13X are through holes used to convey the coil substrate 10. When the coil substrate 10 is attached to a manufacturing device, the through holes are engaged with pins of a sprocket driven by a motor or the like to convey the coil substrate 10 at the pitch of the sprocket holes 13X. Thus, the interval of the adjacent sprocket holes 13X is set in correspondence with the manufacturing device to which the coil substrate 10 is attached. A portion (i.e., coupling portion 12 and outer frames 13) other than the individual regions A1 of the coil substrate 10 is discarded after singulating the coil substrate 10 into the coil substrates 20.

The structure of each coil substrate 20 will now be described according to FIGS. 2 to 7.

Figure 2:
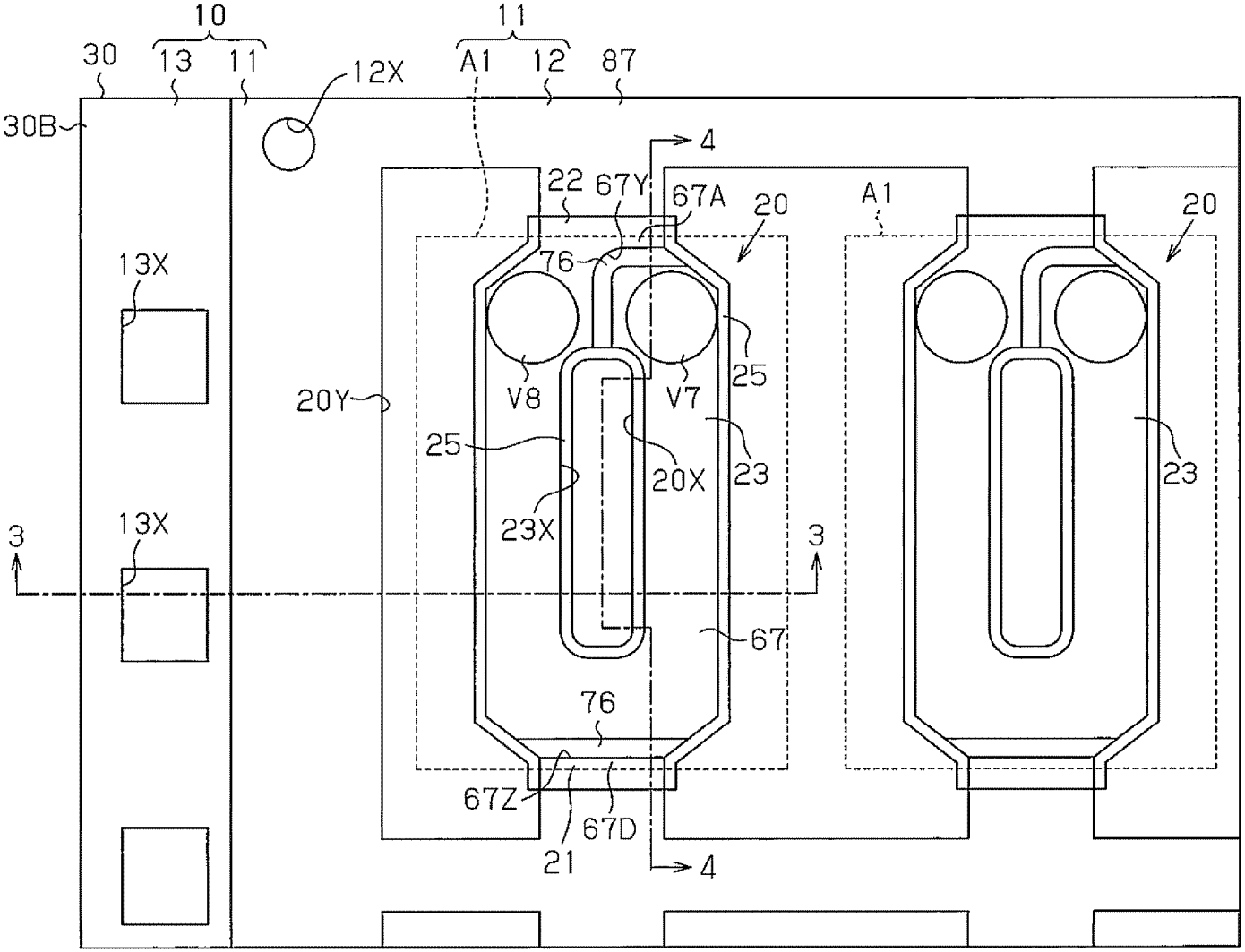
FIG. 2 is an enlarged plan view of a portion of the coil substrate illustrated in FIG. 1.

As illustrated in FIG. 2, the coil substrate 20 of each individual region A1 is formed to have a substantially rectangular shape in a plan view, for example. The planar shape of the coil substrate 20 is, for example, a rectangle having chamfered corners. The coil substrate 20 includes projections 21, 22 projecting toward the outer side (upper side and lower side in FIG. 2) from the short sides of the rectangle. The planar shape of the coil substrate 20 is, however, not limited to the shape illustrated in FIG. 2, and may have any shape. Furthermore, the planar shape of the coil substrate 20 may have any size. For example, the planar shape of the coil substrate 20 may have a size so that the planar shape of an inductor 90 is a substantially rectangular shape of approximately 1.6 mm×0.8 mm when the inductor 90 illustrated in FIG. 8B is manufactured using the coil substrate 20. The thickness of the coil substrate 20 is, for example, approximately 0.5 mm.

A through hole 20X is formed at substantially a central part in a plan view of the coil substrate 20. The through hole 20X extends through the coil substrate 20 in a thickness direction. The planar shape of the through hole 20X may have any shape and any size. For example, the planar shape of the through hole 20X may be a substantially elliptical shape or a substantially oval shape.

An opening 20Y that defines the coil substrate 20 is formed between the coil substrate 20 and the coupling portion 12. The opening 20Y extends through the coil substrate 10 in the thickness direction.

Figure 3:
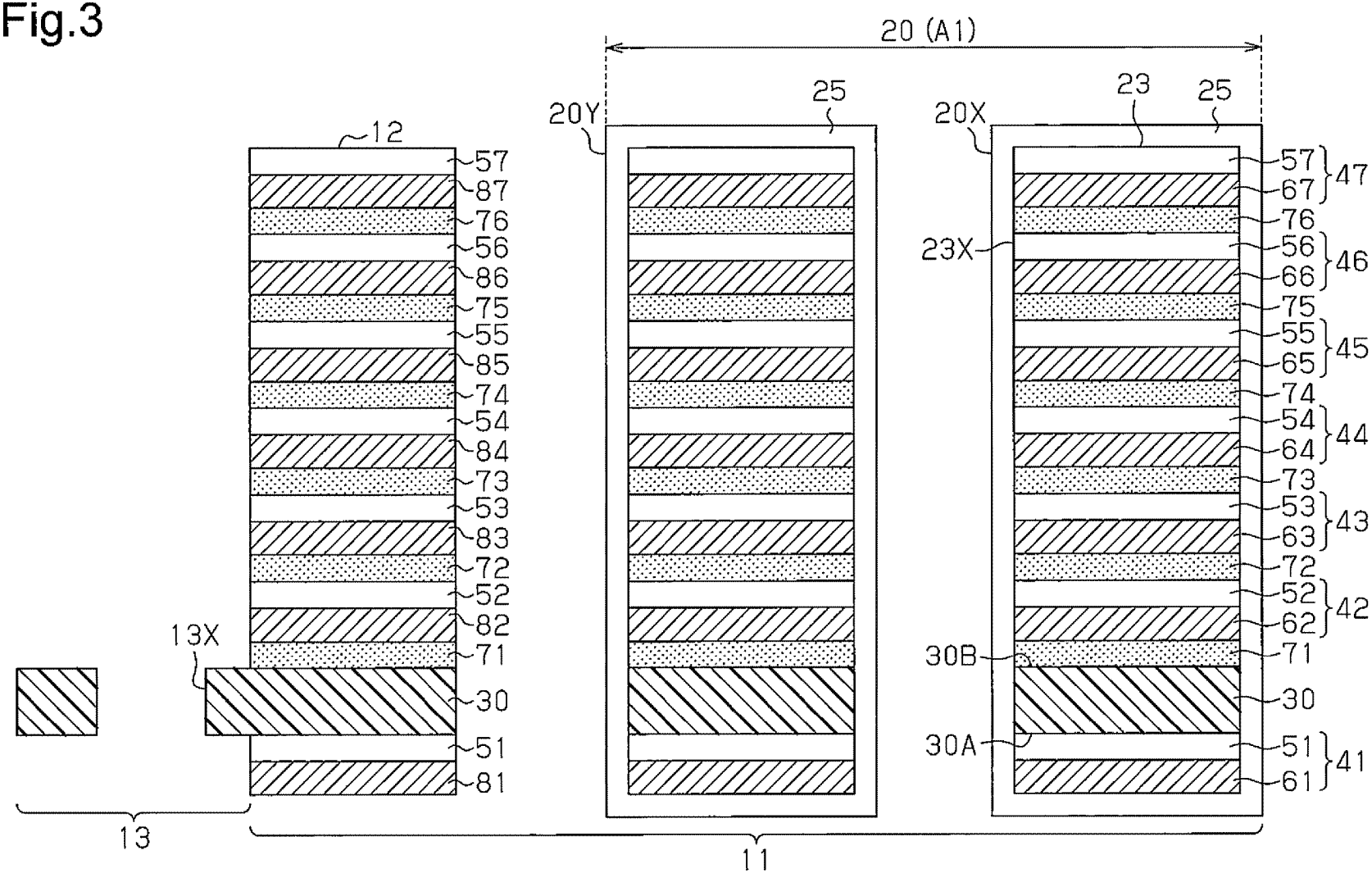
FIG. 3 is a schematic cross-sectional view of the coil substrate taken along line 3-3 in FIG. 2.
Figure 4:
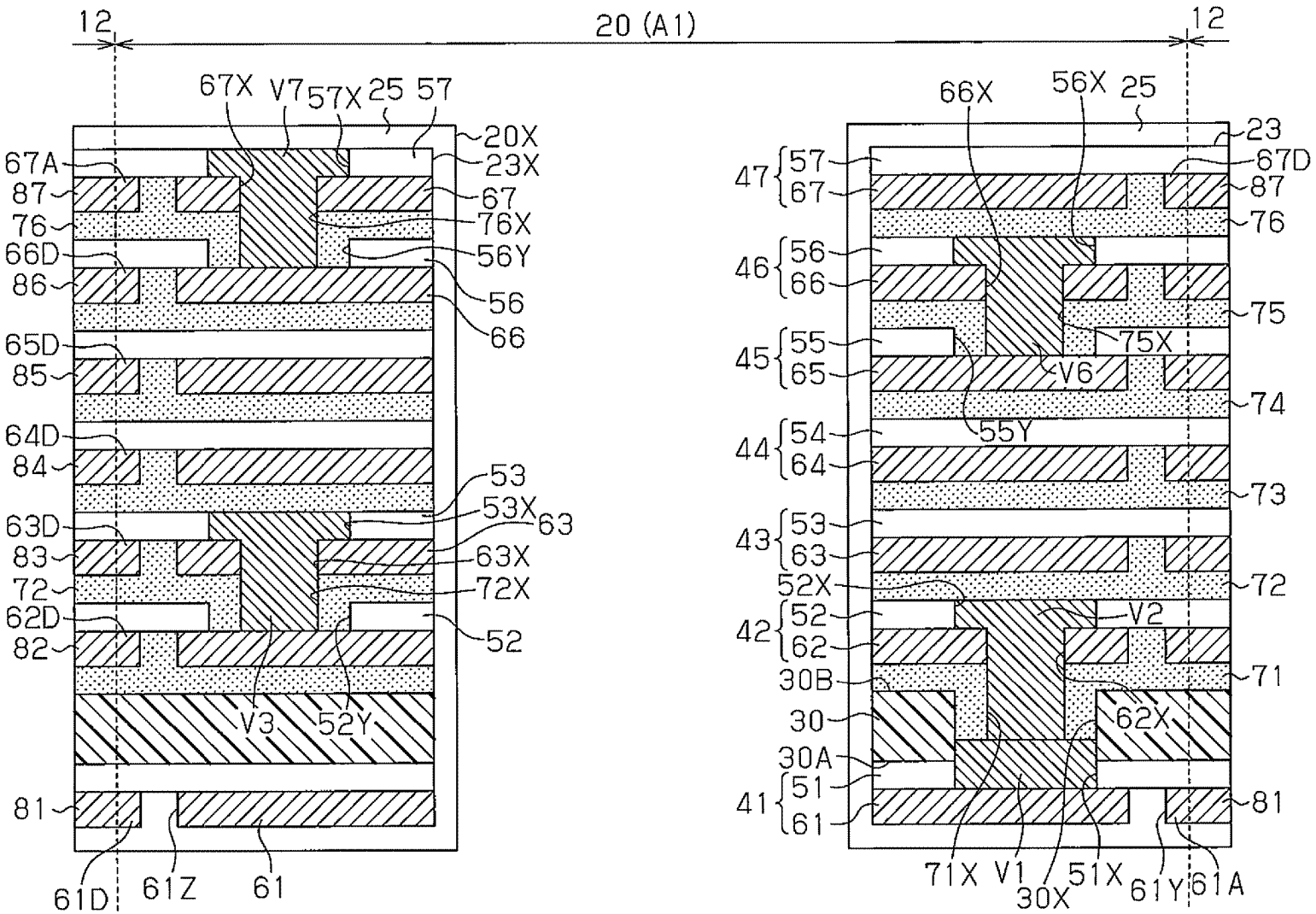
FIG. 4 is a schematic cross-sectional view of a unit coil substrate taken along line 4-4 in FIG. 2.

As illustrated in FIGS. 3 and 4, the coil substrate 20 mainly includes a stacked body 23 and an insulation film 25, which covers the surface of the stacked body 23. The stacked body 23 includes a substrate 30, a structural body 41 stacked on a lower surface 30A of the substrate 30, and structural bodies 42 to 47 sequentially stacked on an upper surface 30B of the substrate 30.

The planar shape of the stacked body 23 is substantially similar to the planar shape of the coil substrate 20. For example, the planar shape of the stacked body 23 is one size smaller than the planar shape of the coil substrate 20 due to the insulation film 25. A through hole 23X that extends through the stacked body 23 in the thickness direction is formed at substantially the central part in a plan view of the stacked body 23. The planar shape of the through hole 23X may be, for example, a substantially elliptical shape or a substantially oval shape like the planar shape of the through hole 20X.

In the stacked body 23, the structural body 42 is stacked on the upper surface 30B of the substrate 30 by way of an adhesive layer 71. The structural body 43 is stacked on the structural body 42 by way of an adhesive layer 72. The structural body 44 is stacked on the structural body 43 by way of an adhesive layer 73. The structural body 45 is stacked on the structural body 44 by way of an adhesive layer 74. The structural body 46 is stacked on the structural body 45 by way of an adhesive layer 75. The structural body 47 is stacked on the structural body 46 by way of an adhesive layer 76.

A heat resistant adhesive formed from an insulative resin, for example, may be used as the adhesive layers 71 to 76. For example, an epoxy-based adhesive is used for the adhesive layers 71 to 76. The thicknesses of the adhesive layers 71 to 76 may be, for example, approximately 12 to 35 μm.

As illustrated in FIG. 4, the structural body 41 includes an insulation layer 51, a wiring 61, a connecting portion 61A, and a metal layer 61D. The structural body 42 includes an insulation layer 52, a wiring 62, and a metal layer 62D. The structural body 43 includes an insulation layer 53, a wiring 63, and a metal layer 63D. The structural body 44 includes an insulation layer 54, a wiring 64, and a metal layer 64D. The structural body 45 includes an insulation layer 55, a wiring 65, and a metal layer 65D. The structural body 46 includes an insulation layer 56, a wiring 66, and a metal layer 66D. The structural body 47 includes an insulation layer 57, a wiring 67, a connecting portion 67A, and a metal layer 67D.

An insulative resin in which an epoxy-based resin is the main component may be used as the material of the insulation layers 51 to 57. Alternatively, an insulative resin in which a thermosetting resin is the main component may be used as the material of the insulation layers 51 to 57. Furthermore, the insulation layers 51 to 57 may contain a filler such as silica, alumina, or the like. The thermal expansion coefficient of the insulation layers 51 to 57 is, for example, 50 to 120 ppm/° C. The thicknesses of the insulation layers 51 to 57 may be, for example, approximately 12 to 20 μm.

The wiring 61 is located in the lowermost wiring layer. A metal material having a higher adhesiveness to the insulation film 25 than the substrate 30, for example, is preferable for the material of the wiring 61 of the lowermost layer, the connecting portion 61A, and the metal layer 61D. For example, copper (Cu) or copper alloy may be used as the material of the wiring 61, the connecting portion 61A, and the metal layer 61D. In the same manner, copper and copper alloy may be used, for example, as the material of the wirings 62 to 67, the connecting portion 67A, and the metal layers 62D to 67D. The thicknesses of the wirings 61 to 67, the connecting portions 61A, 67A, and the metal layers 61D to 67D may be, for example, approximately 12 to 35 μm.

A sheet-like insulating substrate, for example, may be used as the substrate 30. An insulative resin, for example, may be used as the material of the substrate 30. The insulative resin is preferably adjusted so that the thermal expansion coefficient of the substrate 30 becomes lower than the thermal expansion coefficient of the insulation layers 51 to 57. For example, the thermal expansion coefficient of the substrate 30 is set to approximately 10 to 25 ppm/° C. A material having superior heat resistance, for example, is preferable for the material for the substrate 30. A material having a higher elastic modulus than the insulation layers 51 to 57 is preferable for the material of the substrate 30. A resin film such as polyimide (PI) film, polyethylene naphthalate (PEN) film, and the like, for example, may be used as the substrate 30. For example, the polyimide film having a low thermal expansion coefficient may be used as the substrate 30. The thickness of the substrate 30 is, for example, set to be thicker than the insulation layers 51 to 57. For example, the thickness of the substrate 30 may be approximately 12 to 50 μm. Such a substrate 30 has a higher rigidity than the insulation layers 51 to 57.

Figure 5:
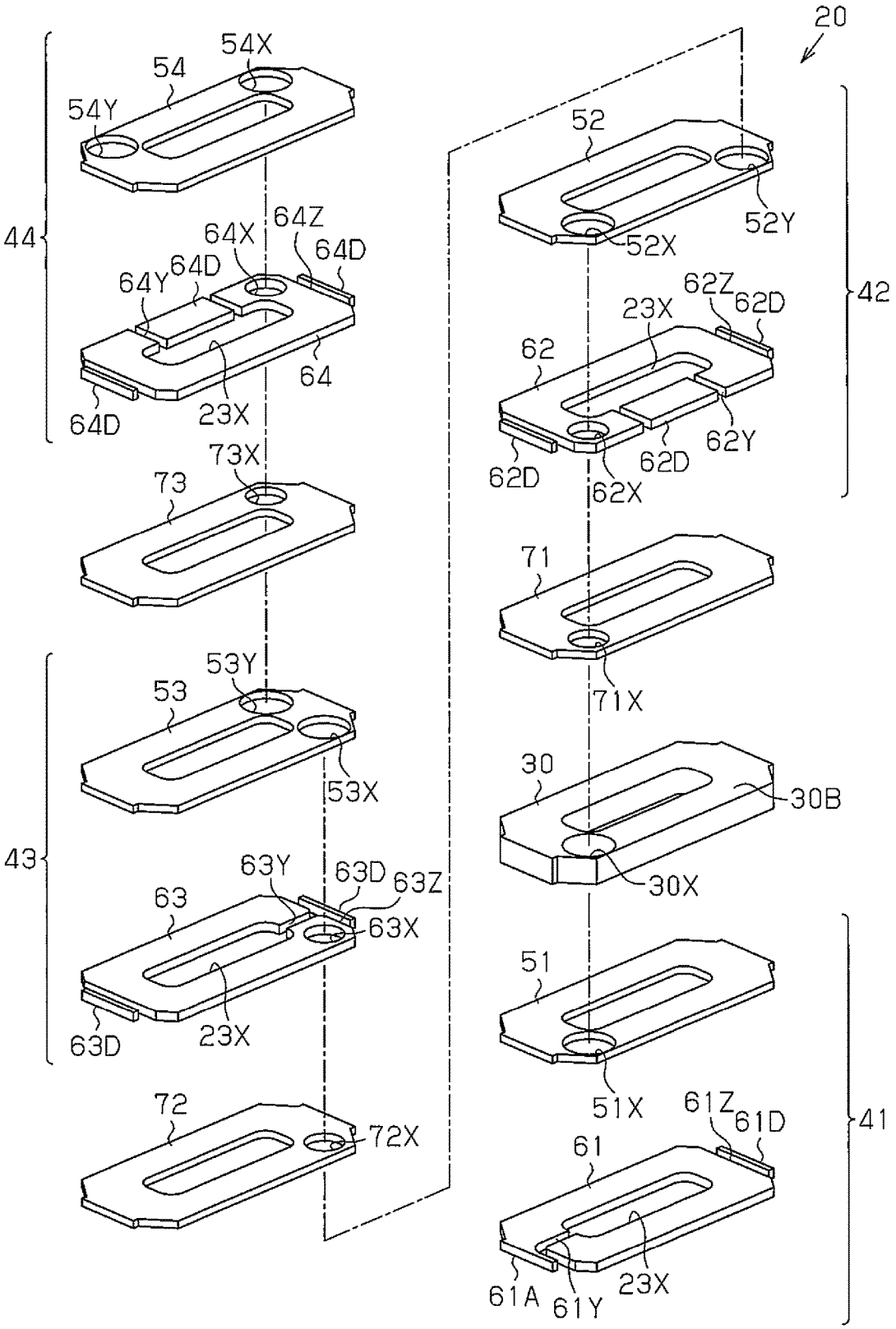
FIGS. 5 and 6 are exploded perspective views of a stacked body of the unit coil substrates.

As illustrated in FIGS. 4 and 5, the substrate 30 includes a through hole 30X that extends through the substrate 30 in the thickness direction. The planar shape of the through hole 30X may have any shape and any size. For example, the planar shape of the through hole 30X may be a circular shape having a diameter of approximately 200 to 300 μm.

The structure of the structural body 41 will now be described.

The insulation layer 51 is stacked on the lower surface 30A of the substrate 30. The insulation layer 51 includes a through hole 51X that extends through the insulation layer 51 in the thickness direction. The through hole 51X communicates with the communication hole 30X of the substrate 30. In other words, the through hole 51X is formed at a position overlapping the through hole 30X in a plan view. The planar shape of the through hole 51X may have any shape and any size. For example, the planar shape of the through hole 51X may be a circular shape having a diameter of approximately 200 to 300 μm like the through hole 30X.

A via wiring V1 is formed partially in the through holes 30X and 51X, which are in communication. In the present example, the through hole 51X and a portion of the through hole 30X are filled with the via wiring V1. Furthermore, in the present example, the via wiring V1 extends from the upper surface of the wiring 61 to an intermediate position of the through hole 30X in the thickness direction of the substrate 30. Thus, the upper inner side surface of the through hole 30X is exposed from the via wiring V1. The via wiring V1 is electrically connected to the wiring 61. The planar shape of the via wiring V1 may have any shape and any size. For example, the planar shape of the via wiring V1 may be a circular shape having a diameter of approximately 200 to 300 μm like the through holes 30X, 51X.

The wiring 61, the connecting portion 61A, and the metal layer 61D are stacked on the lower surface of the insulation layer 51. The wiring 61, the connecting portion 61A, and the metal layer 61D are located on the lowermost layer of the stacked body 23. The width of the wiring 61 is, for example, approximately 100 to 200 μm. The wiring 61 is a portion of a helical coil formed in the coil substrate 20 and serves as a first-layer wiring (about one winding) of the coil. In the description hereafter, the direction in which the helical winding of the coil extends is referred to as the longitudinal direction and the direction orthogonal to the longitudinal direction in a plan view is referred to as the widthwise direction of each wiring.

As illustrated in FIG. 5, the planar shape of the wiring 61 is elliptical. A groove 61Y that extends through the wiring 61 in the thickness direction is formed at a certain location in the wiring 61. That is, the wiring 61 is cut in the widthwise direction by the groove 61Y and formed to have a non-ring-like shape.

The connecting portion 61A is formed at one end of the wiring 61. The connecting portion 61A is formed at a position corresponding to the projection 21 (refer to FIG. 2) of the coil substrate 20. The connecting portion 61A is formed integrally with the wiring 61. In other words, the connecting portion 61A is a portion of the wiring 61. As illustrated in FIG. 4, the connecting portion 61A is electrically connected to the metal layer 81 formed in the coupling portion 12 (refer to FIG. 3). The metal layer 81 is, for example, a power supply line for supplying power during plating. The connecting portion 61A is exposed from the insulation film 25 at the side surface 20A (refer to FIG. 8A) of the coil substrate 20 subsequent to singulation. The connecting portion 61A is connected to an electrode 92 of the inductor 90 (refer to FIG. 8B).

The metal layer 61D is spaced apart from the wiring 61. In other words, a groove 61Z is formed between the metal layer 61D and the wiring 61. Therefore, the metal layer 61D is electrically insulated from the wiring 61 by the groove 61Z. The metal layer 61D, for example, is a dummy pattern that decreases the difference between the shape of the conductive layer (wiring 61, connecting portion 61A, and metal layer 61D) formed in the structural body 41 and the shape of the conductive layer (e.g., wiring 67, connecting portion 67A, and metal layer 67D) formed in another structural body. The metal layer 61D is formed at a position corresponding to the projection 22 (refer to FIG. 2) of the coil substrate 20. In the present example, the metal layer 61D is arranged at a position overlapping the connecting portion 67A, which is formed in the uppermost structural body 47 of the coil substrate 20, in a plan view. The metal layer 61D is a (floating) portion electrically isolated so as not to be electrically connected to other wirings and metal layers in the coil substrate 20 subsequent to singulation.

The structure of the structural bodies stacked on the upper surface 30B of the substrate 30 will now be described.

As illustrated in FIG. 4, an adhesive layer 71 is stacked on the upper surface 30B of the substrate 30. The adhesive layer 71 covers the upper inner side surface of the through hole 30X exposed from the via wiring V1. Thus, the adhesive layer 71 is formed on the upper surface 30B of the substrate 30 and is formed in the through hole 30X. The adhesive layer 71 includes a through hole 71X that extends through the adhesive layer 71 in the thickness direction and exposes a portion of the upper surface of the via wiring V1. The through hole 71X extends from the upper surface of the adhesive layer 71 to the lower surface of the adhesive layer 71 formed in the through hole 30X. In other words, the through hole 71X communicates with a portion of the through hole 30X, and a portion of the through hole 71X is formed in the through hole 30X. The planar shape of the through hole 71X may have any shape and any size. The planar shape of the through hole 71X is, however, smaller than the planar shape of the through hole 30X. For example, the planar shape of the through hole 71X is a circular shape having a diameter of approximately 140 to 180 μm.

The structural body 42 is stacked on the upper surface 30B of the substrate 30 by way of the adhesive layer 71. The wiring 62 and the metal layer 62D are stacked on the adhesive layer 71. As illustrated in FIG. 5, the wiring 62 is formed to be substantially C-shaped in a plan view. The wiring 62 is a portion of the helical coil and serves as a second-layer wiring (approximately ¾ of a winding) of the coil.

The wiring 62 includes a through hole 62X that extends through the wiring 62 in the thickness direction and communicates with the through hole 71X of the adhesive layer 71. The planar shape of the through hole 62X may have any shape and any size. The planar shape of the through hole 62X, however, is smaller than the planar shape of the through hole 30X. For example, the planar shape of the through hole 62X may be a circular shape having a diameter of approximately 140 to 180 μm.

The metal layer 62D is a dummy pattern similar to the metal layer 61D. For example, the metal layer 62D includes three metal layer portions. Two of the three metal layer portions are spaced apart from the wiring 62 by a groove 62Z, and are formed at positions overlapping the connecting portions 61A, 67A (refer to FIG. 6) in a plan view. The remaining metal layer portion of the metal layer 62D is spaced apart from the wiring 62 by a groove 62Y, and is formed at a position overlapping a portion of the wiring 61 in a plan view.

As illustrated in FIG. 4, a portion of each side surfaces of the wiring 62 and the metal layer 62D is covered with the adhesive layer 71. In the present example, the grooves 62Y, 62Z illustrated in FIG. 5 are filled with the adhesive layer 71.

The insulation layer 52 is stacked on the adhesive layer 71 so as to cover the upper surfaces of the wiring 62 and the metal layer 62D. The insulation layer 52 includes a through hole 52X that extends through the insulation layer 52 in the thickness direction and communicates with the through holes 62X, 71X. The through hole 52X exposes the upper surface of the wiring 62 around the through hole 62X. Therefore, the planar shape of the through hole 52X is larger than the planar shapes of the through holes 62X, 71X. For example, the planar shape of the through hole 52X is a circular shape having a diameter of approximately 200 to 300 μm.

A via wiring V2 is formed in the communication through holes 52X, 62X, 71X. For example, the via wiring V2 is formed on the via wiring V1 exposed from the through hole 71X, and all of the through holes 52X, 62X, 71X are filled with the via wiring V2. Thus, the via wiring V2 is formed to have a substantially T-shaped cross-section. The via wiring V2 is connected to the wiring 62 defining the inner side surface of the through hole 62X. The via wiring V2 is also connected to the upper surface of the wiring 62 located at the periphery of through hole 62X. The via wirings V1, V2 serve as through electrodes that connect the wiring 61 (first-layer wiring) and the wiring 62 (second-layer wiring) in series. The via wirings V1, V2 (through electrodes) extend through the insulation layer 51, the substrate 30, the adhesive layer 71, the wiring 62, and the insulation layer 52.

The insulation layer 52 includes a through hole 52Y that extends through the insulation layer 52 in the thickness direction to expose a portion of the upper surface of the wiring 62. The planar shape of the through hole 52Y may have any shape and any size. For example, the planar shape of the through hole 52Y may be a circular shape having a diameter of approximately 200 to 300 μm.

The adhesive layer 72 is stacked on the insulation layer 52. The structural body 43 is stacked on the adhesive layer 72. Therefore, the wiring 63 and the metal layer 63D are stacked on the adhesive layer 72.

As illustrated in FIG. 5, the wiring 63 is formed to have a substantially elliptical shape in a plan view. A groove 63Y that extends through the wiring 63 in the thickness direction is formed at a certain location in the wiring 63. That is, the wiring 63 is cut in the widthwise direction by the groove 63Y and formed to have a non-ring-like shape. The wiring 63 is a portion of the helical coil, and serves as a third-layer wiring (about one winding) of the coil.

The metal layer 63D is a dummy pattern similar to the metal layer 61D. For example, the metal layer 63D includes two metal layer portions. The two metal layer portions are spaced apart from the wiring 63 by the groove 63Z, and are formed at positions overlapping the connecting portions 61A, 67A (refer to FIG. 6) in a plan view.

As illustrated in FIG. 4, the adhesive layer 72 is partially formed in the through hole 52Y, and covers the inner side surface of the through hole 52Y. The adhesive layer 72 covers a portion of the side surfaces of the wiring 63 and the metal layer 63D. In the present example, the grooves 63Y, 63Z illustrated in FIG. 5 are filled with the adhesive layer 72.

The adhesive layer 72 includes a through hole 72X that extends through the adhesive layer 72 in the thickness direction and exposes a portion of the upper surface of the wiring 62. The through hole 72X extends from the upper surface of the adhesive layer 72 to the lower surface of the adhesive layer 72 formed in the through hole 52Y. In other words, a portion of the through hole 72X is located in the through hole 52Y.

The wiring 63 includes a through hole 63X that extends through the wiring 63 in the thickness direction and communicates with the through hole 72X. The planar shapes of the through holes 63X, 72X may have any shape and any size. The planar shapes of the through holes 63X, 72X is smaller than the planar shape of the through hole 52Y. For example, the planar shapes of the through holes 63X, 72X may be a circular shape having a diameter of approximately 140 to 180 μm.

The insulation layer 53 is stacked on the adhesive layer 72 to cover the upper surfaces of the wiring 63 and the metal layer 63D. The insulation layer 53 includes a through hole 53X that extends through the insulation layer 53 in the thickness direction and communicates with the through holes 63X, 72X. The through hole 53X exposes the upper surface of the wiring 63 around the through hole 63X. Therefore, the planar shape of the through hole 53X may be larger than the planar shapes of the through holes 63X, 72X. For example, the planar shape of the through hole 53X is a circular shape having a diameter of approximately 200 to 300 μm.

A via wiring V3 is formed in the communication through holes 53X, 63X, 72X. For example, the via wiring V3 is formed on the wiring 62 exposed from the through hole 72X, and the through holes 53X, 63X, 72X are all filled with the via wiring V3. Thus, the via wiring V3 is formed to have a substantially T-shaped cross-section. The via wiring V3 is connected to the wiring 63 defining the inner side surface of the through hole 63X. The via wiring V3 is also connected to the upper surface of the wiring 63 around the through hole 63X. The via wiring V3 serves as a through electrode that connects the wiring 62 (second-layer wiring) and the wiring 63 (third-layer wiring) in series. The via wiring V3 (through electrode) extends through the insulation layer 52 of the structural body 42, the adhesive layer 72, and the wiring 63 and the insulation layer 53 of the structural body 43.

As illustrated in FIG. 5, the insulation layer 53 includes a through hole 53Y that extends through the insulation layer 53 in the thickness direction and exposes a portion of the upper surface of the wiring 63. The planar shape of the through hole 53Y may have any shape and any size. For example, the planar shape of the through hole 53Y may be a circular shape having a diameter of approximately 200 to 300 μm.

The adhesive layer 73 is stacked on the insulation layer 53. The structural body 44 is stacked on the adhesive layer 73. Therefore, the wiring 64 and the metal layer 64D are stacked on the adhesive layer 73. The insulation layer 54 is stacked on the adhesive layer 73 so as to cover the upper surfaces of the wiring 64 and the metal layer 64D. The structural body 44 has the same structure as the structural body 42, and for example, corresponds to the structure in which the structural body 42 is rotated by 180 degrees about a normal line on the upper surface of the insulation layer 52.

The wiring 64 is formed to have a substantially C-shaped in a plan view. The wiring 64 is a portion of the helical coil, and serves as a fourth-layer wiring (about ¾ winding) of the coil. The metal layer 64D is a dummy pattern similar to the metal layer 62D. For example, the metal layer 64D is spaced apart from the wiring 64 by a groove 64Y or a groove 64Z.

The adhesive layer 73 covers the inner side surface of the through hole 53Y like the adhesive layer 72. The adhesive layer 73 also covers a portion of the side surfaces of the wiring 64 and the metal layer 64D. In the present example, the grooves 64Y, 64Z are filled with the adhesive layer 73. The adhesive layer 73 includes a through hole 73X that extends through the adhesive layer 73 in the thickness direction and exposes a portion of the upper surface of the wiring 63. The through hole 73X is formed at a position overlapping the through hole 53Y in a plan view, and a portion of the through hole 73X is located in the through hole 53Y.

The wiring 64 includes a through hole 64X that extends through the wiring 64 in the thickness direction and communicates with the through hole 73X. The planar shapes of the through holes 64X, 73X are smaller than the planar shape of the through hole 53Y.

The insulation layer 54 includes a through hole 54X that extends through the insulation layer 54 in the thickness direction and communicates with the through holes 64X, 73X. The planar shape of the through hole 54X is larger than the planar shapes of the through holes 64X, 73X. The insulation layer 54 also includes a through hole 54Y that extends through the insulation layer 54 in the thickness direction and exposes a portion of the upper surface of the wiring 64.

A via wiring V4 (refer to FIG. 7) is formed in the communication through holes 54X, 64X, 73X. For example, the via wiring V4 is formed on the wiring 63 exposed from the through hole 73X, and all of the through holes 54X, 64X, 73X are filled with the via wiring V4. The via wiring V4 serves as a through electrode that connects the wiring 63 (third-layer wiring) and the wiring 64 (fourth-layer wiring) in series. The via wiring V4 (through electrode) extends through the insulation layer 53 of the structural body 43, the adhesive layer 73, and the wiring 64 and the insulation layer 54 of the structural body 44.

Figure 6:
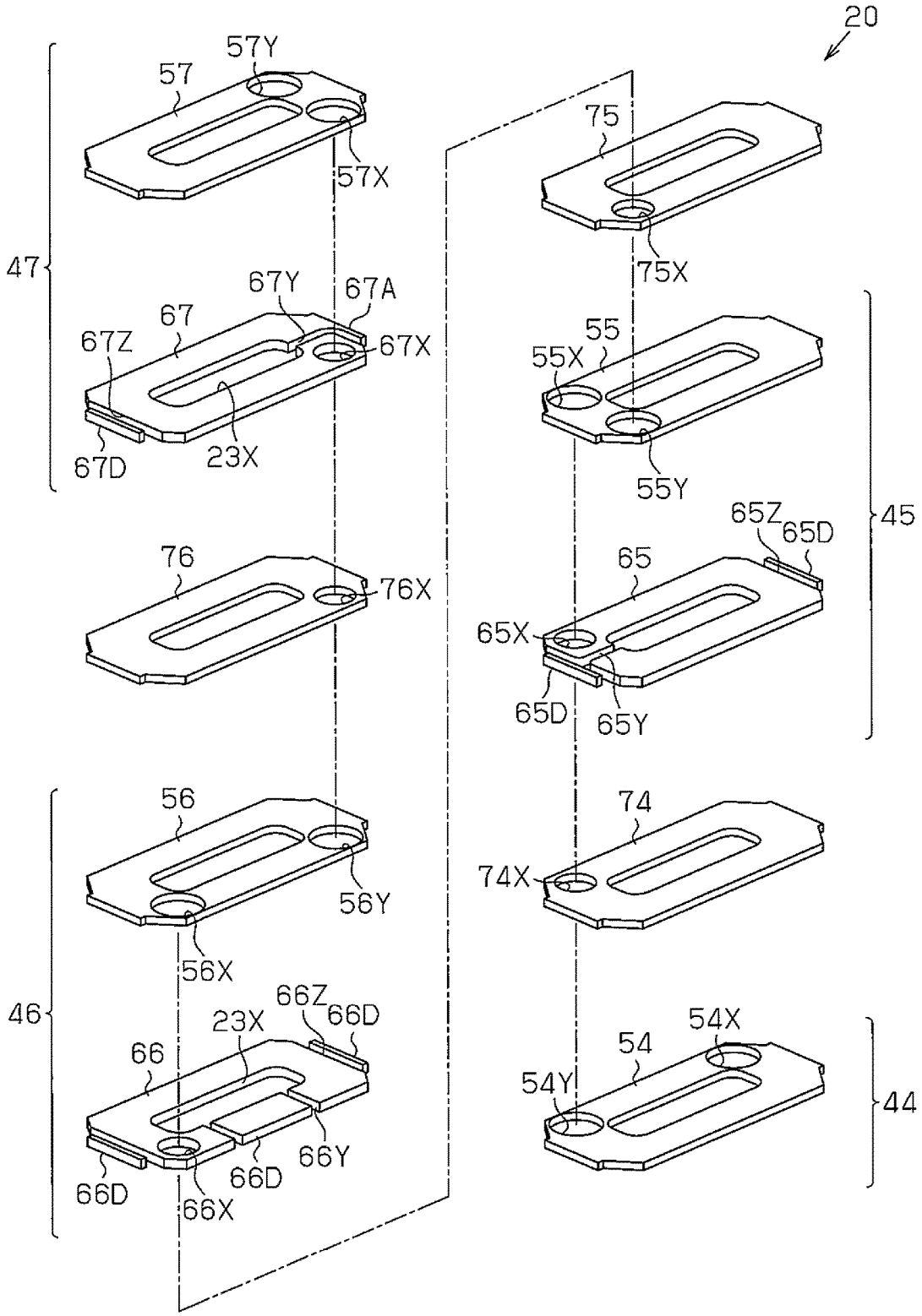

As illustrated in FIG. 4, the adhesive layer 74 is stacked on the insulation layer 54. The structural body 45 is stacked on the adhesive layer 74. Therefore, the wiring 65 and the metal layer 65D are stacked on the adhesive layer 74. The insulation layer 55 is stacked on the adhesive layer 74 so as to cover the upper surfaces of the wiring 65 and the metal layer 65D. As illustrated in FIGS. 5 and 6, the structural body 45 has the same structure as the structural body 43, and corresponds to a structure in which the structural body 43 is rotated by 180 degrees about a normal line on the upper surface of the insulation layer 53.

As illustrated in FIG. 6, the wiring 65 is formed to have a substantially elliptical shape in a plan view. A groove 65Y that extends through the wiring 65 in the thickness direction is formed at a certain location in the wiring 65. That is, the wiring 65 is cut in the widthwise direction by the groove 65Y and formed to a have a non-ring-like shape. The wiring 65 is a portion of the helical coil and serves as a fifth-layer wiring (about one winding) of the coil. The metal layer 65D is a dummy pattern similar to the metal layer 61D (refer to FIG. 5), and is spaced apart from the wiring 65 by a groove 65Z.

The adhesive layer 74 covers the inner side surface of the through hole 54Y like the adhesive layer 72 (refer to FIG. 4). The adhesive layer 74 covers a portion of the side surfaces of the wiring 65 and the metal layer 65D. In the present example, the grooves 65Y, 65Z are filled with the adhesive layer 74. The adhesive layer 74 includes a through hole 74X that extends through the adhesive layer 74 in the thickness direction and exposes a portion of the upper surface of the wiring 64 (refer to FIG. 5). The through hole 74X is formed at a position overlapping the through hole 54Y in a plan view, and a portion of the through hole 74X is located in the through hole 54Y.

The wiring 65 includes a through hole 65X that extends through the wiring 65 in the thickness direction and communicates with the through hole 74X. The planar shapes of the through holes 65X, 74X are smaller than the planar shape of the through hole 54Y.

The insulation layer 55 includes a through hole 55X that extends through the insulation layer 55 in the thickness direction and communicates with the through holes 65X, 74X. The planar shape of the through hole 55X is larger than the planar shapes of the through holes 65X, 74X. The insulation layer 55 includes a through hole 55Y that extends through the insulation layer 55 in the thickness direction and exposes a portion of the upper surface of the wiring 65.

A via wiring V5 (refer to FIG. 7) is formed in the communication through holes 55X, 65X, 74X. For example, the via wiring V5 is formed on the wiring 64 (refer to FIG. 5) exposed from the through hole 74X, and the through holes 55X, 65X, 74X are all filled with the via wiring V5. The via wiring V5 serves as a through electrode that connects the wiring 64 (fourth-layer wiring) and the wiring 65 (fifth-layer wiring) in series. The via wiring V5 (through electrode) extends through the insulation layer 54 of the structural body 44, the adhesive layer 74, and the wiring 65 and the insulation layer 55 of the structural body 45.

The adhesive layer 75 is stacked on the insulation layer 55. The structural body 46 is stacked on the adhesive layer 75. Therefore, the wiring 66 and the metal layer 66D are stacked on the adhesive layer 75. The insulation layer 56 is stacked on the adhesive layer 75 so as to cover the upper surfaces of the wiring 66 and the metal layer 66D. The structural body 46 has the same structure as the structural body 42 (refer to FIG. 5).

As illustrated in FIG. 6, the wiring 66 is formed to have a substantially C-shaped in a plan view. The wiring 66 is a portion of the helical coil, and is a sixth-layer wiring (about ¾ winding) of the coil. The metal layer 66D is a dummy pattern similar to the metal layer 62D (refer to FIG. 5). The metal layer 66D is, for example, spaced apart from the wiring 66 by a groove 66Y or a groove 66Z.

As illustrated in FIG. 4, the adhesive layer 75 covers the inner side surface of the through hole 55Y. The adhesive layer 75 also covers a portion of the respective side surfaces of the wiring 66 and the metal layer 66D. In the present example, the grooves 66Y, 66Z (refer to FIG. 6) are filled with the adhesive layer 75. The adhesive layer 75 includes a through hole 75X that extends through the adhesive layer 75 in the thickness direction and exposes a portion of the upper surface of the wiring 65. The through hole 75X is formed at a position overlapping the through hole 55Y in a plan view, and a portion of the through hole 75X is located in the through hole 55Y.

The wiring 66 includes a through hole 66X that extends through the wiring 66 in the thickness direction and communicates with the through hole 75X. The planar shapes of the through holes 66X, 75X are smaller than the planar shape of the through hole 55Y.

The insulation layer 56 includes a through hole 56X that extends through the insulation layer 56 in the thickness direction and communicates with the through holes 66X, 75X. The planar shape of the through hole 56X is larger than the planar shapes of the through holes 66X, 75X. The insulation layer 56 includes a through hole 56Y that extends through the insulation layer 56 in the thickness direction and exposes a portion of the upper surface of the wiring 66.

A via wiring V6 is formed in the communication through holes 56X, 66X, 75X. For example, the via wiring V6 is formed on the wiring 65 exposed from the through hole 75X, and the through holes 56X, 66X, 75X are all filled with the via wiring V6. The via wiring V6 serves as a through electrode that connects the wiring 65 (fifth-layer wiring) and the wiring 66 (sixth-layer wiring). The via wiring V6 (through electrode) extends through the insulation layer 55 of the structural body 45, the adhesive layer 75, and the wiring 66 and the insulation layer 56 of the structural body 46.

The adhesive layer 76 is stacked on the insulation layer 56. The structural body 47 is stacked on the adhesive layer 76. Therefore, the wiring 67, the connecting portion 67A, and the metal layer 67D are stacked on the adhesive layer 76. The insulation layer 57 is stacked on the adhesive layer 76 so as to cover the upper surfaces of the wiring 67, the connecting portion 67A, and the metal layer 67D.

As illustrated in FIG. 6, the planar shape of the wiring 67 is formed to have a substantially elliptical shape. A groove 67Y that extends through the wiring 67 in the thickness direction is formed at a certain location in the wiring 67. That is, the wiring 67 is cut in the widthwise direction by the groove 67Y and formed to have a non-ring-like shape. The wiring 67 is a portion of the helical coil, and serves as a seventh-layer wiring (about one winding) of the coil.

The connecting portion 67A is formed at one end of the wiring 67. The connecting portion 67A is formed at a position corresponding to the projection 22 (refer to FIG. 2) of the coil substrate 20. The connecting portion 67A is formed integrally with the wiring 67. In other words, the connecting portion 67A is a portion of the wiring 67. The connecting portion 67A is exposed from the insulation film 25 at a side surface 20B (refer to FIG. 8A) of the coil substrate 20 subsequent to singulation. The connecting portion 67A is connected to the electrode 93 of the inductor 90 (refer to FIG. 8B). The metal layer 67D is a dummy pattern similar to the metal layer 61D (refer to FIG. 5), and is spaced apart from the wiring 67 by a groove 67Z.

As illustrated in FIG. 4, the adhesive layer 76 covers the inner side surface of the through hole 56Y. The adhesive layer 76 also covers a portion of the respective side surfaces of the wiring 67, the connecting portion 67A, and the metal layer 67D. In the present example, the grooves 67Y, 67Z (refer to FIG. 6) are filled with the adhesive layer 76. The adhesive layer 76 includes a through hole 76X that extends through the adhesive layer 76 in the thickness direction and exposes a portion of the upper surface of the wiring 66. The through hole 76X is formed at a position overlapping the through hole 56Y in a plan view, and a portion of the through hole 76X is located in the through hole 56Y.

The wiring 67 includes a through hole 67X that extends through the wiring 67 in the thickness direction and communicates with the through hole 76X. The planar shapes of the through holes 67X, 76X are smaller than the planar shape of the through hole 56Y.

The insulation layer 57 includes a through hole 57X that extends through the insulation layer 57 in the thickness direction and communicates with the through holes 67X, 76X. The planar shape of the through hole 57X is larger than the planar shapes of the through holes 67X, 76X.

A via wiring V7 is formed in the communication through holes 57X, 67X, 76X. For example, the via wiring V7 is formed on the wiring 66 exposed from the through hole 76X, and the through holes 57X, 67X, 76X are all filled with the via wiring V7. The via wiring V7 serves as a through electrode that connects the wiring 66 (sixth-layer wiring) and the wiring 67 (seventh-layer wiring) in series. The via wiring V7 (through electrode) extends through the insulation layer 56 of the structural body 46, the adhesive layer 76, and the wiring 67 and the insulation layer 57 of the structural body 47.

As illustrated in FIG. 6, the insulation layer 57 includes a through hole 57Y that extends through the insulation layer 57 in the thickness direction and exposes a portion of the upper surface of the wiring 67. The through hole 57Y is filled by a via wiring V8 (refer to FIG. 7). The wiring 67 is electrically connected to the via wiring V8.

The planar shapes of the through holes 64X to 67X, 73X to 76X may have any shape and any size. For example, the planar shapes of the through holes 64X to 67X, 73X to 76X may be a circular shape having a diameter of approximately 140 to 180 μm. The planar shapes of the through holes 54X to 57X, 54Y to 57Y that are larger than the planar shapes of the through holes 64X to 67X, 73X to 76X may be, for example, a circular shape having a diameter of approximately 200 to 300 μm. Furthermore, copper and copper alloy, for example, may be used as the material of the via wirings V1 to V8 illustrated in FIG. 7.

Figure 7:
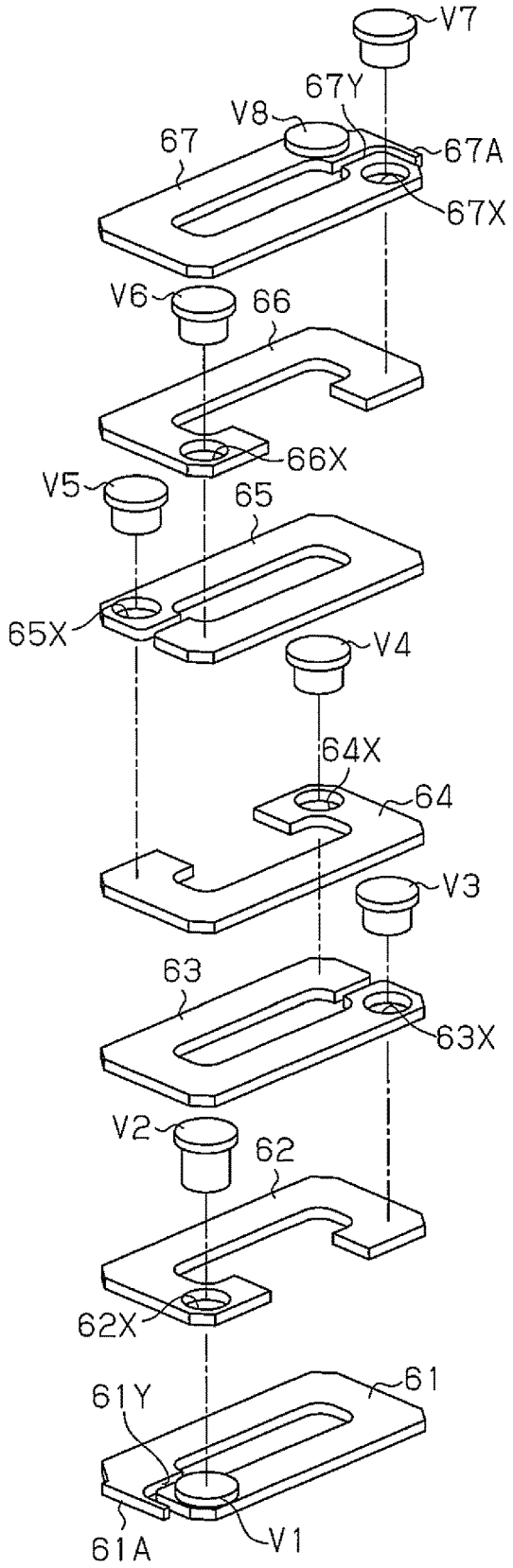
FIG. 7 is a schematic perspective view illustrating the wiring structure of the unit coil substrate.

Thus, the wirings 61 to 67 of the structural bodies 41 to 47 adjacent in the thickness direction in the coil substrate 20 are connected in series by the via wirings V1 to V8, as illustrated in FIG. 7, to form a helical coil from the connecting portion 61A to the connecting portion 67A. In other words, the connecting portion 61A is arranged at one end of the helical coil, and the connecting portion 67A is arranged at the other end of the helical coil.

As illustrated in FIG. 2, the through hole 23X that extends through the stacked body 23 in the thickness direction is formed at a substantially central part in a plan view of the stacked body 23. As illustrated in FIGS. 3 and 4, the side surfaces of the wirings 61 to 67 are exposed at the inner wall surface of the through hole 23X.

The insulation film 25 covers the entire surface of the stacked body 23. As illustrated in FIGS. 2 and 4, the insulation film 25 continuously covers the outer wall surface (side wall) of the stacked body 23, the lower surface and the side surface of the wiring 61 located at the lowermost layer of the stacked body 23, the upper surface of the insulation layer 57 located at the uppermost layer of the stacked body 23, the upper surface of the via wiring V7, the upper surface of the via wiring V8 (refer to FIG. 7), and the inner wall surface of the through hole 23X. Therefore, the insulation film 25 covers the side surfaces of the wirings 61 to 67 exposed at the inner wall surface of the through hole 23X. The insulation film 25 covers the side surface of the wiring 61 exposed in the grooves 61Y, 61Z. As illustrated in FIG. 2, for example, the insulation film 25 covers the upper surface and the lower surface of the stacked body 23 from the position overlapping the connecting portion 67A in a plan view to the position overlapping the metal layer 67D (connecting portion 61A) in a plan view. In the present example, the insulation film 25 further covers a portion of the coupling portion 12. The majority of the coupling portion 12 and the entire surface of the outer frame 13 are exposed from the insulation film 25. The insulation layer 57 is not illustrated in FIG. 2. Further, the insulation film 25 on the stacked body 23 is not illustrated in FIG. 2.

For example, an insulative resin such as an epoxy-based resin, an acryl-based resin, and the like may be used as the material of the insulation film 25. The insulation film 25 may contain a filler of silica, alumina, or the like. The thickness of the insulation film 25 is approximately 10 to 50 μm, for example.

The coil substrate 20 described above is coupled to the adjacent coil substrate 20 by the coupling portion 12. The structure of the coupling portion 12 will be briefly described below.

As illustrated in FIG. 3, the insulation layer 51 and the metal layer 81 are sequentially stacked on the lower surface 30A of the substrate 30. The adhesive layer 71, the metal layer 82, the insulation layer 52, the adhesive layer 72, the metal layer 83, the insulation layer 53, the adhesive layer 73, the metal layer 84, the insulation layer 54, the adhesive layer 74, the metal layer 85, the insulation layer 55, the adhesive layer 75, the metal layer 86, the insulation layer 56, the adhesive layer 76, the metal layer 87, and the insulation layer 57 are stacked in order on the upper surface 30B of the substrate 30. As illustrated in FIG. 4, the metal layer 81 is electrically connected to the metal layer 61D and the connecting portion 61A, the metal layer 82 is electrically connected to the metal layer 62D, the metal layer 83 is electrically connected to the metal layer 63D, and the metal layer 84 is electrically connected to the metal layer 64D. Furthermore, the metal layer 85 is electrically connected to the metal layer 65D, the metal layer 86 is electrically connected to the metal layer 66D, and the metal layer 87 is electrically connected to the metal layer 67D and the connecting portion 67A. Copper and copper alloy, for example, may be used as the material of the metal layers 81 to 87.

As illustrated in FIG. 2, a recognition mark 12X is formed at the certain location in the coupling portion 12. The recognition mark 12X extends through the coupling portion 12 in the thickness direction. The recognition mark 12X is used as an alignment mark, for example. The planar shape of the recognition mark 12X may have any shape and any size. For example, the planar shape of the recognition mark 12X is substantially circular.

The structure of the outer frame 13 will now be described.

As illustrated in FIG. 3, the outer frame 13 is formed only by the substrate 30. The outer frame 13 is formed at the two end regions of the substrate 30, for example. The outer frame 13, for example, is formed by extending the substrate 30 to the outer side of the coupling portion 12. In other words, only the substrate 30 projects to the outer side of the coupling portion 12. The sprocket holes 13X described above are formed in the outer frame 13 (substrate 30). Each sprocket hole 13X extends through the substrate 30 in the thickness direction.

Figure 8A:
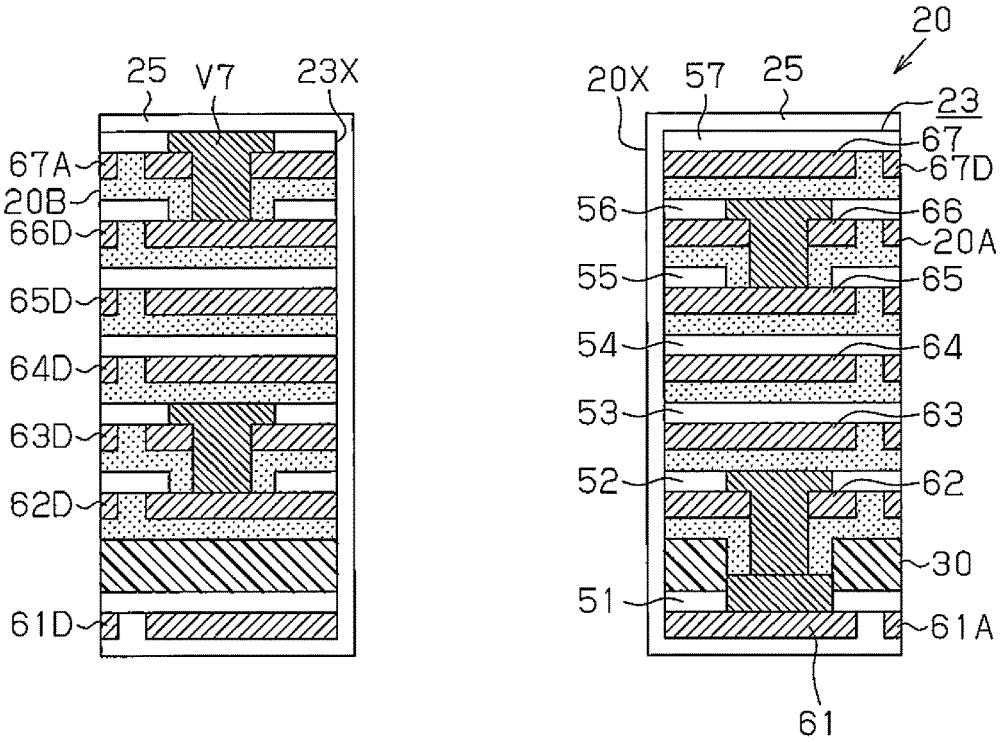
FIG. 8A is a schematic cross-sectional view illustrating the unit coil substrate after singulation.
Figure 8B:
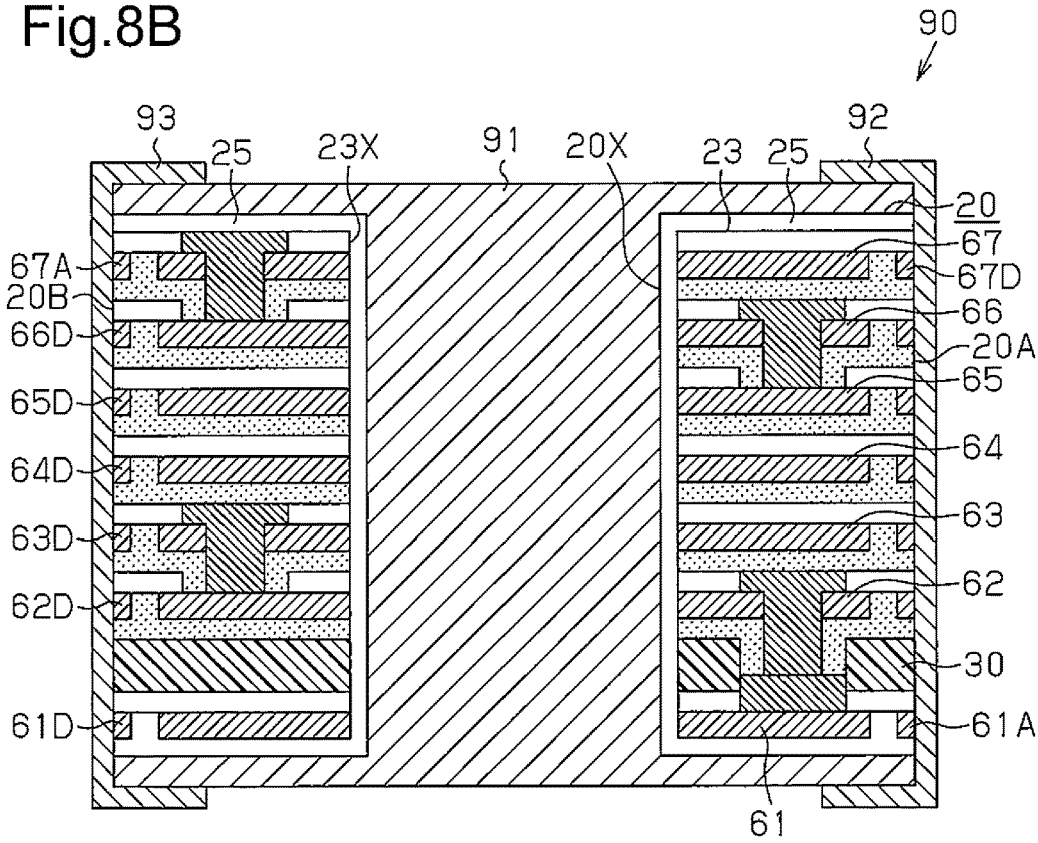
FIG. 8B is a schematic cross-sectional view illustrating an inductor that uses the unit coil substrate.

FIG. 8A illustrates the coil substrate singulated by cutting the insulation film 25, the substrate 30, the insulation layers 51 to 57, the metal layers 61D to 67D, and the like at the cutting position illustrated by broken lines in FIG. 4. The connecting portion 61A is exposed at one side surface 20A of the coil substrate 20. The connecting portion 67A is exposed at the other side surface 20B of the coil substrate 20. Subsequent to the singulation, the coil substrate 20 may also be used upside down. Furthermore, the coil substrate 20 may be arranged at any angle subsequent to the singulation.

The structure of the inductor 90 including the coil substrate 20 will now be described.

As illustrated in FIG. 8B, the inductor 90 is a chip inductor including the coil substrate 20, an encapsulation resin 91 that encapsulates the coil substrate 20, and the electrodes 92, 93. The planar shape of the inductor 90 is, for example, substantially rectangular and approximately 1.6 mm×0.8 mm. The thickness of the inductor 90 is, for example, approximately 1.0 mm. The inductor 90 may be used, for example, in a voltage conversion circuit of a compact electronic device.

The encapsulation resin 91 encapsulates the coil substrate 20 excluding the side surface 20A and the side surface 20B. In other words, the encapsulation resin 91 entirely covers the coil substrate 20 (stacked body 23 and insulation film 25) excluding the side surfaces 20A, 20B where the connecting portions 61A, 67A are exposed. The encapsulation resin 91 covers the upper surface and the lower surface of the insulation film 25. The encapsulation resin 91 also covers the side surface of the insulation film 25 defining the inner wall surface of the through hole 20X. In the present example, the through hole 20X is filled with the encapsulation resin 91. Therefore, the encapsulation resin 91 covers the entire inner wall surface of the through hole 20X. The encapsulation resin 91 functions as a magnetic body. In other words, a magnetic material is used for the encapsulation resin 91. The magnetic material is formed from magnetic powder and a resin that serves as a bonding material. For example, ferrite or a magnetic metal, such as iron or an iron-based alloy, may be used as the material of the magnetic powder. As the material of the bonding material, for example, a thermosetting resin such as an epoxy-based resin or a thermoplastic resin may be used. The magnetic material functions to increase the inductance of the inductor 90.

Thus, in the inductor 90, the through hole 20X formed at substantially the central part of the coil substrate 20 is filled with the encapsulation resin 91 that functions as the magnetic body. Therefore, more portions around the coil substrate 20 may be encapsulated with the magnetic body (encapsulation resin 91) compared to when the through hole 20X is not formed. The inductance of the inductor 90 may thus be enhanced.

The core of the magnetic body such as the ferrite may be arranged in the through hole 20X. In this case, the encapsulation resin 91 may be formed to encapsulate the coil substrate 20 together with the core of the magnetic body. The shape of the core of the magnetic body may be, for example, a circular column shape or a cuboid shape.

The electrode 92 is formed on the outer side of the encapsulation resin 91, and is connected to a portion of the connecting portion 61A. The electrode 92 continuously covers the side surface 20A of the coil substrate 20, the side surface of the encapsulation resin 91 formed flush with the side surface 20A, and portions of the upper surface and the lower surface of the encapsulation resin 91. The inner wall surface of the electrode 92 contacts the side surface of the connecting portion 61A exposed at the side surface 20A of the coil substrate 20. Therefore, the electrode 92 is electrically connected to the connecting portion 61A.

The electrode 93 is formed on the outer side of the encapsulation resin 91, and is connected to a portion of the connecting portion 67A. The electrode 93 continuously covers the side surface 20B of the coil substrate 20, the side surface of the encapsulation resin 91 formed flush with the side surface 20B, and portions of the upper surface and the lower surface of the encapsulation resin 91. The inner wall surface of the electrode 93 contacts the side surface of the connecting portion 67A exposed at the side surface 20B of the coil substrate 20. Therefore, the electrode 93 is electrically connected to the connecting portion 67A.

Copper and copper alloy, for example, may be used as the material of the electrodes 92, 93. The electrodes 92, 93 may have a stacked structure including a plurality of metal layers.

The electrodes 92, 93 are also connected to the metal layers 51D to 67D arranged as dummy patterns. However, the metal layers 61D to 67D are not electrically connected to the wirings 61 to 67 and the other metal layers. The metal layers 61D to 67D are electrically isolated. Thus, the wirings 61 to 67 are not short-circuited by the metal layers 61D to 67D and the electrodes 92, 93.

A method for manufacturing the coil substrate 10 will now be described.

Figure 9:
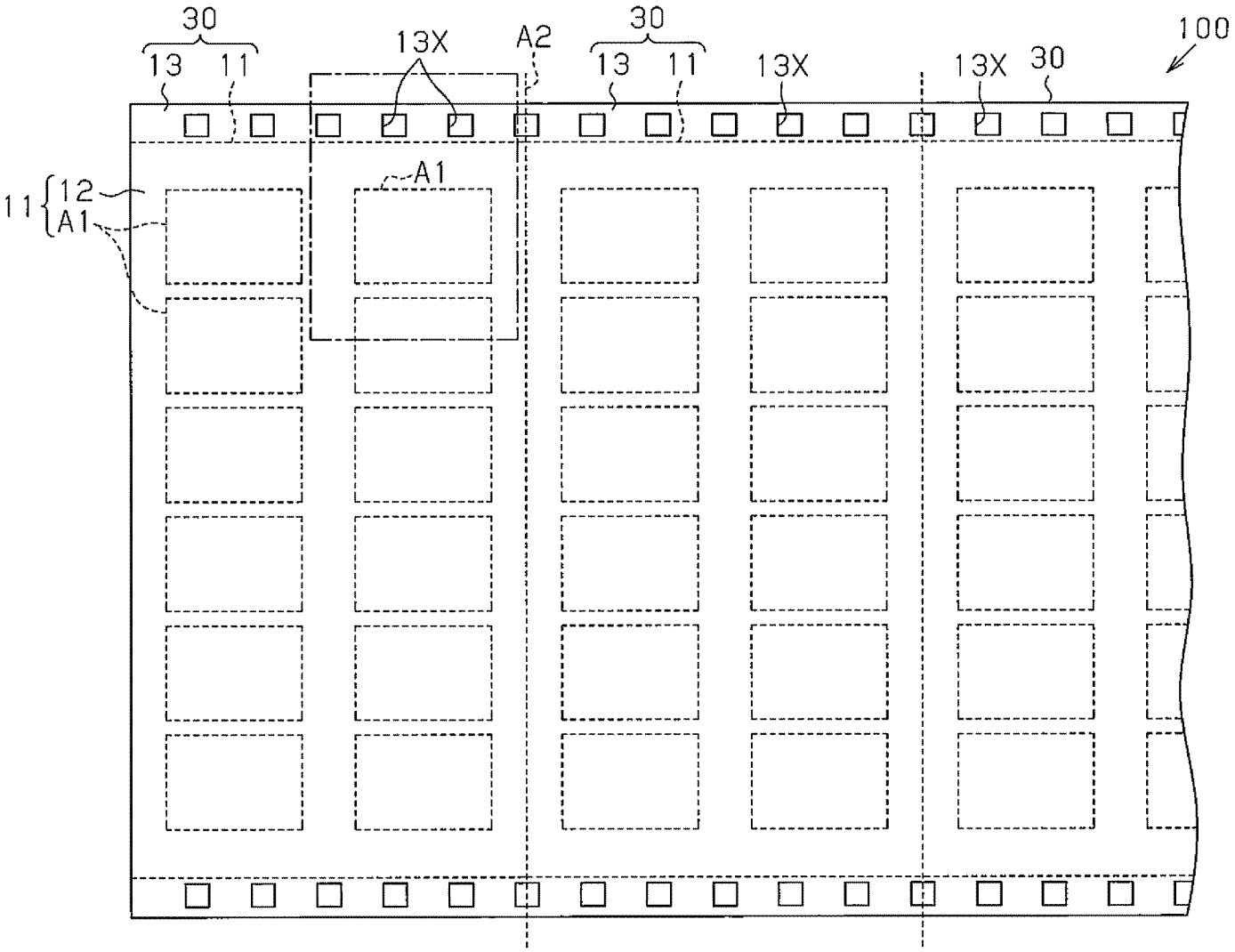
FIG. 9 is a schematic plan view illustrating a manufacturing method of the coil substrate of FIG. 1.

First, in the step illustrated in FIG. 9, the substrate 100 is prepared. The substrate 100 includes a plurality of substrates 30, each having a block 11 and an outer frame 13. Each block 11 includes a plurality of individual regions A1 and a coupling portion 12 that surrounds the individual regions A1. The outer frame 13 is arranged at two ends (upper end and lower end in FIG. 9) of the substrate 100. The outer frame 13 includes a plurality of sprocket holes 13X that extends through the substrate 30 in the thickness direction. The sprocket holes 13X are arranged at substantially constant intervals in the longitudinal direction (lateral direction in FIG. 9) of the substrate 100. The sprocket holes 13X may be formed in, for example, a pressing process or a laser cutting process. The sprocket holes 13X are through holes for conveying the substrate 100. When the substrate 100 is attached to the manufacturing device, the sprocket holes 13X are engaged with the pins of the sprocket driven by the motor or the like to convey the substrate 100 at the pitch of the sprocket holes 13X.

The substrate 100 may be a reel-like (tape-like) flexible insulative resin film. The width of the substrate 100 (length in the direction orthogonal in a plan view to the arraying direction of the sprocket holes 13X) is determined in accordance with the manufacturing device on which the substrate 100 is mounted. For example, the width of the substrate 100 may be approximately 40 to 90 mm. The substrate 100 may have any length. In the example illustrated in FIG. 9, the individual regions A1 are arranged in 6 rows and 2 columns in each substrate 30. However, each substrate 30 may be lengthened to provide, for example, several hundred columns of the individual regions A1. The reel-like substrate 100 is cut along the cutting position A2 and divided into a plurality of sheet-like coil substrates 10.

Hereinafter, the manufacturing of a single individual region A1 (illustrated by dashed lines in FIG. 9) of one substrate will be described for the sake of convenience.

Figure 10A:
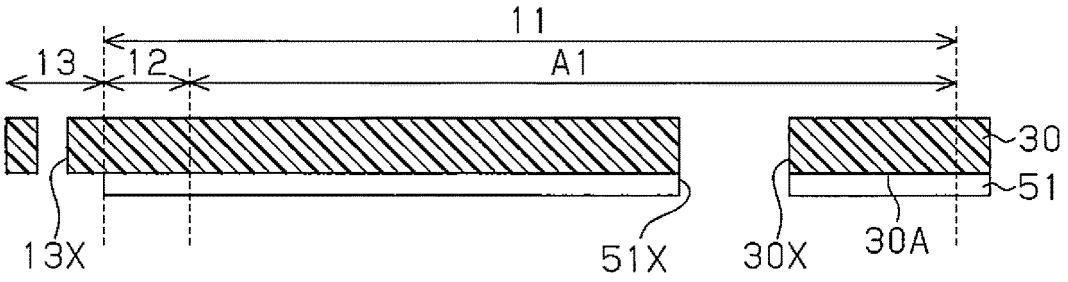
FIG. 10A is a schematic cross-sectional view taken along line 10*a*-10*a* in FIG. 10B and illustrating the manufacturing method of the coil substrate.
Figure 10B:
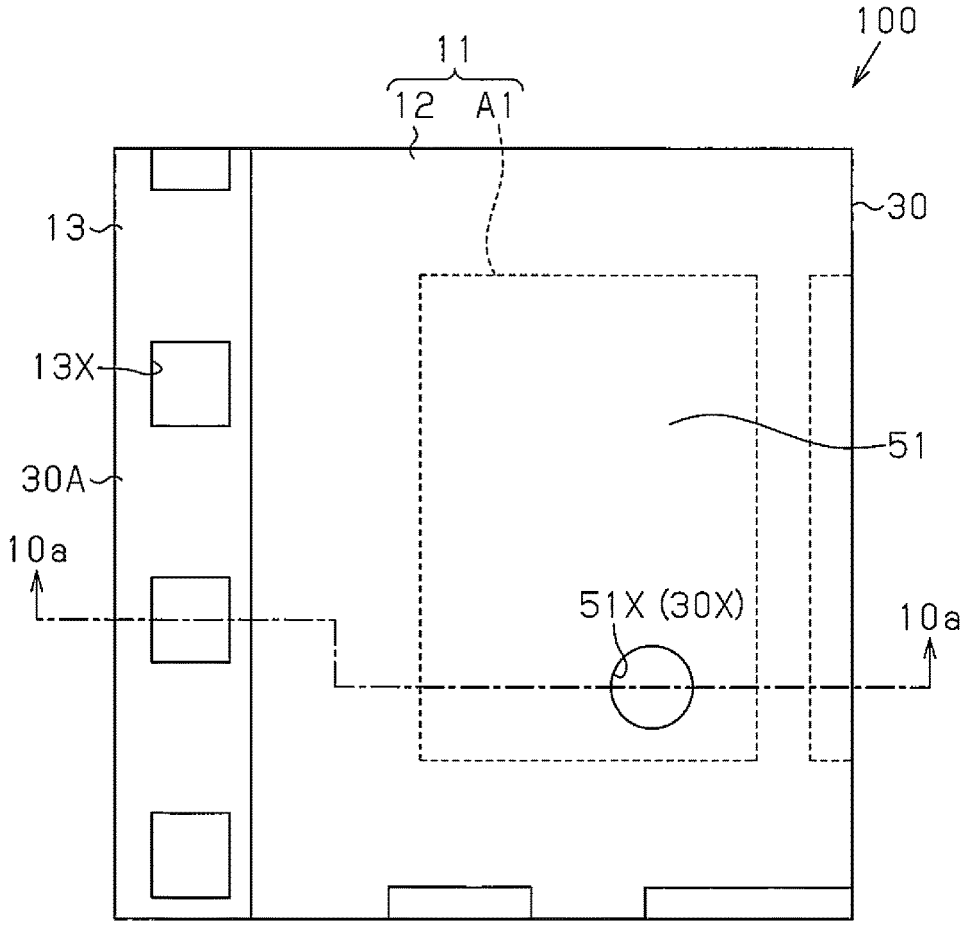
FIG. 10B is a schematic plan view illustrating the manufacturing method of the coil substrate.

In the steps illustrated in FIGS. 10A and 10B, the insulation layer 51 is stacked, in a semi-cured state, on the lower surface 30A of the substrate 30 in the region (i.e., block 11) excluding the outer frame 13. For example, the insulation layer 51 covers the entire lower surface 30A of the substrate 30 at the position of the block 11. For example, when using the insulative resin film for the insulation layer 51, the insulative resin film is laminated onto the lower surface 30A of the substrate 30. In this step, however, the insulative resin film is not thermally cured and is in the B-stage state (semi-cured state). The insulative resin film is laminated in the vacuum atmosphere to limit the formation of voids in the insulation layer 51. When using a liquid insulative resin or an insulative resin paste for the insulation layer 51, the liquid insulative resin or the insulative resin paste is, for example, applied to the lower surface 30A of the substrate 30 by a printing process or a spin coating process. Then, the liquid insulative resin or the insulative resin paste is pre-baked to the B-stage state.

Then, the through hole 30X is formed in the substrate 30 at the position of the individual region A1. Furthermore, the through hole 51X, which is in communication with the through hole 30X, is formed in the insulation layer 51 at the position of the individual region A1. The through holes 30X, 51X can be formed through a pressing process or a laser cutting process, for example. The sprocket holes 13X may be formed in this step. In other words, the through holes 30X, 51X and the sprocket holes 13X may be formed in the same step.

Figure 11A:
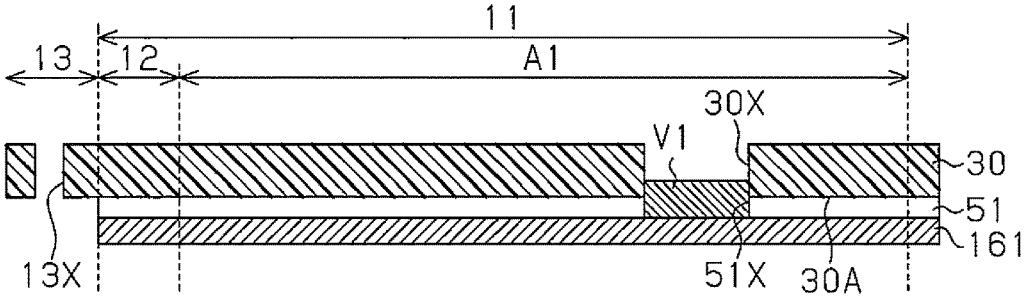
FIGS. 11A and 11B are schematic cross-sectional views taken along line 11*b*-11*b* in FIG. 11C and illustrating the manufacturing method of the coil substrate.

Next, in the step illustrated in FIG. 11A, a metal foil 161 is stacked on the lower surface of the semi-cured insulation layer 51. The metal foil 161 covers, for example, the entire lower surface of the insulation layer 51. For example, the metal foil 161 is laminated onto the lower surface of the semi-cured insulation layer 51 by thermal compression bonding. Then, a thermal curing process is performed under a temperature atmosphere of approximately 150° C. to cure the semi-cured insulation layer 51. When the insulation layer 51 is cured, the substrate 30 is adhered to the upper surface of the insulation layer 51, and the metal foil 161 is adhered to the lower surface of the insulation layer 51. In other words, the insulation layer 51 functions as an adhesive for adhering the substrate 30 and the metal foil 161. The metal foil 161 is patterned in a subsequent step to form the wiring 61, the connecting portion 61A, and the like. Copper foil, for example, may be used as the metal foil 161.

Then, the via wiring V1 is formed on the metal foil 161 exposed in the through hole 51X. In this step, the through hole 51X and a portion of the through hole 30X are filled with the via wiring V1. For example, a plated film is deposited in the through holes 30X, 51X through electrolytic plating using the metal foil 161 as a power supplying layer to form the via wiring V1. Alternatively, a metal paste of copper or the like may be applied to the metal foil 161 exposed in the through hole 51X to form the via wiring V1.

Figure 11B:
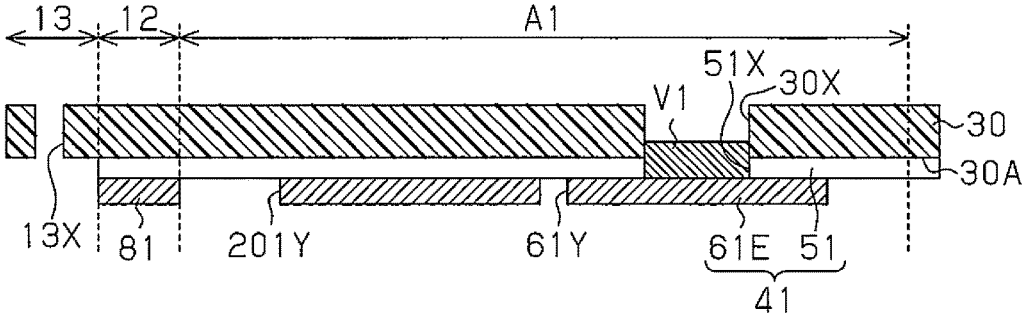
Figure 11C:
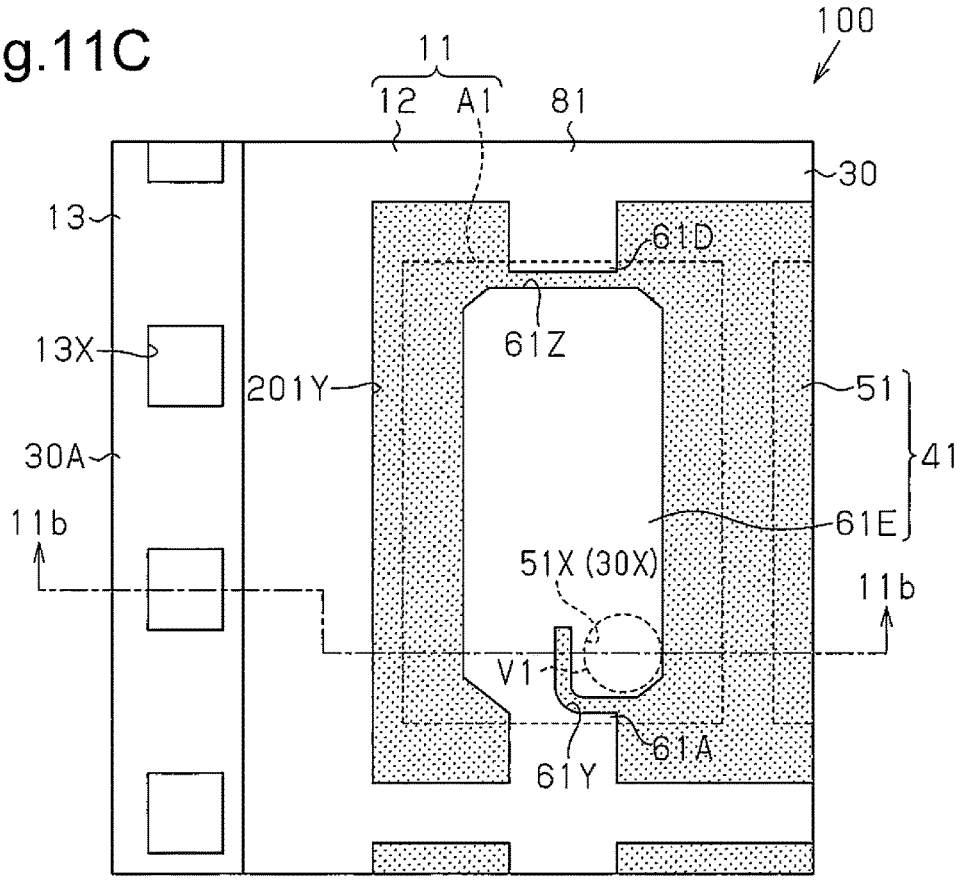
FIG. 11C is a schematic plan view illustrating the manufacturing method of the coil substrate.

Next, as illustrated in FIGS. 11B and 11C, the metal foil 161 is patterned to form the metal layer 61E on the lower surface of the insulation layer 51 at the position of the individual region A1. The patterning of the metal foil 161 forms the connecting portion 61A at one end of the metal layer 61E and the metal layer 61D, which serves as the dummy pattern. As a result, the structural body 41 including the insulation layer 51, the metal layer 61E, and the connecting portion 61A is stacked on the lower surface 30A of the substrate 30. The metal layer 61E formed in this step has a larger planar shape than the wiring 61 (portion of helical coil) illustrated in FIG. 7, for example. The metal layer 61E is ultimately punched out to form the first-layer wiring 61 (approximately one winding) of the helical coil. Furthermore, in this step, the metal layer 81, which is connected to the connecting portion 61A and the metal layer 61D, is formed on the lower surface of the insulation layer 51 at the position of the coupling portion 12. In other words, in this step, the metal foil 161 illustrated in FIG. 11A is patterned to form an opening 201Y and the grooves 61Y, 61Z, as illustrated in FIG. 11C. The groove 61Y enables the helical shape of the coil to be easily formed when shaping the coil substrate 20 in a subsequent step. The metal layer 81 formed in this step is used as a power supplying layer when performing electrolytic plating in a subsequent step. If electrolytic plating is not performed in a subsequent step, the formation of the metal layer 81 may be omitted. In FIG. 11C, the insulation layer 51 exposed from the opening 201Y and the grooves 61Y, 61Z is shaded.

The patterning of the metal foil 161 is performed, for example, using a wiring forming process such as a subtractive process. For example, the photosensitive resist is applied to the lower surface of the metal foil 161, and a predetermined region is exposed and developed to form an opening in the resist. Then, the metal foil 161 exposed from the opening is etched and removed. This integrally forms the metal layer 61E, the connecting portion 61A, the metal layer 61D, and the metal layer 81.

Figure 12A:
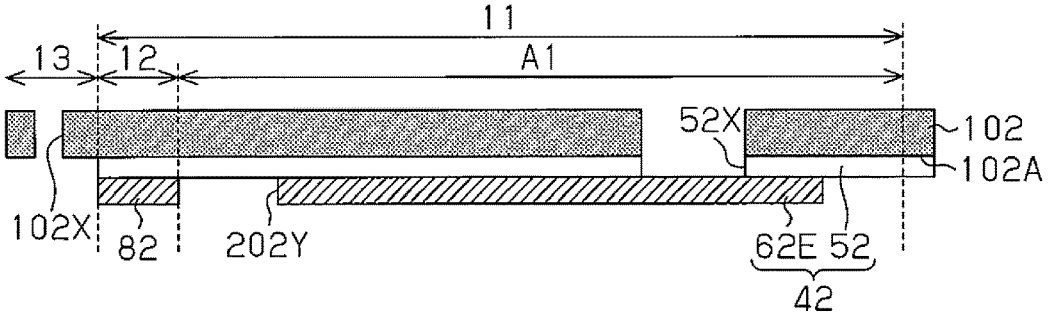
FIG. 12A is a schematic cross-sectional view taken along line 12*a*-12*a* in FIG. 12C and illustrating the manufacturing method of the coil substrate.

In the step illustrated in FIG. 12A, a support film 102 (support member) having a structure similar to the substrate 100 is first prepared. In other words, the support film 102 includes a block 11 with a plurality of individual regions A1, and an outer frame 13 projecting out to the outer side of the block 11. A reel-like (tape-like) flexible insulative resin film may be used, for example, for the support film 102. For example, polyphenylene sulfide (PPS), polyimide film, polyethylene naphtalate film, and the like may be used as the support film 102. The thickness of the support film 102 is, for example, approximately 12 to 50 μm.

Figure 12B:
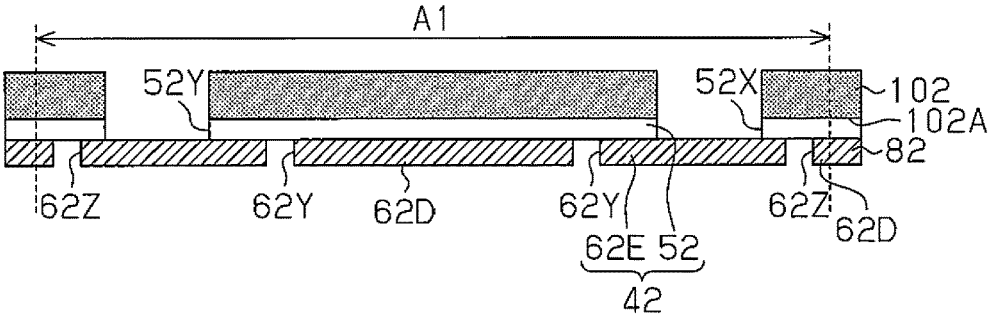
FIG. 12B is a schematic cross-sectional view taken along line 12*b*-12*b* in FIG. 12C and illustrating the manufacturing method of the coil substrate.
Figure 12C:
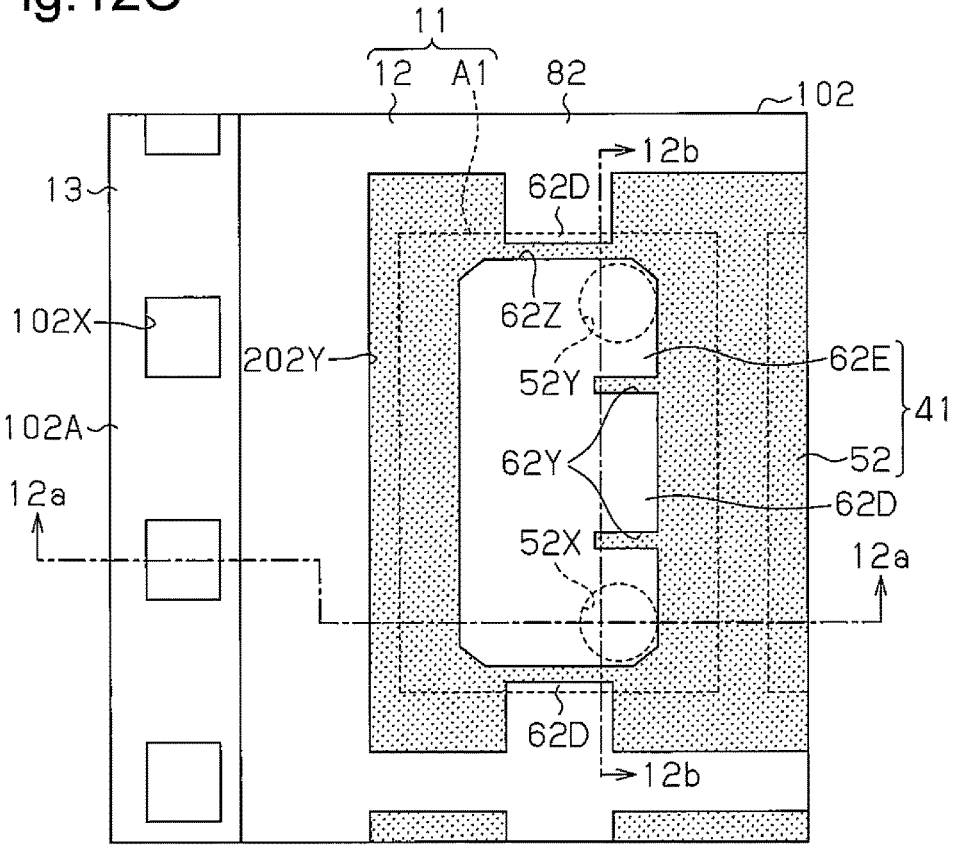
FIG. 12C is a schematic plan view illustrating the manufacturing method of the coil substrate.

Then like the steps illustrated in FIGS. 9 to 11A, the structural body 42 including the insulation layer 52 and the metal layer 62E is stacked on a lower surface 102A of the support film 102. For example, after forming the sprocket hole 102X in the support film 102 at the position of the outer frame 13, the insulation layer 52 in the semi-cured state is stacked on the lower surface 102A of the support film 102 at a position other than the outer frame 13. Then, as illustrated in FIG. 12B, the through holes 52X, 52Y that extend through the support film 102 and the insulation layer 52 in the thickness direction are formed through a pressing process or a laser cutting process. Then, the metal foil is stacked on the lower surface of the semi-cured insulation layer 52, and the metal foil is patterned by the subtractive method. As illustrated in FIGS. 12B and 12C, the metal layer 62E is formed on the lower surface of the insulation layer 52 at the position of the individual region A1, and the metal layer 62D serving as the dummy pattern is formed by patterning the metal foil. The metal layer 82, which is connected to the metal layer 62D, is formed on the lower surface of the insulation layer 52 at the position of the coupling portion 12. In other words, in this step, an opening 202Y and the grooves 62Y, 62Z are formed by patterning the metal foil stacked on the lower surface of the insulation layer 52. The metal layer 62E formed in this step has a larger planar shape than the wiring 62 (part of helical coil) illustrated in FIG. 7, for example. The metal layer 62E is ultimately punched out or the like to form the second-layer wiring 62 (approximately ¾ of a winding) of the helical coil. The metal layer 62E is separated from the metal layer 82 by the opening 202Y and the groove 62Z. The groove 62Y enables the helical shape of the coil to be easily formed when shaping the coil substrate 20 in a subsequent step. In FIG. 12C, the insulation layer 52 exposed from the opening 202Y and the grooves 62Y, 62Z is shaded.

The sprocket holes 102X are through hole for conveying the support film 102 like the sprocket holes 13X. When the support film 102 is attached to the manufacturing device, the sprocket holes 102X engage with the pins of the sprocket driven by a motor or the like to convey the support film 102 at the pitch between the sprocket holes 102X.

Steps illustrated in FIGS. 13A to 14B will now be described. FIGS. 13A to 14B are cross-sectional views taken along line 12*b*-12*b* in FIG. 12C.

Figure 13A:
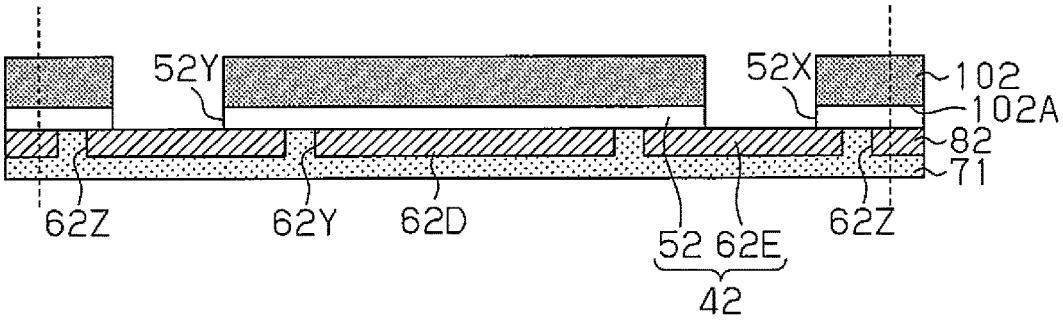
FIGS. 13A to 13C, 14A and 14B are schematic cross-sectional views illustrating the manufacturing method of the coil substrate.

First, in the step illustrated in FIG. 13A, the adhesive layer 71 in the semi-cured state that covers the entire surfaces (lower surface and side surface) of the metal layers 62D, 62E, 82 is stacked on the lower surface of the insulation layer 52. The grooves 62Y, 62Z and the opening 202Y (refer to FIG. 12A) are filled with the adhesive layer 71. For example, when using the insulative resin film for the adhesive layer 71, the insulative resin film is laminated to the lower surface of the insulation layer 52 by thermal compression bonding. The thermal compression bonding may be performed by pressing the insulative resin film at a predetermined pressure (e.g., approximately 0.5 to 0.6 MPa) under a vacuum atmosphere. In this step, however, the insulative resin film is not thermally cured and is in the B-stage state (semi-cured state). Alternatively, when using the liquid insulative resin or the insulative resin paste for the adhesive layer 71, the liquid insulative resin or the insulative resin paste is applied to the lower surface of the insulation layer 52, for example, by a printing process or a spin coating process. Then, the liquid insulative resin or the insulative resin paste is pre-baked to the B-stage state. The insulative resin having high fluidity is preferably used, for example, for the material of the adhesive layer 71. The grooves 62Y, 62Z and the opening 202Y may be filled by such insulative resin having high fluidity.

Figure 13B:
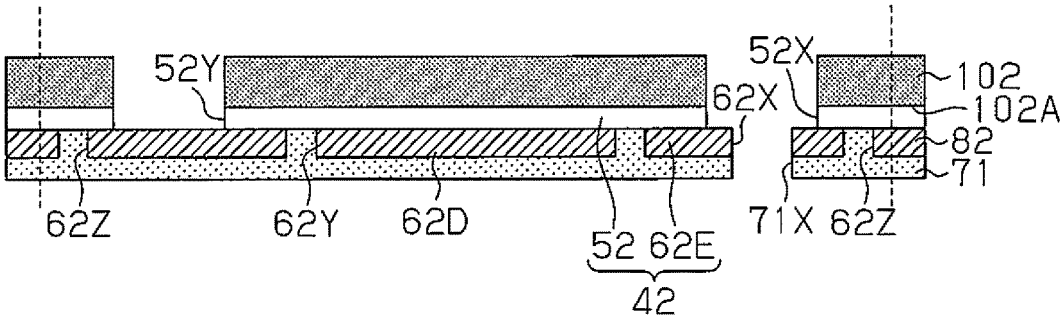

In the step illustrated in FIG. 13B, the through hole 62X is formed in the metal layer 62E, which is exposed from the through hole 52X, and the through hole 71X, which is in communication with the through hole 62X, is formed in the adhesive layer 71. The through holes 62X, 71X have smaller planar shapes than the through hole 52X. In the present example, the through holes 52X, 62X, 71X have a circular shape, and the diameter of the through holes 62X, 71X is smaller than the diameter of the through hole 52X. The upper surface of the metal layer 62E around the through hole 62X is thereby exposed from the through hole 52X. The through holes 62X, 71X may be formed through a pressing process or a laser cutting process, for example.

Figure 13C:
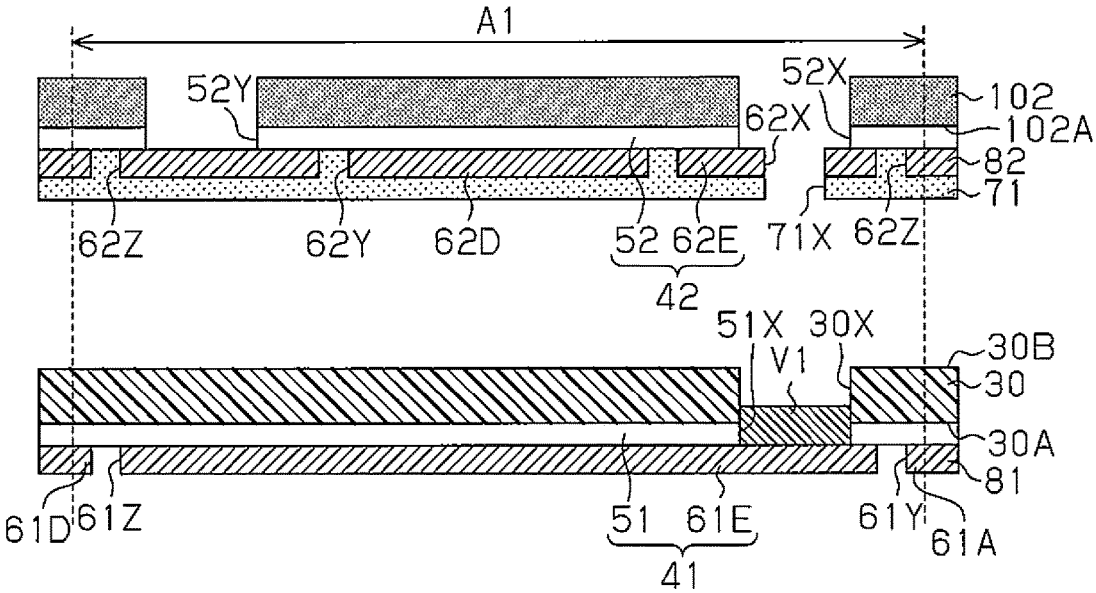

When the structural body 42 is stacked on the upper surface 30B of the substrate 30, the through holes 52X, 62X, 71X are formed at positions overlapping the through hole 30X in a plan view, as illustrated in FIG. 13C. The upper surface of the metal layer 62E is exposed from the through hole 52Y.

In the step illustrated in FIG. 13C, the structure illustrated in FIG. 13B (i.e., structure in which the structural body 42 and the adhesive layer 71 are stacked in order on the lower surface 102A of the support film 102) is arranged on the upper side of the structure in which the structural body 41 is stacked on the lower surface 30A of the substrate 30. In this case, the adhesive layer 71 is arranged faced downward to the upper surface 30B of the substrate 30.

Figure 14A:
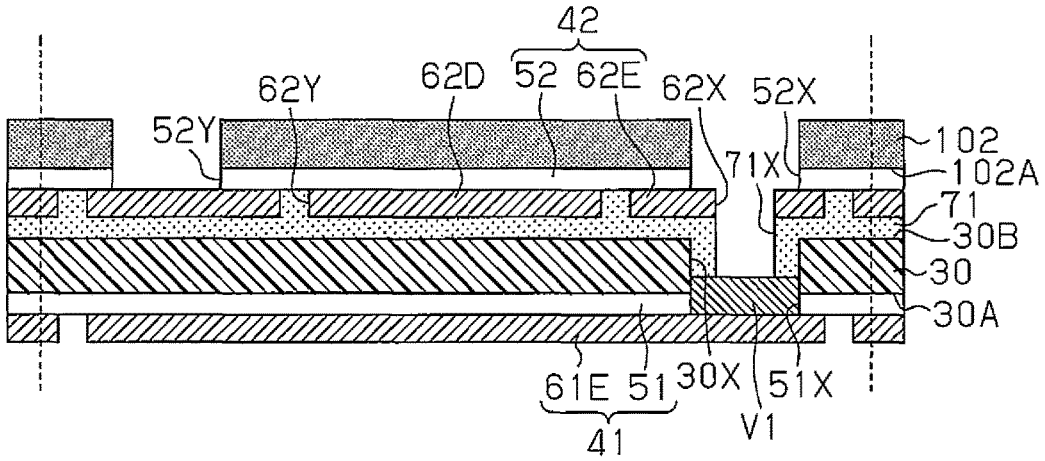

Then, in the step illustrated in FIG. 14A, the structural body 42 is stacked on the upper surface 30B of the substrate 30 by way of the adhesive layer 71 so that the structural body 41 and the support film 102 are arranged at the outer side. For example, the structure illustrated in FIG. 14A is hot pressed from above and below through vacuum pressing or the like. The adhesive layer 71 in the semi-cured state is then pressed and spread in the planar direction by the lower surface of the metal layer 62E and the upper surface 30B of the substrate 30. When using the insulative resin having high fluidity as the material of the adhesive layer 71 in this case, the adhesive layer 71 that spreads in the planar direction may leak into the through hole 71X and close the through hole 71X. In such a case, the entire upper surface of the via wiring V1 exposed from the through hole 30X will be covered by the adhesive layer 71, and the via wiring V2 connected to the via wiring V1 cannot be formed in a subsequent step. Thus, the through hole 30X of the substrate 30 is formed to have a larger diameter than the through hole 71X of the adhesive layer 71 in the present example. The pressure applied to the adhesive layer 71 around the through hole 30X is thus small to reduce leakage of the adhesive layer 71 into the through hole 71X. In other words, hot pressing limits reduction in the size of the planar shape of the through hole 71X. Furthermore, a portion of the adhesive layer 71 spreads into the through hole 30X in the present step, and the spread adhesive layer 71 covers the upper inner side surface of the through hole 30X exposed from the via wiring V1. As a result, a portion of the through hole 71X is formed in the through hole 30X. In the hot pressing of the present step, the structure illustrated in FIG. 14X is pressed from above and below with a pressure (e.g., approximately 0.2 to 0.6 MPa) that is the same as or smaller than the pressure of when laminating the adhesive layer 71 to the lower surface of the insulation layer 52.

Then, the adhesive layer 71 is cured. This maintains the through hole 71X, the through hole 62X, and the through hole 52X in communication. A portion of the upper surface of the via wiring V1 is thus exposed from the through hole 71X.

In the steps illustrated in FIGS. 12A to 14A, the through holes 62X, 71X may be formed after stacking the structural body 42 on the upper surface 30B of the substrate 30 by way of the adhesive layer 71.

Figure 14B:
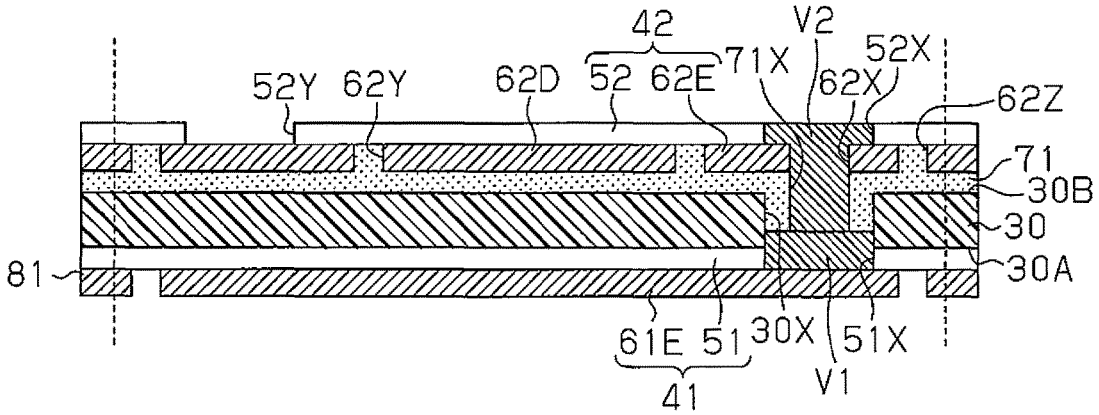

In the step illustrated in FIG. 14B, the support film 102 illustrated in FIG. 14A is removed from the insulation layer 52. For example, the support film 102 is mechanically removed from the insulation layer 52.

Then, the via wiring V2 is formed on the via wiring V1 exposed from the through hole 71X. The through holes 71X, 62X, 52X are filled with the via wiring V2. In this case, the through hole 52X has a larger diameter than the through holes 71X, 62X. Thus, the via wiring V2 also forms on a portion of the upper surface of the metal layer 62E. This connects the via wiring V2 to the side surface of the metal layer 62E defining the inner side surface of the through hole 62X and the upper surface of the metal layer 62E around the through hole 62X. As a result, the metal layer 61E and the metal layer 62E are connected in series by the via wirings V1, V2. In this step, for example, the upper surface of the via wiring V2 is formed to be substantially flush with the upper surface of the insulation layer 52. The via wiring V2 may be formed by performing electrolytic plating that uses both of the metal layer 81 and the metal layer 61E as the power supplying layers or by filling metal paste or the like. When forming the via wiring V2, the metal layer 62E exposed from the through hole 52Y is masked so that a plated film does not form on the through hole 52Y.

In the manufacturing steps described above, the metal layer 61E is connected in series to the metal layer 62E by the via wiring V1, V2 in the stacked structure including the structural body 41 stacked on the lower surface 30A of the substrate 30 and the structural body 42 stacked on the upper surface 30B of the substrate 30. The series conductor of the metal layers 61E, 62E and the via wirings V1, V2 corresponds to the portion of an approximately (1+¾) winding of the helical coil.

Figure 15A:
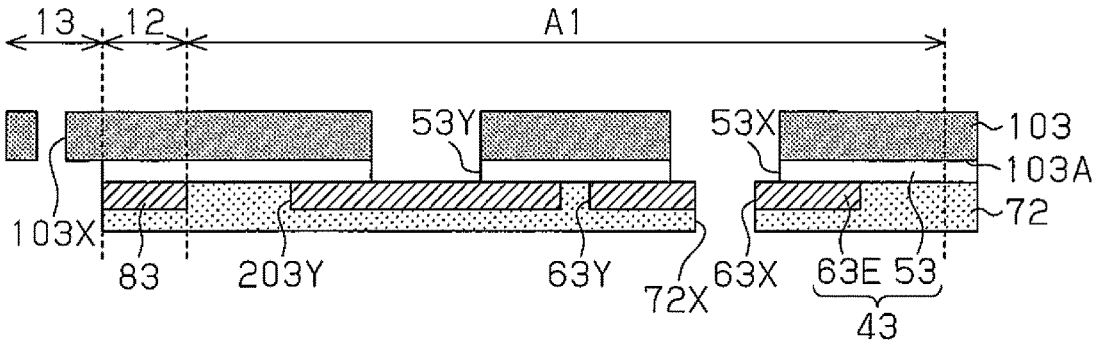
FIG. 15A is a schematic cross-sectional view taken along line 15*a*-15*a* in FIG. 15B and illustrating the manufacturing method of the coil substrate.

In the step illustrated in FIG. 15A, the structural body 43 including the insulation layer 53 and the metal layer 63E is stacked on a lower surface 103A of a support film 103 (support member), and the adhesive layer 72 is then stacked on the structural body 43. This step may be performed in the same manner as the steps illustrated in FIGS. 12A to 13B. The step of FIG. 15A and the steps illustrated in FIGS. 12A to 13B differ only in the position of the through hole and the shape of the metal layer (wiring) after patterning the metal foil. Thus, detailed description of the manufacturing method in the step of FIG. 15A will be omitted. The shape, thickness, material, and the like of the support film 103 and the support films 104 to 105 (support members) used in subsequent steps are similar to the support film 102 illustrated in FIG. 12A. Sprocket holes 103X to 107X formed in the outer frame 13 of each support film 103 to 107 are also similar to the sprocket holes 102X of the support film 102.

Figure 15B:
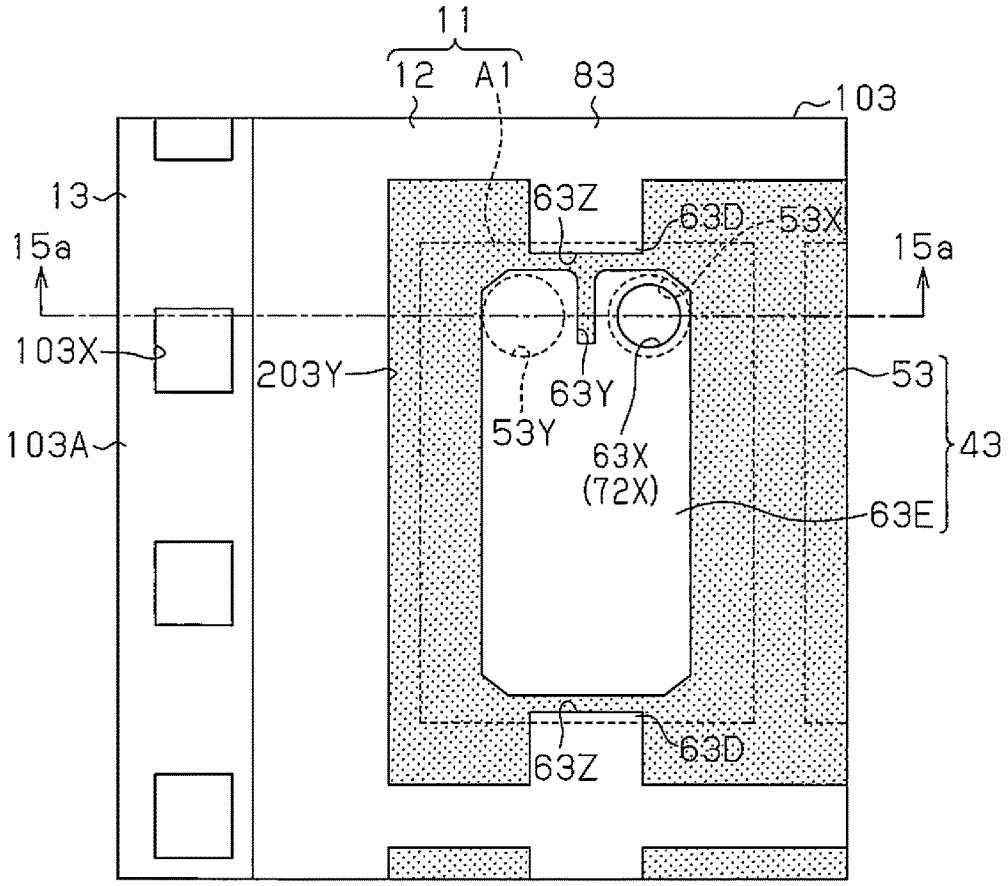
FIG. 15B is a schematic plan view illustrating the manufacturing method of the coil substrate.

The structure illustrated in FIG. 15A includes the through holes 53X, 53Y that extend through the support film 103 and the insulation layer 53 in the thickness direction, and the through holes 63X, 72X that extend through the metal layer 63E and the adhesive layer 72 in the thickness direction and communicate with the through hole 53X. The through hole 53X has a larger diameter than the through holes 63X, 72X. Thus, the upper surface of the metal layer 63E around the through hole 63X is exposed from the through hole 53X. As illustrated in FIG. 15B, the metal layer 63E, the metal layer 63D, and the metal layer 83 are formed on the lower surface of the insulation layer 53. The metal layer 63E is separated from the metal layers 63D, 83 by an opening 203Y and the groove 63Z. The groove 63Y formed in the metal layer 63E enables the helical shape of the coil to be easily formed when shaping the coil substrate 20 in a subsequent step. The metal layer 63E, for example, has a larger planar shape than the wiring 63 illustrated in FIG. 7. The metal layer 63E is ultimately punched out or the like to form the third-layer wiring 63 (about one winding) of the helical coil. As illustrated in FIG. 15A, the adhesive layer 72 is formed on the lower surface of the insulation layer 53 so as to cover the lower surface and the side surface of the metal layer 63E, and fill the opening 203Y, the groove 63Y, and the groove 63Z (refer to FIG. 15B). In FIG. 15B, the illustration of the adhesive layer 72 is omitted, and the insulation layer 53 exposed from the opening 203Y and the grooves 63Y, 63Z is illustrated shaded.

Figure 16A:
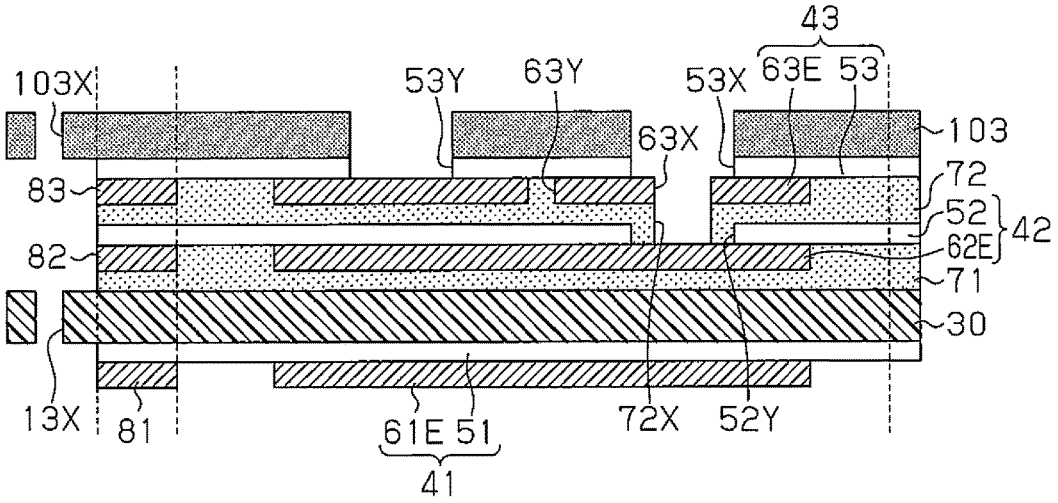
FIGS. 16A to 16C are schematic cross-sectional views illustrating the manufacturing method of the coil substrate.
Figure 16B:
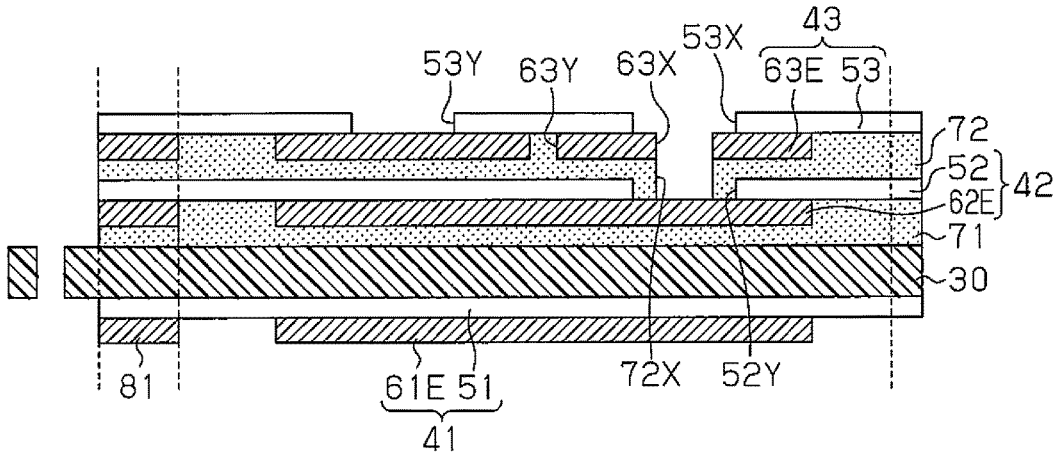
Figure 16C:
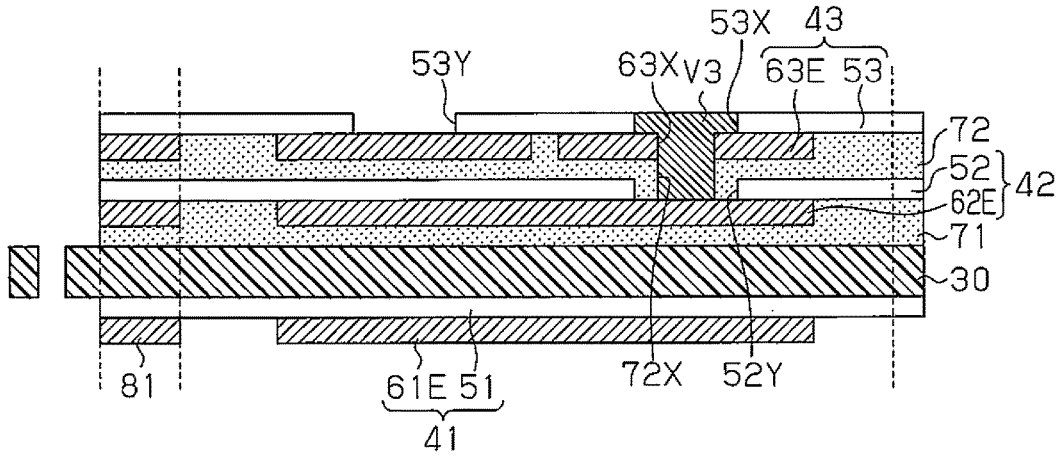

The steps illustrated in FIGS. 16A to 16C will now be described. FIGS. 16A to 16C are cross-sectional views taken along line 15*a*-15*a* in FIG. 15B.

First, in the step illustrated in FIG. 16A, the structural body 43 and the support film 103 are stacked on the insulation layer 52 of the structural body 42 through the adhesive layer 72 so that the structural body 41 and the support film 103 are arranged on the outer side like the step illustrated in FIG. 14A. In this case, the through hole 52Y of the insulation layer 52 has a larger diameter than the through hole 72X of the adhesive layer 72. Thus, leakage of the adhesive layer 72 into the through hole 72X may be like the adhesive layer 71. The inner side surface of the through hole 52Y is covered by the adhesive layer 72. As a result, a portion of the through hole 72X of the adhesive layer 72 forms in the through hole 52Y. Furthermore, the through hole 72X, the through hole 63X, and the through hole 53X are communicated, and the metal layer 62E is exposed from the through hole 72X.

In the step illustrated in FIG. 16B, the support film 103 illustrated in FIG. 16A is removed from the insulation layer 53. For example, the support film 103 is mechanically removed from the insulation layer 53.

Then, in the step illustrated in FIG. 16C, the via wiring V3 is formed in the same manner as the step illustrated in FIG. 14B. The through holes 72X, 63X, 53X are filled with the via wiring V3. The via wiring V3 is connected to the side surface of the metal layer 63E defining the inner side surface of the through hole 63X, the upper surface of the metal layer 63E around the through hole 63X, and the upper surface of the metal layer 62E exposed from the through hole 72X. As a result, the metal layer 62E and the metal layer 63E are connected in series by the via wiring V3. In this step, for example, the upper surface of the via wiring V3 is formed to be substantially flush with the upper surface of the insulation layer 53. The via wiring V3, for example, may be formed by performing electrolytic plating that uses both of the metal layer 81 and the metal layer 61E as the power supplying layers or by filling metal paste or the like.

In the manufacturing steps described above, the metal layers 61E, 62E, 63E are connected in series by the via wirings V1 to V3 in the stacked structure including the structural body 41, the substrate 30, the structural body 42, and the structural body 43. The series conductor of the metal layers 61E, 62E, 63E and the via wirings V1 to V3 corresponds to the portion of an approximately (2+¾) winding of the helical coil.

In the steps illustrated in FIGS. 15A to 16B, the through holes 63X, 72X may be formed after stacking the structural body 43 on the structural body 42 by way of the adhesive layer 72.

Figure 17A:
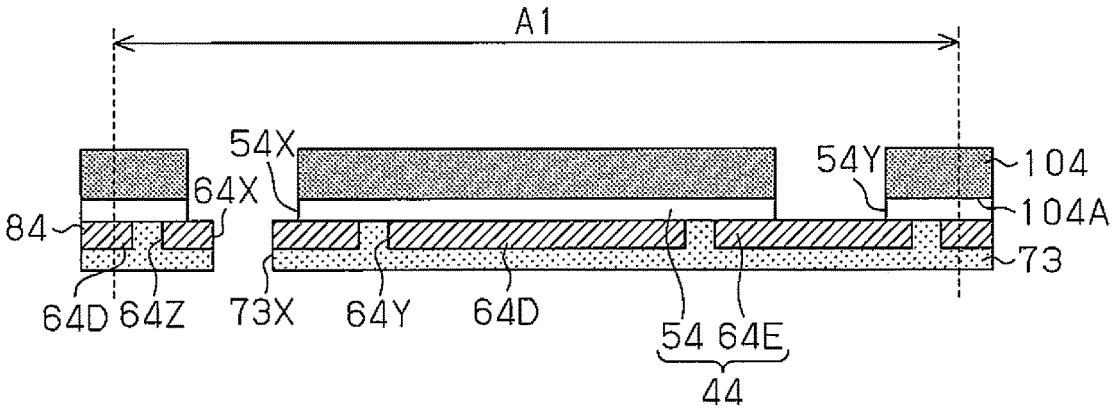
FIG. 17A is a schematic cross-sectional view taken along line 17*a*-17*a* in FIG. 17B and illustrating the manufacturing method of the coil substrate.

In the step illustrated in FIG. 17A, the structural body 44 including the insulation layer 54 and the metal layer 64E is stacked on a lower surface 104A of the support film 104. This step can be performed in the same manner as the steps illustrated in FIGS. 12A to 13B. Thus, detailed description of the manufacturing method in the step of FIG. 17A will be omitted.

Figure 17B:
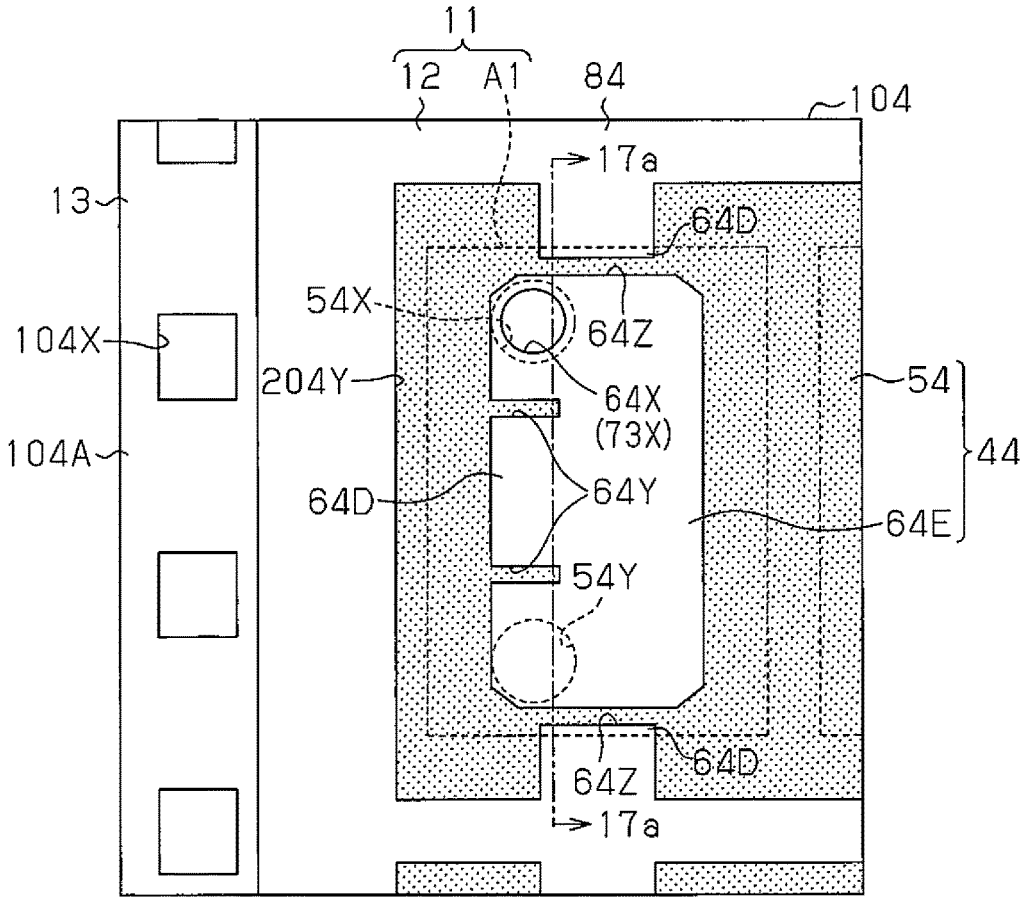
FIG. 17B is a schematic plan view illustrating the manufacturing method of the coil substrate.

The structure illustrated in FIG. 17A includes the through holes 54X, 54Y that extend through the support film 104 and the insulation layer 54 in the thickness direction, and the through holes 64X, 73X that extend through the metal layer 64E and the adhesive layer 73 in the thickness direction and communicate with the through hole 54X. The through hole 54X has a larger diameter than the through holes 64X, 73X. Thus, the upper surface of the metal layer 64E around the through hole 64X is exposed from the through hole 54X. The metal layer 64E, the metal layer 64D, and the metal layer 84 are formed on the lower surface of the insulation layer 54. As illustrated in FIG. 17B, the metal layer 64E is separated from the metal layers 64D, 84 by an opening 204Y and the groove 64Z. The groove 64Y formed in the metal layer 64E enables the helical shape of the coil to be easily formed when shaping the coil substrate 20 in a subsequent step. The metal layer 64E has a larger planar shape than the wiring 64 illustrated in FIG. 7, for example. The metal layer 64E is ultimately punched out or the like to form the fourth-layer wiring 64 (approximately ¾ winding) of the helical coil. Furthermore, as illustrated in FIG. 17A, the adhesive layer 73 is formed on the lower surface of the insulation layer 54 so as to cover the lower surface and the side surface of the metal layer 64E and to fill the opening 204Y (refer to FIG. 17B) and the grooves 64Y, 64Z. In FIG. 17B, the illustration of the adhesive layer 73 is omitted, and the insulation layer 54 exposed from the opening 204Y and the grooves 64Y, 64Z is illustrated shaded.

Figure 18A:
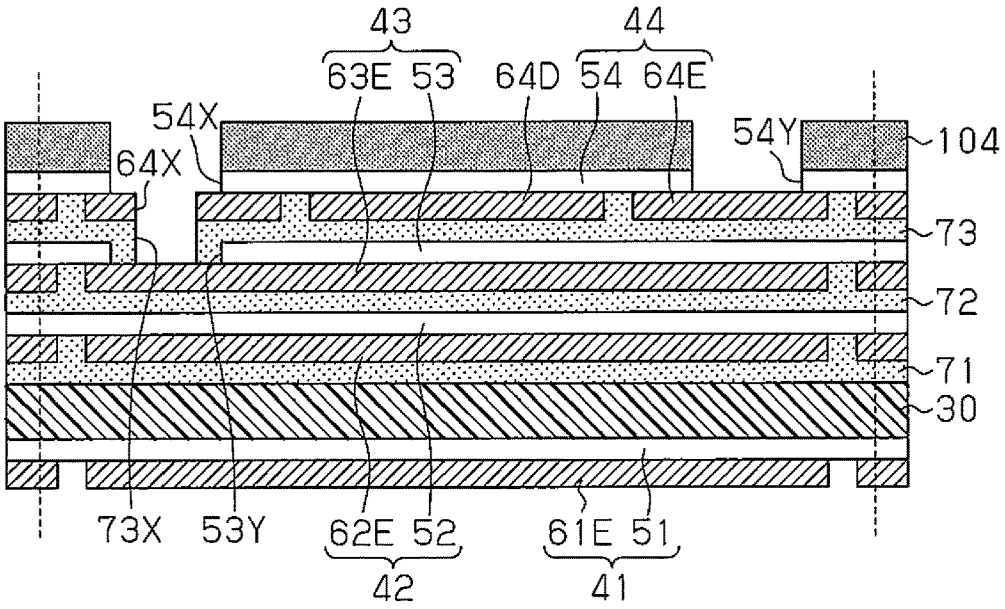
FIGS. 18A and 18B are schematic cross-sectional views illustrating the manufacturing method of the coil substrate.
Figure 18B:
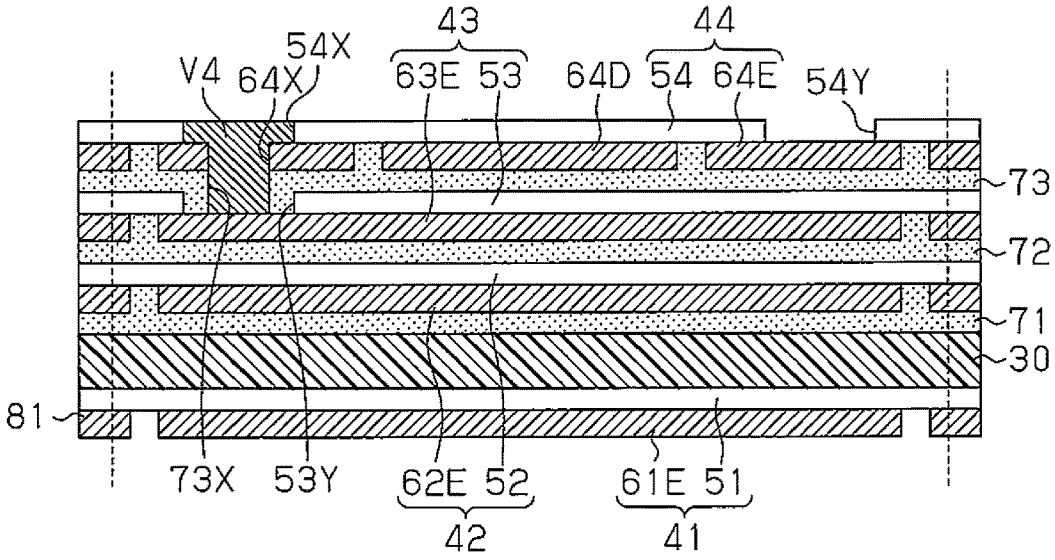

The steps illustrated in FIGS. 18A and 18B will now be described. FIGS. 18A and 18B are cross-sectional views taken along line 17*a*-17*a* in FIG. 17B.

First, in the step illustrated in FIG. 18A, the structural body 44 and the support film 104 are stacked on the insulation layer 53 of the structural body 43 by way of the adhesive layer 73 so that the structural body 41 and the support film 104 are arranged on the outer side. In this case, the through hole 53Y of the insulation layer 53 has a larger diameter than the through hole 73X of the adhesive layer 73. Thus, leakage of the adhesive layer 73 into the through hole 73X may be limited like the adhesive layer 71. The inner side surface of the through hole 53Y is covered by the adhesive layer 73. As a result, a portion of the through hole 73X of the adhesive layer 73 is formed in the through hole 53Y. Furthermore, the through hole 73X, the through hole 64X, and the through hole 54X are communicated, and the metal layer 63E is exposed from the through hole 73X. The support film 104 is then removed from the insulation layer 54.

Then, in the step illustrated in FIG. 18B, the via wiring V4 is formed like the step illustrated in FIG. 14B. The through holes 73X, 64X, 54X are filled with the via wiring V4. Thus, the via wiring V4 is connected to the side surface of the metal layer 64E defining the inner side surface of the through hole 64X, the upper surface of the metal layer 64E around the through hole 64X, and the upper surface of the metal layer 63E exposed from the through hole 73X. As a result, the metal layer 63E and the metal layer 64E are connected in series by the via wiring V4. In this step, for example, the upper surface of the via wiring V4 is formed to be substantially flush with the upper surface of the insulation layer 54. The via wiring V4 is, for example, formed by performing electrolytic plating that uses both of the metal layer 81 and the metal layer 61E as the power supplying layers or by filling metal paste or the like.

In the manufacturing steps described above, the metal layers 61E, 62E, 63E, 64E are connected in series by the via wirings V1 to V4 in the stacked structure including the structural body 41, the substrate 30, and the structural bodies 42 to 44. The series conductor of the metal layers 61E, 62E, 63E, 64E and the via wirings V1 to V4 corresponds to the portion of approximately three windings of the helical coil.

In the steps illustrated in FIGS. 17A and 18A, the through holes 64X, 73X may be formed after stacking the structural body 33 on the structural body 43 through the adhesive layer 73.

Figure 19A:
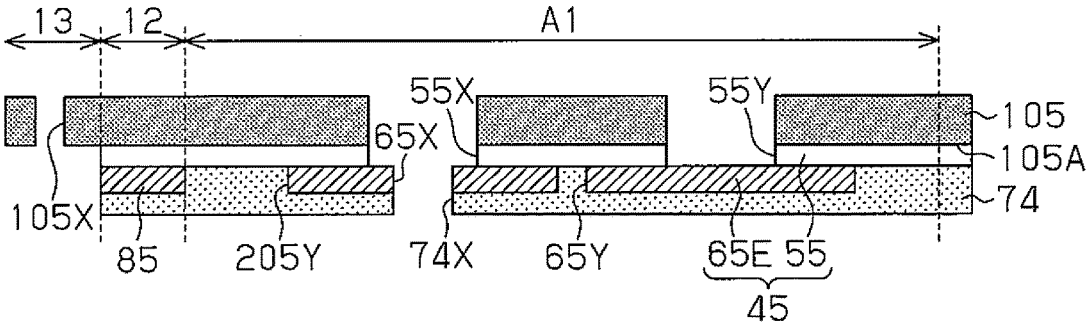
FIG. 19A is a schematic cross-sectional view taken along line 19*a*-19*a* in FIG. 19B and illustrating the manufacturing method of the coil substrate.

In the step illustrated in FIG. 19A, the structural body 45 including the insulation layer 55 and the metal layer 65E is stacked on a lower surface 105A of the support film 105. This step can be performed in the same manner as the steps illustrated in FIGS. 12A to 13B. Thus, detailed description of the manufacturing method in the step of FIG. 19A will be omitted.

Figure 19B:
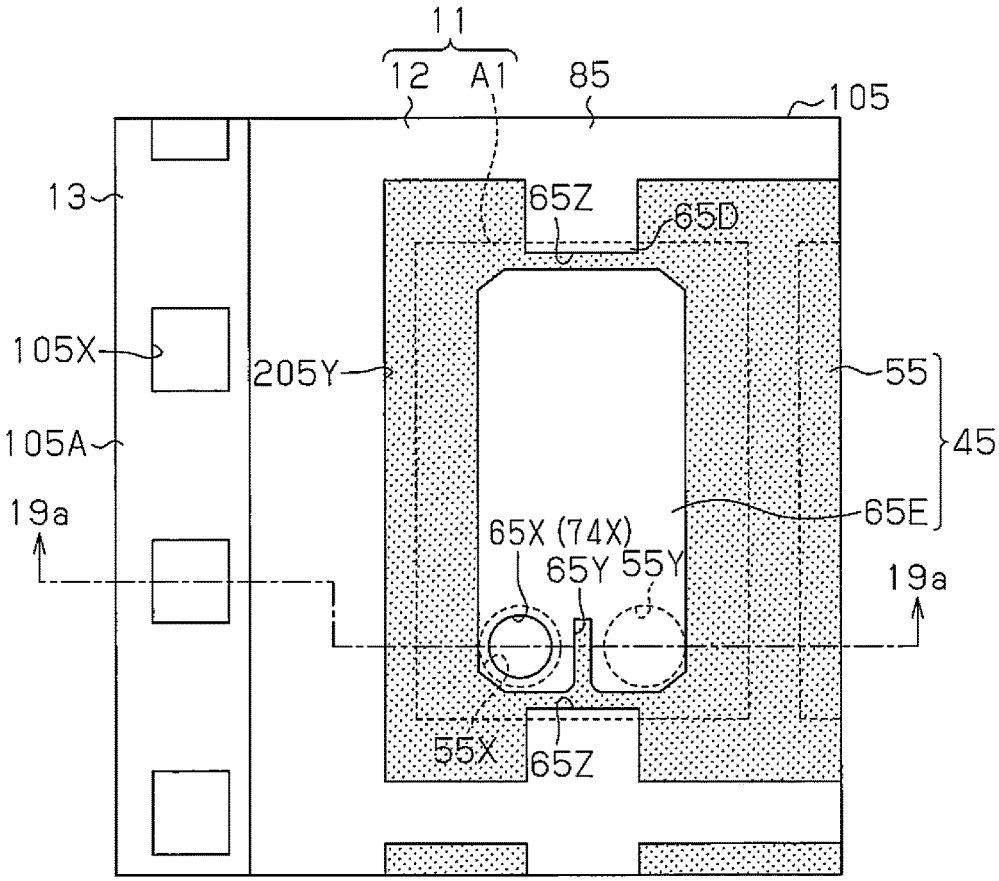
FIG. 19B is a schematic plan view illustrating the manufacturing method of the coil substrate.

The structure illustrated in FIG. 19A includes the through holes 55X, 55Y that extend through the support film 105 and the insulation layer 55 in the thickness direction, and the through holes 65X, 74X that extend through the metal layer 65E and the adhesive layer 74 in the thickness direction and communicate with the through hole 55X. The through hole 55X has a larger diameter than the through holes 65X, 74X. Thus, the upper surface of the metal layer 65E around the through hole 65X is exposed from the through hole 55X. Furthermore, as illustrated in FIG. 19B, the metal layer 65E, the metal layer 65D, and the metal layer 85 are formed on the lower surface of the insulation layer 55. The metal layer 65E is separated from the metal layers 65D, 85 by an opening 205Y and the groove 65Z. The groove 65Y formed in the metal layer 65E enables the helical shape of the coil to be easily formed when shaping the coil substrate 20 in a subsequent step. The metal layer 65E has a larger planar shape than the wiring 65 illustrated in FIG. 7, for example. The metal layer 65E is ultimately punched out or the like to form the fifth-layer wiring 65 (about one winding) of the helical coil. As illustrated in FIG. 19A, the adhesive layer 74 is formed on the lower surface of the insulation layer 55 to cover the lower surface and the side surface of the metal layer 65E and fill the opening 205Y, the groove 65Y, and the groove 65Z (refer to FIG. 19B). In FIG. 19B, the illustration of the adhesive layer 74 is omitted, and the insulation layer 55 exposed from the opening 205Y and the grooves 65Y, 65Z is illustrated shaded.

Figure 20A:
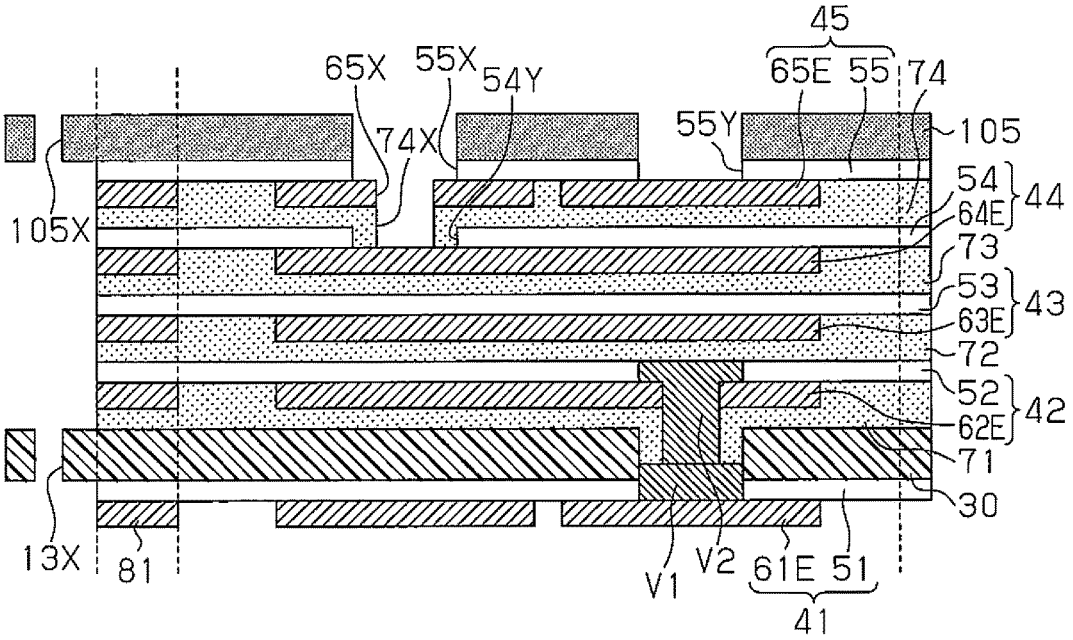
FIGS. 20A and 20B are schematic cross-sectional views illustrating the manufacturing method of the coil substrate.
Figure 20B:
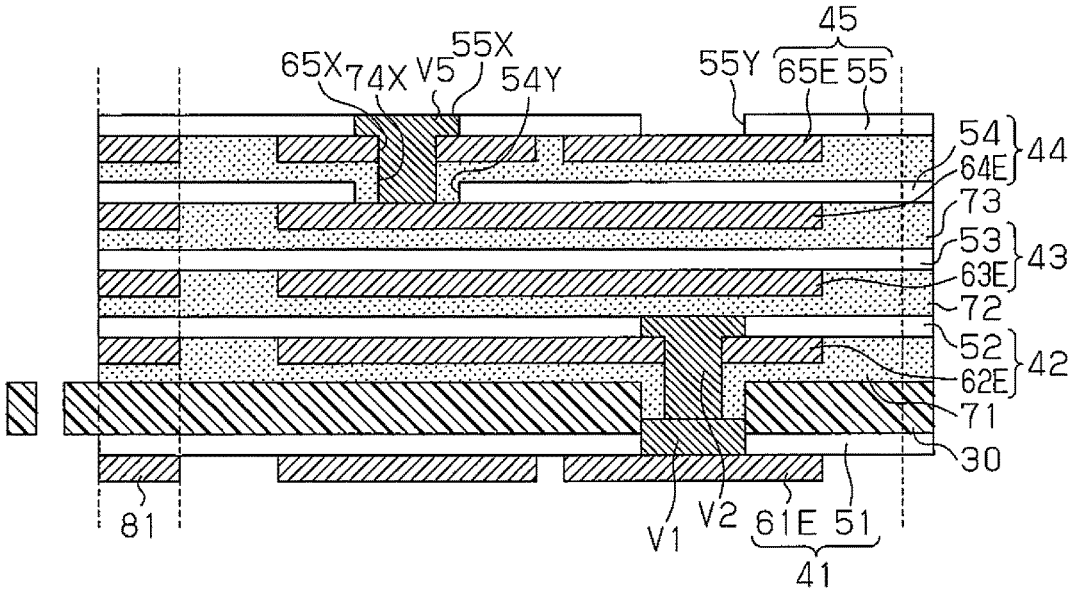

The steps illustrated in FIGS. 20A and 20B will now be described. FIGS. 20A and 20B are cross-sectional views taken along line 19*a*-19*a* in FIG. 19B.

First, in the step illustrated in FIG. 20A, the structural body 45 and the support film 105 are stacked on the insulation layer 54 of the structural body 44 through the adhesive layer 74 so that the structural body 41 and the support film 105 are arranged on the outer side like the step illustrated in FIG. 14A. In this case, the through hole 54Y of the insulation layer 54 has a larger diameter than the through hole 74X of the adhesive layer 74. Thus, the leakage of the adhesive layer 74 into the through hole 74X may be limited like the adhesive layer 71. The inner side surface of the through hole 54Y is covered by the adhesive layer 74. As a result, a portion of the through hole 74X of the adhesive layer 74 forms in the through hole 54Y. Furthermore, the through hole 74X, the through hole 65X, and the through hole 55X are communicated, and the metal layer 64E is exposed from the through hole 74X. The support film 105 is then removed from the insulation layer 55.

In the step illustrated in FIG. 20B, the via wiring V5 is formed like the step illustrated in FIG. 14B. The through holes 74X, 65X, 55X are filled with the via wiring V5. Thus, the via wiring V5 is connected to the side surface of the metal layer 65E defining the inner side surface of the through hole 65X, the upper surface of the metal layer 65E around the through hole 65X, and the upper surface of the metal layer 64E exposed from the through hole 74X. As a result, the metal layer 64E and the metal layer 65E are connected in series by the via wiring V5. In this step, for example, the upper surface of the via wiring V5 is formed to be substantially flush with the upper surface of the insulation layer 55. The via wiring V5 can be formed through methods such as electrolytic plating that uses both of the metal layer 81 and the metal layer 61E as power supplying layers or by filling metal paste or the like.

In the manufacturing steps described above, the metal layers 61E, 62E, 63E, 64E, 65E are connected in series by the via wirings V1 to V5 in the stacked structure including the structural body 41, the substrate 30, and the structural bodies 42 to 45. The series conductor of the metal layers 61E, 62E, 63E, 64E, 65E and the via wirings V1 to V5 corresponds to the portion of approximately four windings of the helical coil.

In the steps illustrated in FIGS. 19A and 20A, the through holes 65X, 74X may be formed after stacking the structural body 45 on the structural body 44 through the adhesive layer 74.

Figure 21A:
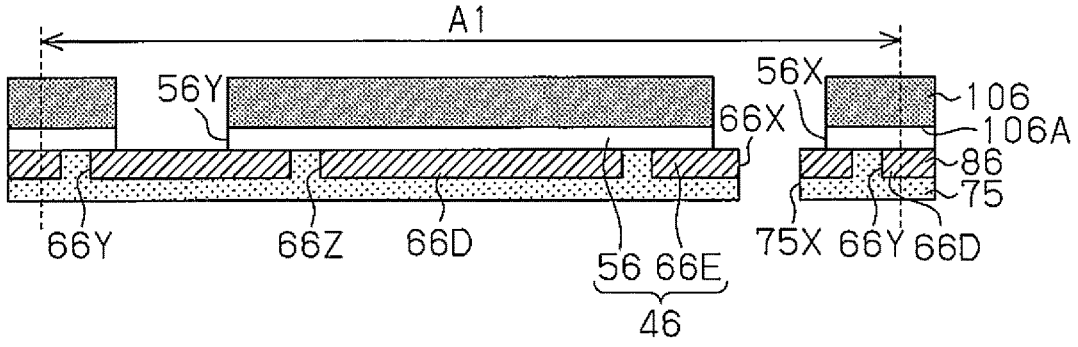
FIG. 21A is a schematic cross-sectional view taken along line 21*a*-21*a* in FIG. 21B and illustrating the manufacturing method of the coil substrate.

In the step illustrated in FIG. 21A, the structural body 46 including the insulation layer 56 and the metal layer 66E is stacked on a lower surface 106A of the support film 106. This step can be performed in the same manner as the steps illustrated in FIGS. 12A to 13B. Thus, detailed description of the manufacturing method in the step of FIG. 21A will be omitted.

Figure 21B:
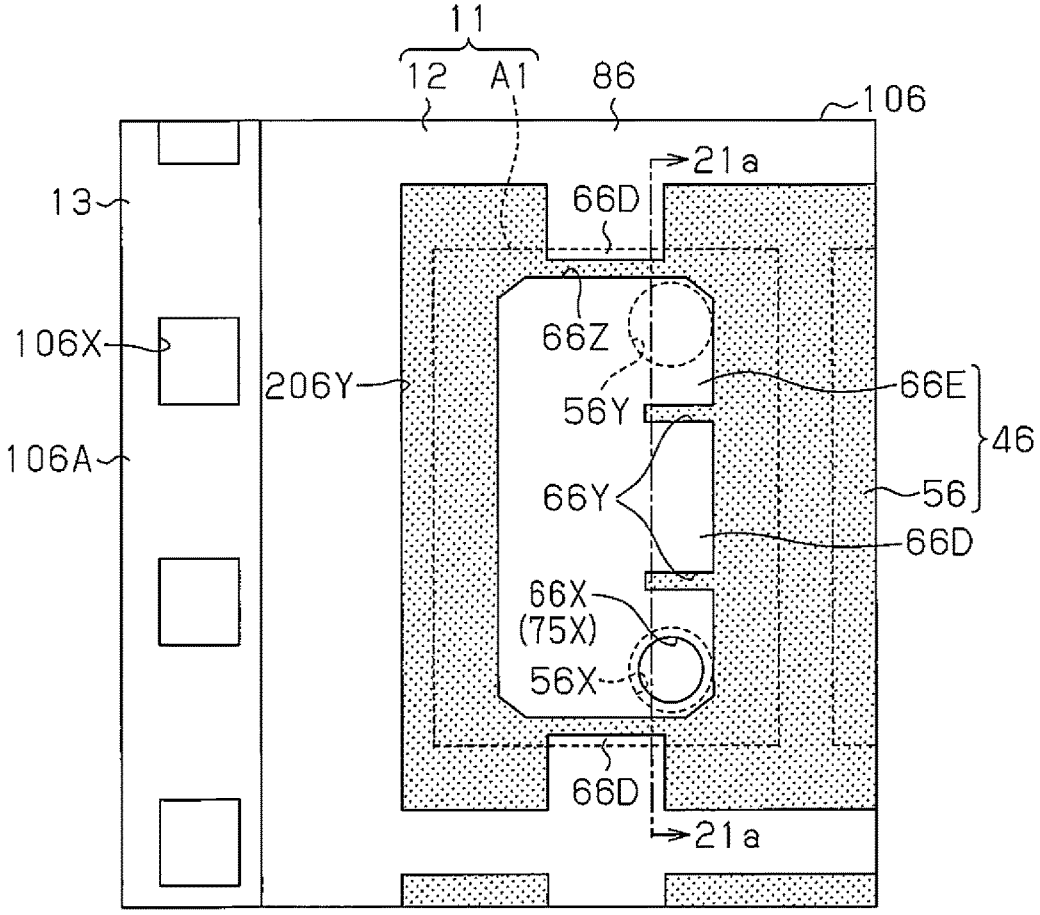
FIG. 21B is a schematic plan view illustrating the manufacturing method of the coil substrate.

The structure illustrated in FIG. 21A includes the through holes 56X, 56Y that extend through the support film 106 and the insulation layer 56 in the thickness direction, and the through holes 66X, 75X that extend through the metal layer 66E and the adhesive layer 75 in the thickness direction and communicate with the through hole 56X. The through hole 56X has a larger diameter than the through holes 66X, 75X. Thus, the upper surface of the metal layer 66E around the through hole 665X is exposed from the through hole 56X. Furthermore, as illustrated in FIG. 21B, the metal layer 66E, the metal layer 66D, and the metal layer 86 are formed on the lower surface of the insulation layer 56. The metal layer 66E is separated from the metal layers 66D, 86 by an opening 206Y and the groove 65Z. The groove 66Y formed in the metal layer 66E enables the helical shape of the coil to be easily formed when shaping the coil substrate 20 in a subsequent step. The metal layer 66E has a larger planar shape than the wiring 66 illustrated in FIG. 7, for example. The metal layer 66E is ultimately punched out or the like to form the sixth-layer wiring 66 (about ¾ winding) of the helical coil. As illustrated in FIG. 21A, the adhesive layer 75 is formed on the lower surface of the insulation layer 56 to cover the lower surface and the side surface of the metal layer 66E and fill the opening 206Y (refer to FIG. 21B) and the grooves 66Y, 66Z. In FIG. 21B, the illustration of the adhesive layer 75 is omitted, and the insulation layer 56 exposed from the opening 206Y and the grooves 66Y, 66Z is illustrated shaded.

Figure 22A:
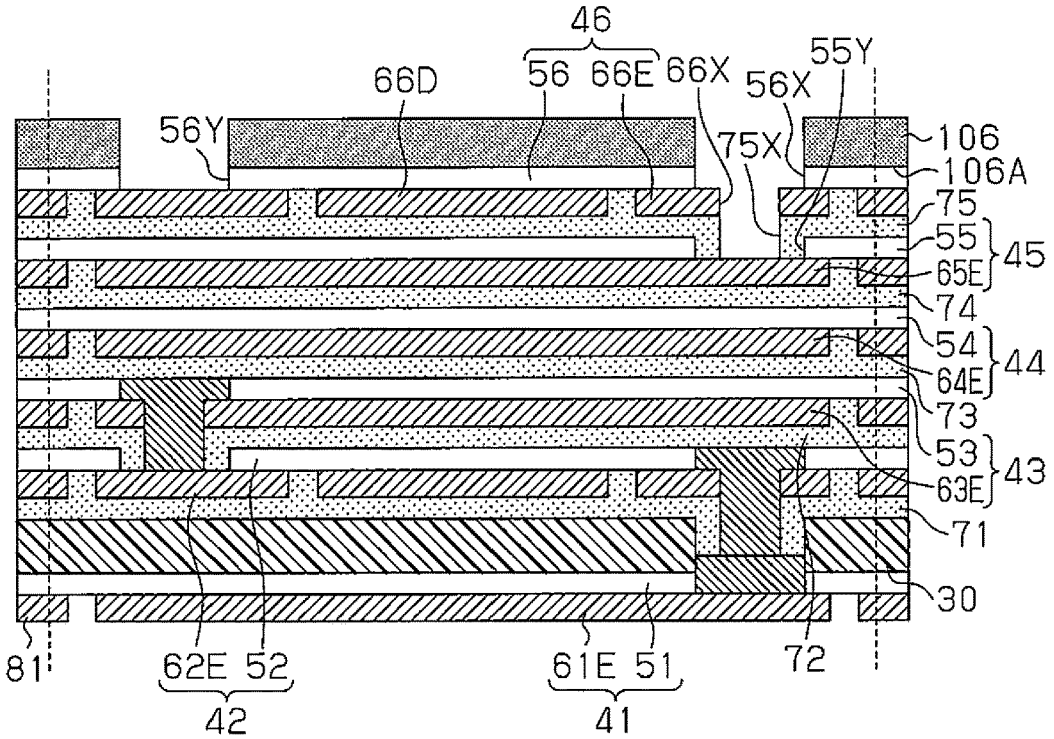
FIGS. 22A and 22B are schematic cross-sectional views illustrating the manufacturing method of the coil substrate.
Figure 22B:
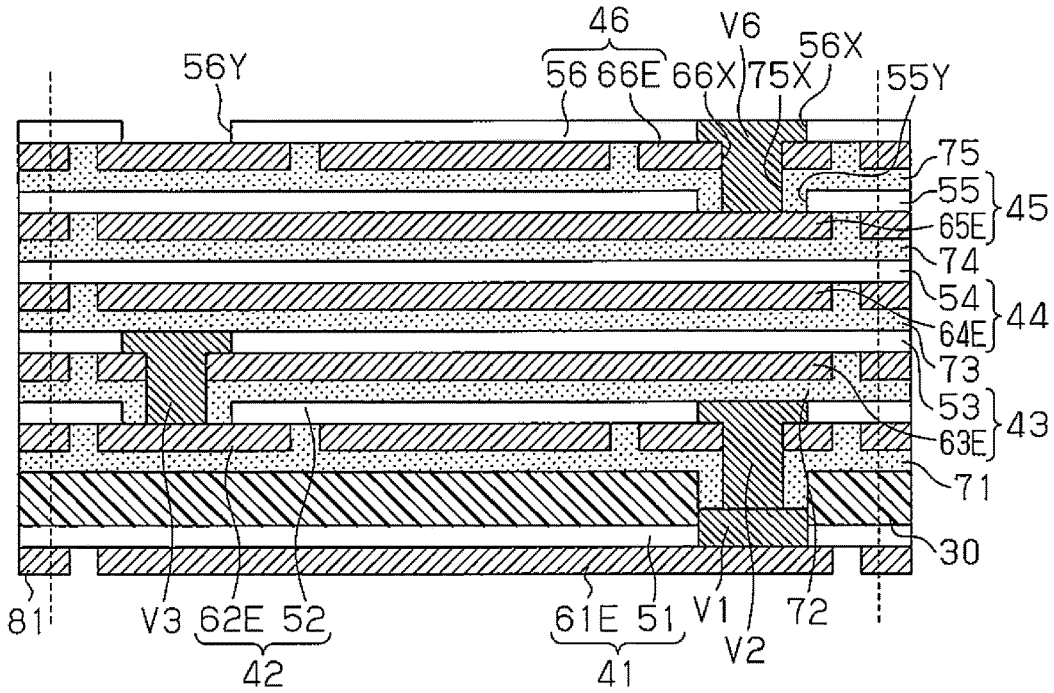

The steps illustrated in FIGS. 22A and 22B will now be described. FIGS. 22A and 22B are cross-sectional views taken along line 21*a*-21*a* in FIG. 21B.

First, in the step illustrated in FIG. 22A, the structural body 46 and the support film 106 are stacked on the insulation layer 55 of the structural body 45 through the adhesive layer 75 so that the structural body 41 and the support film 106 are arranged on the outer side like the step illustrated in FIG. 14A. In this case, the through hole 55Y of the insulation layer 55 has a larger diameter than the through hole 75X of the adhesive layer 75. Thus, the leakage of the adhesive layer 75 into the through hole 75X may be limited like the adhesive layer 71. The inner side surface of the through hole 55Y is covered by the adhesive layer 75. As a result, a portion of the through hole 75X of the adhesive layer 75 is formed in the through hole 55Y. Furthermore, the through hole 75X, the through hole 66X, and the through hole 56X are communicated, and the metal layer 65E is exposed from the through hole 75X. The support film 106 is then removed from the insulation layer 56.

In the step illustrated in FIG. 22B, the via wiring V6 is formed like the step illustrated in FIG. 14A. The through holes 75X, 66X, 56X are filled with the via wiring V6. Thus, the via wiring V6 is connected to the side surface of the metal layer 66E defining the inner side surface of the through hole 66X, the upper surface of the metal layer 66E around the through hole 66X, and the upper surface of the metal layer 65E exposed from the through hole 75X. As a result, the metal layer 65E and the metal layer 66E are connected in series by the via wiring V6. In this step, for example, the upper surface of the via wiring V6 is formed to be substantially flush with the upper surface of the insulation layer 56. The via wiring V6 can be formed through methods such as electrolytic plating that uses both of the metal layer 81 and the metal layer 61E as power supplying layers or by filling metal paste and the like.

In the manufacturing steps described above, the metal layers 61E, 62E, 63E, 64E, 65E, 66E are connected in series by the via wirings V1 to V6 in the stacked structure including the structural body 41, the substrate 30, and the structural bodies 42 to 46. The series conductor portion of the metal layers 61E, 62E, 63E, 64E, 65E, 66E and the via wirings V1 to V6 corresponds to the portion of approximately (4+¾) windings of the helical coil.

In the steps illustrated in FIGS. 21A and 22A, the through holes 66X, 75X may be formed after stacking the structural body 46 on the structural body 45 through the adhesive layer 75.

Figure 23A:
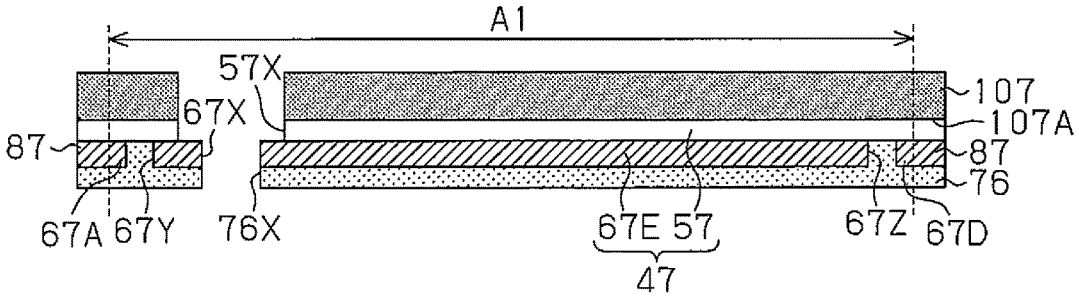
FIG. 23A is a schematic cross-sectional view taken along line 23*a*-23*a* in FIG. 23C and illustrating the manufacturing method of the coil substrate.

In the step illustrated in FIG. 23A, the structural body 47 including the insulation layer 57 and the metal layer 67E is stacked on a lower surface 107A of the support film 107. This step can be performed in the same manner as the steps illustrated in FIGS. 12A to 13B. Thus, detailed description of the manufacturing method in the step of FIG. 23A will be omitted.

Figure 23B:
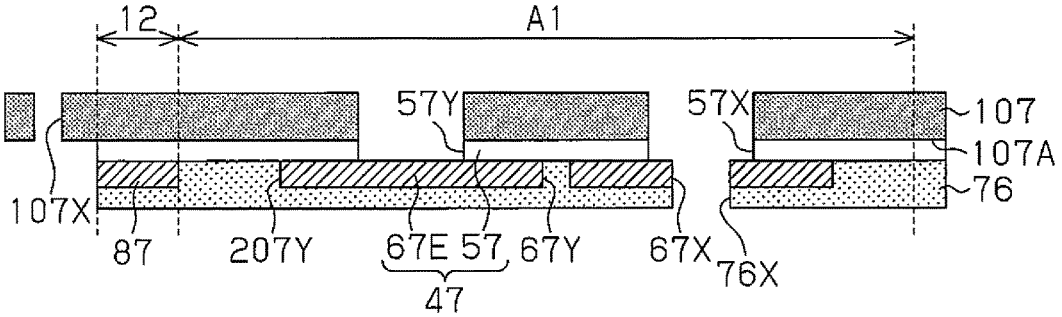
FIG. 23B is a schematic cross-sectional view taken along line 23*b*-23*b* in FIG. 23C and illustrating the manufacturing method of the coil substrate.
Figure 23C:
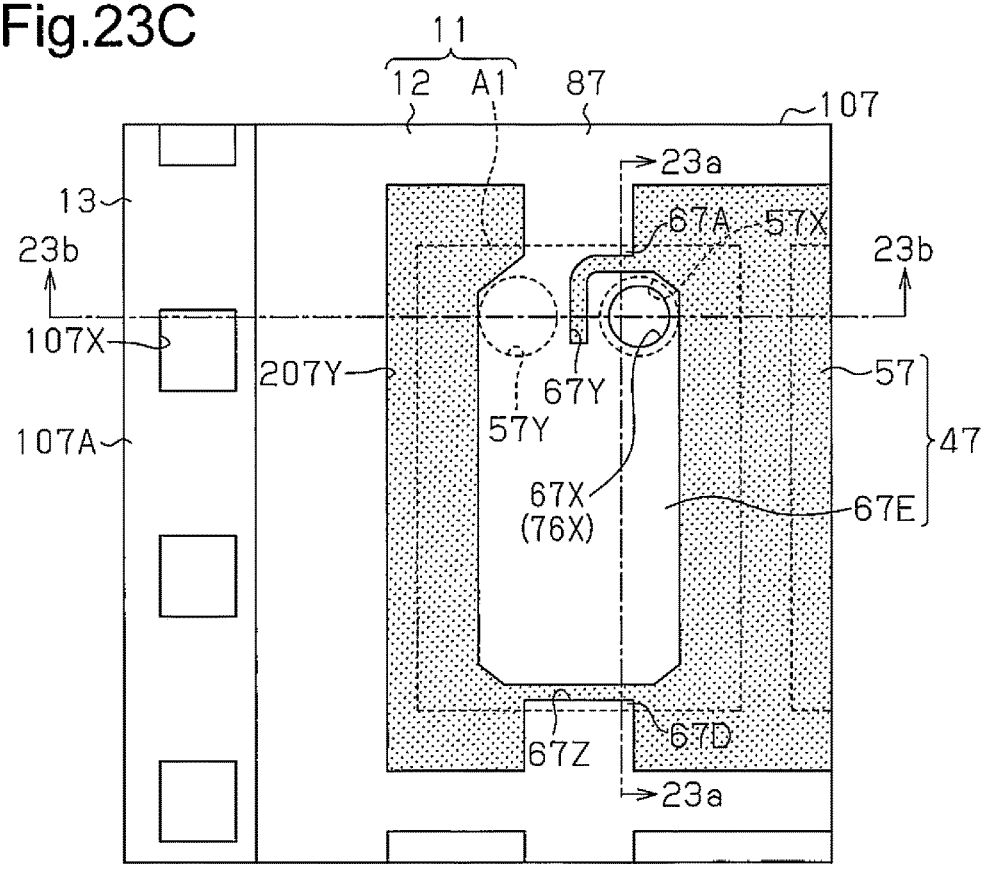
FIG. 23C is a schematic plan view illustrating the manufacturing method of the coil substrate.

The structure illustrated in FIG. 23B includes the through holes 57X, 57Y that extend through the support film 107 and the insulation layer 57 in the thickness direction, and the through holes 67X, 76X that extend through the metal layer 67E and the adhesive layer 76 in the thickness direction and communicate with the through hole 57X. The through hole 57X has a larger diameter than the through holes 67X, 76X. Thus, the upper surface of the metal layer 67E around the through hole 67X is exposed from the through hole 57X. Furthermore, as illustrated in FIG. 23C, the metal layer 67E, the connecting portion 67A, the metal layer 67D, and the metal layer 87 are formed on the lower surface of the insulation layer 57. The metal layer 67E is separated from the metal layers 67D, 87 by the opening 207Y and the groove 67Z. The groove 67Y formed in the metal layer 67E enables the helical shape of the coil to be easily formed when shaping the coil substrate 20 in a subsequent step. The metal layer 67E has a larger planar shape than the wiring 67 illustrated in FIG. 7, for example. The metal layer 67E is ultimately punched out or the like to form the seventh-layer wiring 67 (about one winding) of the helical coil. As illustrated in FIGS. 23A and 23B, the adhesive layer 76 is formed on the lower surface of the insulation layer 57 to cover the lower surface and the side surface of the metal layer 67E and fill the opening 207Y and the grooves 67Y, 67Z. In FIG. 23C, the illustration of the adhesive layer 76 is omitted, and the insulation layer 57 exposed from the opening 207Y and the grooves 67Y, 67Z is illustrated shaded.

Figure 24A:
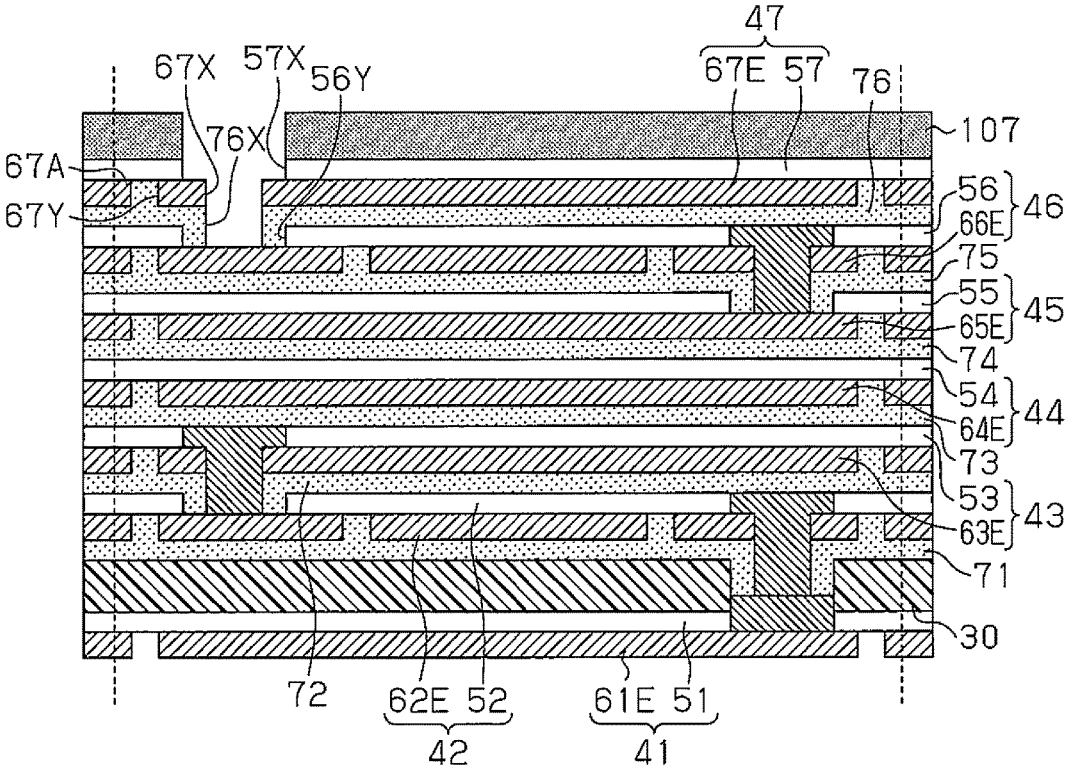
FIGS. 24A, 24B, 25A, and 25B are schematic cross-sectional views illustrating the manufacturing method of the coil substrate.
Figure 25A:
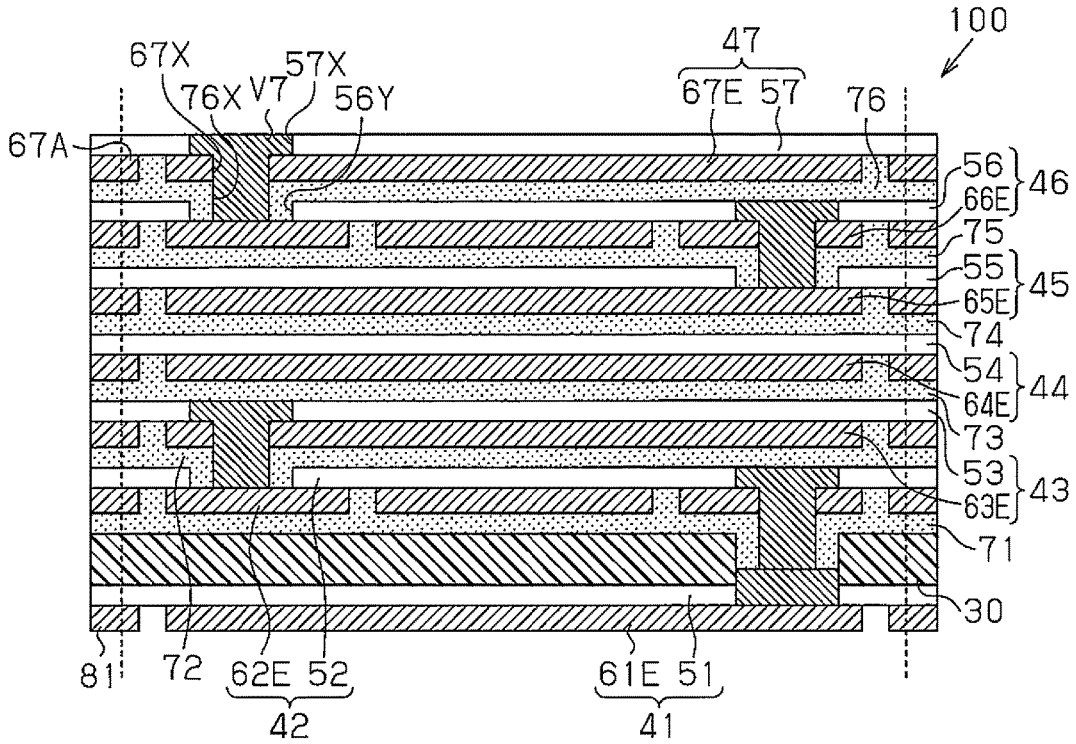

The steps illustrated in FIGS. 24A and 25B will now be described. FIGS. 24A and 25A illustrate cross-sectional views taken along line 23*a*-23*a* in FIG. 23C, and FIG. 25B illustrates a cross-sectional view taken along line 23*b*-23*b* in FIG. 23C.

First, in the step illustrated in FIG. 24A, the structural body 47 and the support film 107 are stacked on the insulation layer 56 of the structural body 46 through the adhesive layer 76 so that the structural body 41 and the support film 107 are arranged on the outer side like the step illustrated in FIG. 14A. In this case, the through hole 56Y of the insulation layer 56 has a larger diameter than the through hole 76X of the adhesive layer 76. Thus, the leakage of the adhesive layer 76 into the through hole 76X may be limited like the adhesive layer 71. The inner side surface of the through hole 56Y is covered by the adhesive layer 76. As a result, a portion of the through hole 76X of the adhesive layer 76 is formed in the through hole 56Y. Furthermore, the through hole 76X, the through hole 67X, and the through hole 57X are communicated, and the metal layer 66E is exposed from the through hole 76X. The support film 107 illustrated in FIG. 24A is then removed from the insulation layer 57 in the step illustrated in FIG. 24B.

Figure 25B:
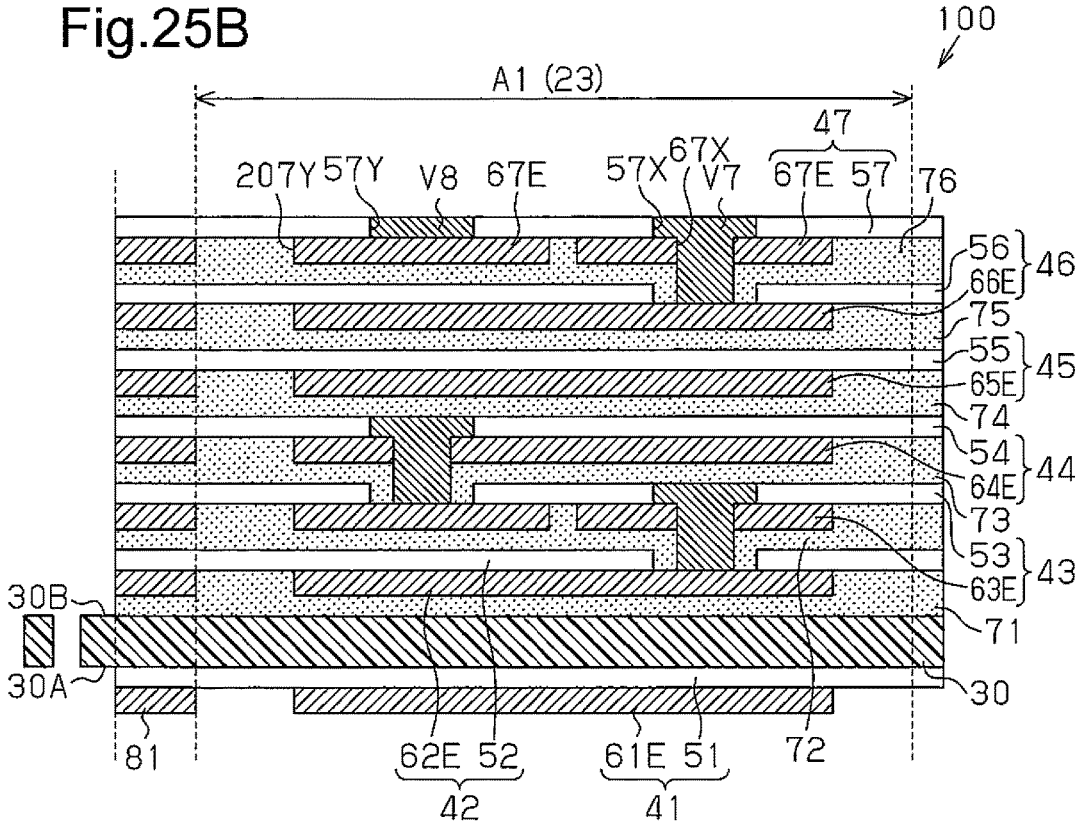

In the steps illustrated in FIGS. 25A and 25B, the via wiring V7 is formed like the step illustrated in FIG. 14B. The through holes 76X, 67X, 57X are filled with the via wiring V7. Thus, the via wiring V7 is connected to the side surface of the metal layer 67E defining the inner side surface of the through hole 67X, the upper surface of the metal layer 67E around the through hole 67X, and the upper surface of the metal layer 66E exposed from the through hole 76X. As a result, the metal layer 66E and the metal layer 67E are connected in series by the via wiring V7. Furthermore, the via wiring V8 that fills the through hole 57Y is formed, as illustrated in FIG. 25B. The metal layer 67E is thus electrically connected to the via wiring V8. In this step, for example, the upper surfaces of the via wirings V7, V8 are formed to be substantially flush with the upper surface of the insulation layer 57. The via wirings V7, B8 can be formed through methods such as electrolytic plating that uses both of the metal layer 81 and the metal layer 61E as power supplying layers, filling of the metal paste, and the like.

In the manufacturing steps described above, the metal layers 61E, 62E, 63E, 64E, 65E, 66E, 67E are connected in series by the via wirings V1 to V7 in the stacked structure including the structural body 41, the substrate 30, and the structural bodies 42 to 47. The series conductor of the metal layers 61E, 62E, 63E, 64E, 65E, 66E, 67E and the via wirings V1 to V7 corresponds to the portion of approximately (5+½) windings of the helical coil.

Figure 24B:
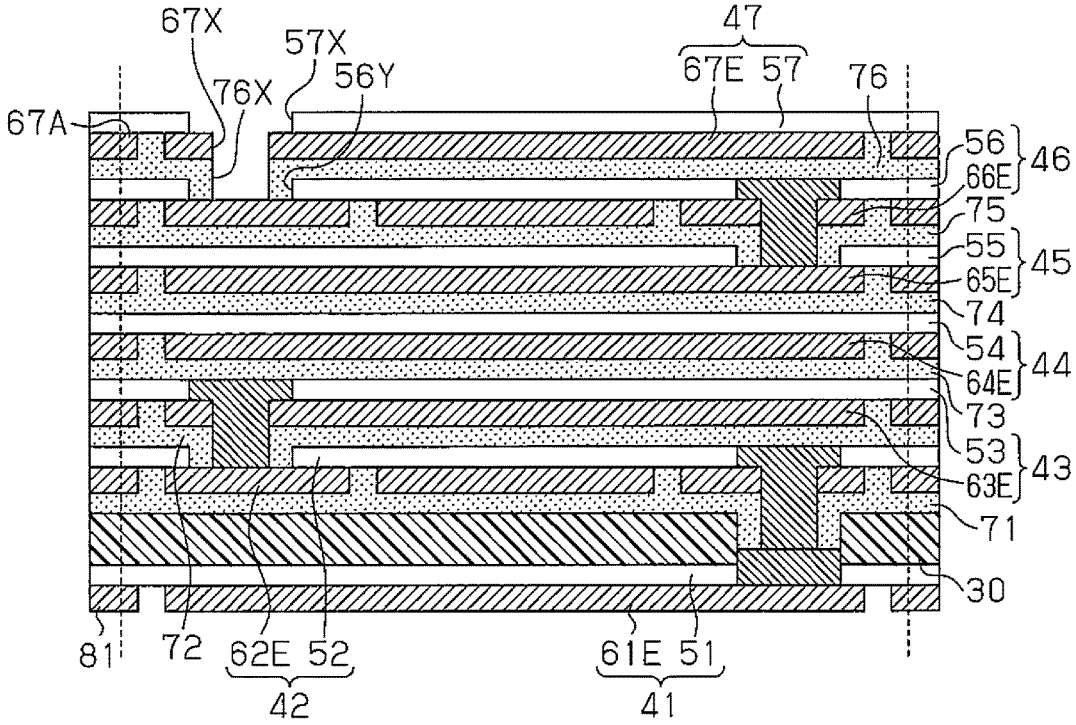

In the steps illustrated in FIGS. 23A and 24B, the through holes 67X, 76X may be formed after stacking the structural body 47 on the structural body 46 through the adhesive layer 76.

In the manufacturing steps described above, the stacked body 23 including the structural body 41 stacked on the lower surface 30A of the substrate 30, and the plurality of structural bodies 42 to 47 stacked in order on the upper surface 30B of the substrate 30 may be manufactured in each individual region A1.

Figure 26A:
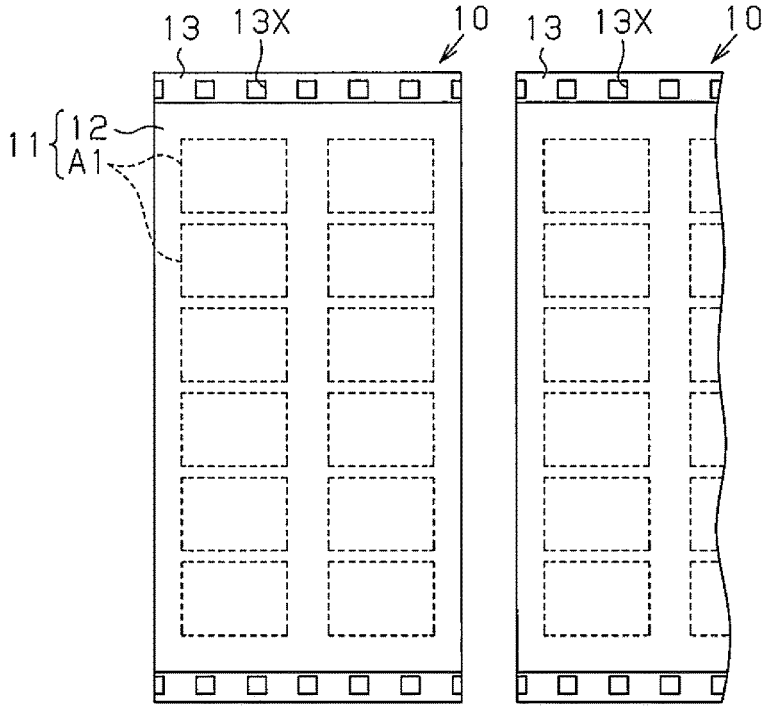
FIGS. 26A and 26B are schematic plan views illustrating the manufacturing method of the coil substrate.

In the step illustrated in FIG. 26A, the reel-like substrate 100 having the structure illustrated in FIGS. 25A and 25B is cut along the cutting position A2 illustrated in FIG. 9 to be singulated into an individual sheet-like coil substrate 10. In the example of FIG. 26A, twelve individual regions A1 are formed in the coil substrate 10. The substrate 100 completed in the steps illustrated in FIGS. 25A and 25B may be shipped as a product without undergoing the step illustrated in FIG. 26A.

Figure 26B:
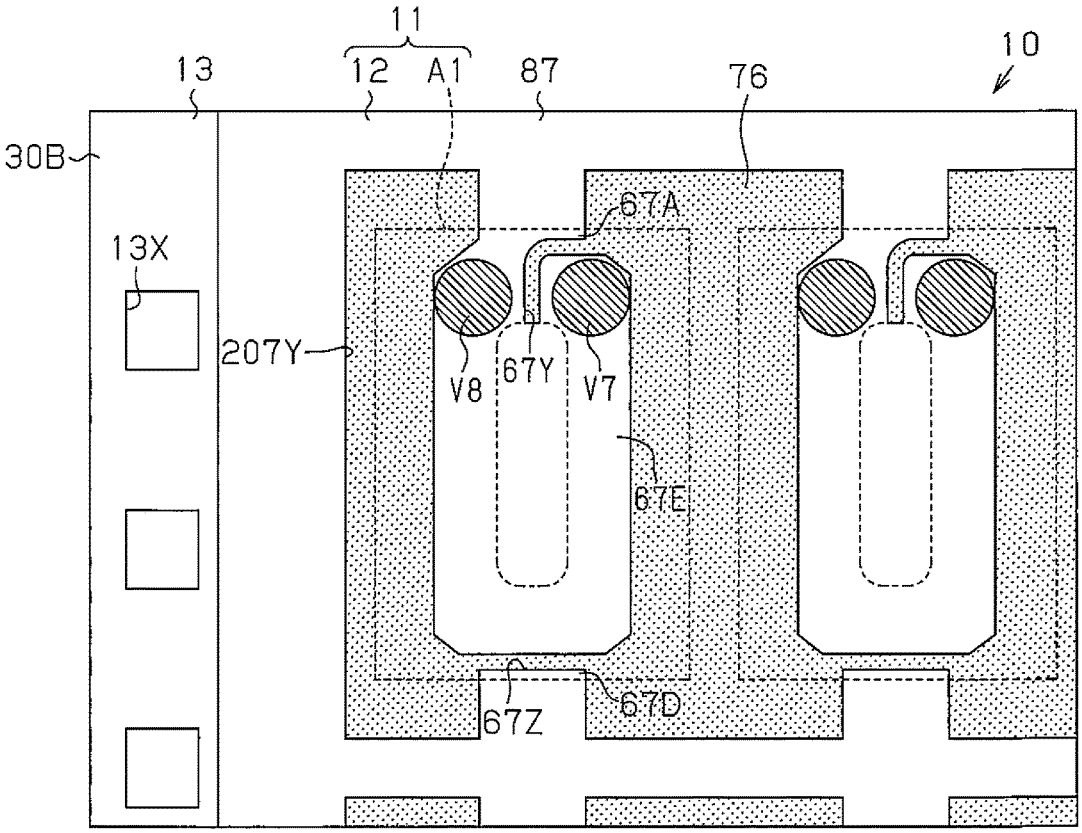
Figure 27:
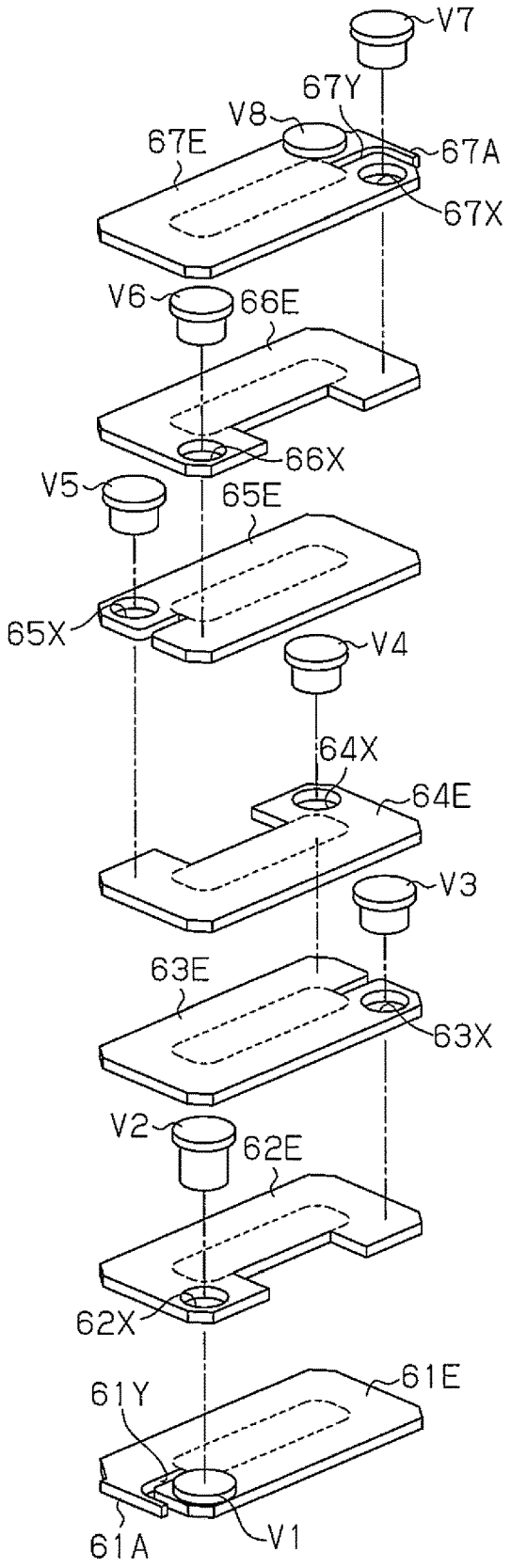
FIG. 27 is a schematic perspective view illustrating a metal layer prior to shaping.
Figure 28A:
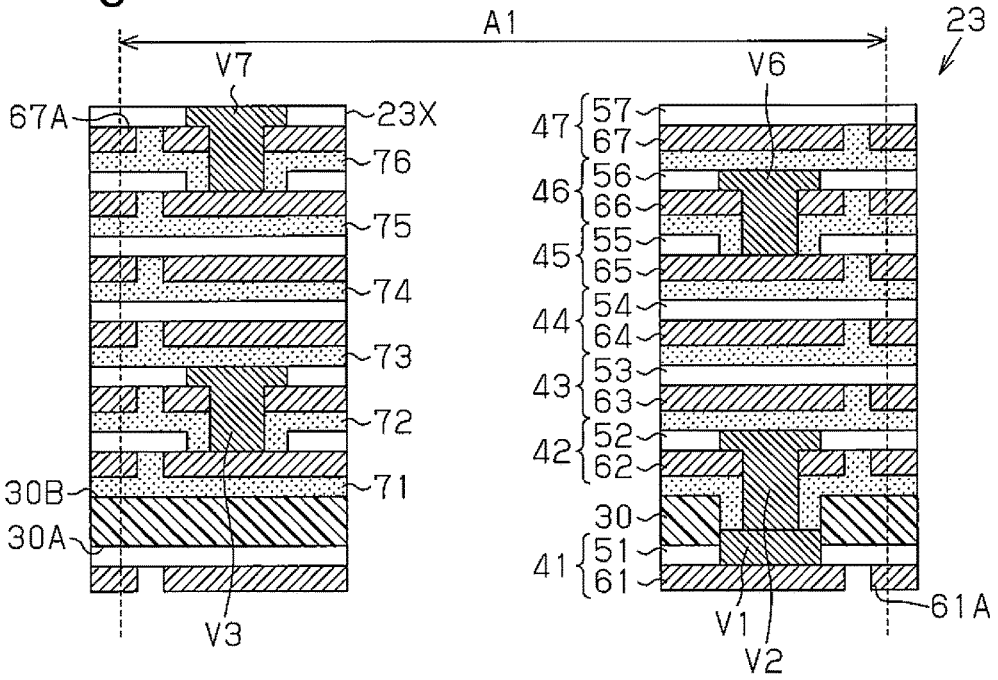
FIG. 28A is a schematic cross-sectional view taken along line 28*a*-28*a* in FIG. 28B and illustrating the manufacturing method of the coil substrate.
Figure 28B:
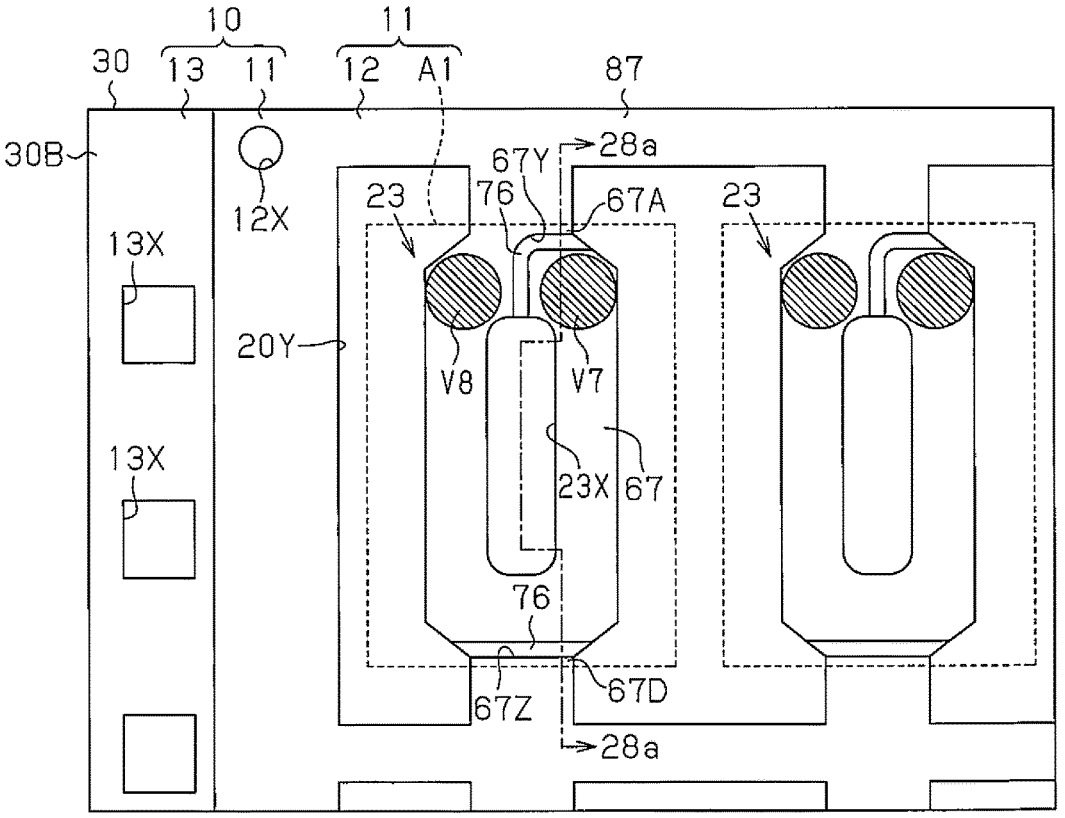
FIGS. 28B and 29 are schematic plan views illustrating the manufacturing method of the coil substrate.

In the steps illustrated in FIGS. 26B to 28B, the coil substrate 10 is shaped when punched out to remove unnecessary portions, and the metal layers 61E to 67E are processed into the shapes of the wirings 61 to 67 of the helical coil. FIG. 26B illustrates the metal layer 67E and the adhesive layer 76 before shaping the coil substrate 10. In FIG. 26B, the illustration of the insulation layer 57 is omitted, and the adhesive layer 76 exposed from the opening 207Y and the grooves 67Y, 67Z is illustrated shaded. FIG. 27 schematically illustrates the shapes of the metal layers 61E to 67E before shaping the coil substrate 10. For example, the coil substrate 10 illustrated in FIGS. 26B and 27 is shaped as illustrated in FIGS. 28A and 28B by undergoing pressing that uses a die, for example. In the present example, the substrate 30, the insulation layers 51 to 57, the metal layers 61E to 67E, and the adhesive layers 71 to 76 (refer to FIG. 25B) are punched out when undergoing pressing at the position corresponding to the opening 20Y to remove unnecessary portions from the coil substrate 10 illustrated in FIGS. 26B and 27. Furthermore, the substrate 30, the insulation layers 51 to 57, the metal layers 61E to 67E, and the adhesive layers 71 to 76 are punched out when undergoing pressing at the position overlapping the region illustrated by broken lines in FIGS. 26B and 27 in a plan view to remove the unnecessary portion of the coil substrate 10. As illustrated in FIG. 28B, this forms the opening 20Y at a certain location in the block 11, and the stacked body 23 is shaped to a substantially rectangular shape in a plan view. Furthermore, the through hole 23X is formed at substantially the central part of the stacked body 23, and the metal layers 61E to 67E are each shaped into the wirings 61 to 67, as illustrated in FIG. 28A. The wirings 61 to 67 are connected in series by the via wirings V1 to V7 to be formed as a helical coil having approximately (5+½) windings. The formation of the through hole 23X exposes the end face of each wiring 61 to 67 from the inner wall surface of the through hole 23X. Furthermore, the formation of the opening 20Y exposes the end face of each wiring 61 to 67 from the outer wall surface of the stacked body 23 (refer to FIG. 3). The stacked body 23 is formed in each individual region A1, and the adjacent stacked bodies 23 are coupled by the coupling portion 12.

In the present embodiment, when performing pressing, the metal layer (metal layer 61E to 67E and metal layer 61D to 67D) in each structural body 41 to 47 prior to shaping have substantially the same shape. In other words, the difference in shape of the metal layer formed in each structural body 41 to 47 is reduced by arranging the metal layer 61D to 67D serving as the dummy pattern in each structural body 41 to 47. This reduces deformation of the stacked body 23 that would be caused by a difference in the shapes of the metal layer during pressing.

The coil substrate 10 may be shaped (i.e., opening 20Y and through hole 23X may be formed) through laser processing instead of pressing that uses a die. In this step, the recognition mark 12X that extends through the coupling portion 12 in the thickness direction may be formed at a certain location in the coupling portion 12, as illustrated in FIG. 28B, when forming the opening 20Y and the through hole 23X. The recognition mark 12X may be formed, for example, through press working using a die or through laser processing.

Figure 29:
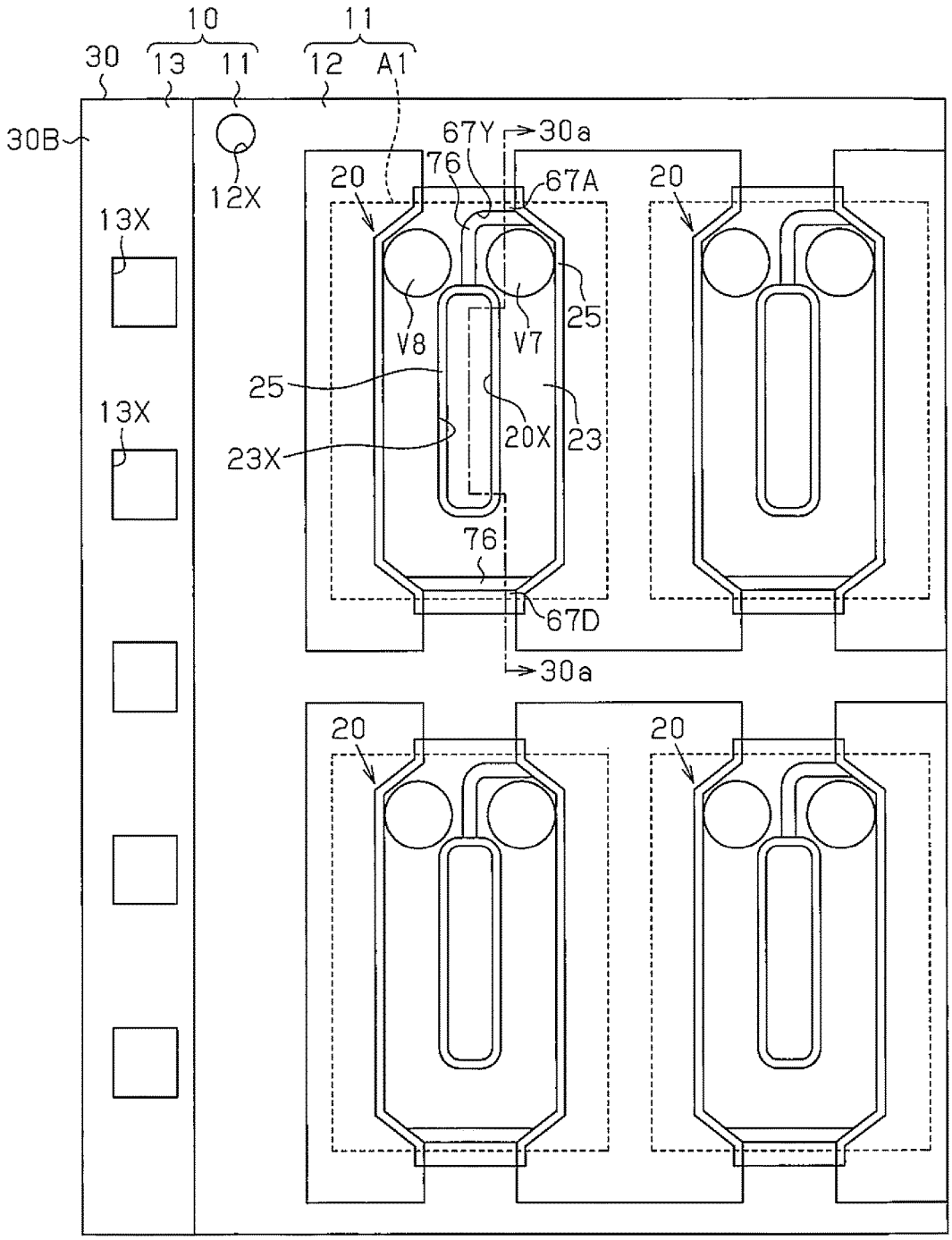
Figure 30A:
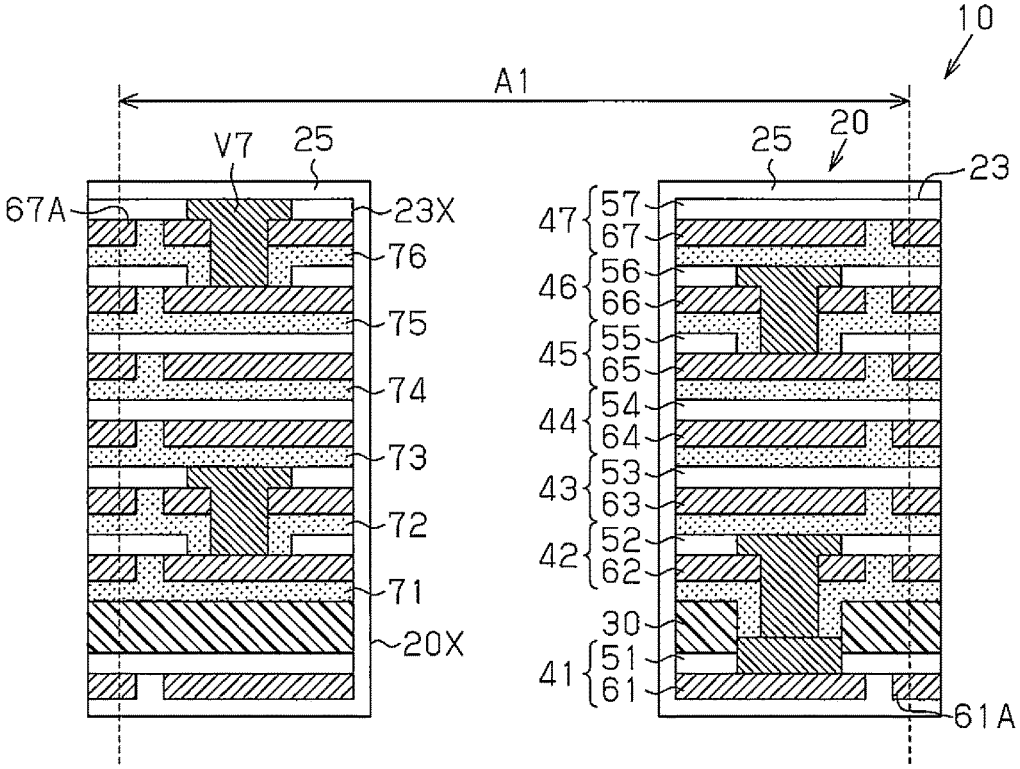
FIG. 30A is a schematic cross-sectional view taken along line 30*a*-30*a* in FIG. 29 and illustrating the manufacturing method of the coil substrate.

The steps illustrated in FIGS. 29 and 30A form the insulation film 25 that covers the entire surface of the stacked body 23 including the inner wall surface of the through hole 23X. The insulation film 25 continuously covers the outer wall surface of the stacked body 23 formed in each individual region A1, the lower surface and the side surface of the wiring 61 of the lowermost layer, the upper surface of the insulation layer 57 of the uppermost layer, the upper surfaces of the via wirings V7, V8, and the inner wall surface of the through hole 23X. Therefore, the insulation film 25 covers the end face of each wiring 61 to 67 exposed at the outer wall surface of the stacked body 23 and the inner wall surface of the through hole 23X. Thus, even if the encapsulation resin 91 of the inductor 90 (refer to FIG. 8B) contains the conductive body (filler of magnetic body, etc.), the insulation film 25 limits short-circuiting of each of the wirings 61 to 67 with the conductive body of the encapsulation resin 91.

The insulation film 25 can be formed, for example, using the spin coating method and the spray coating method. An electrodeposited resist may be used as the insulation film 25. In this case, the electrodeposited resist (insulation film 25) is attached only to the end face of each wiring 61 to 67 exposed at the outer wall surface of the stacked body 23 and the inner wall surface of the through hole 23X by performing an electrodeposition application process.

The above manufacturing steps manufacture the coil substrate 20 in each individual region A1 and the coil substrate 10 including the coil substrates 20.

A method for manufacturing the inductor 90 will now be described.

Figure 30B:
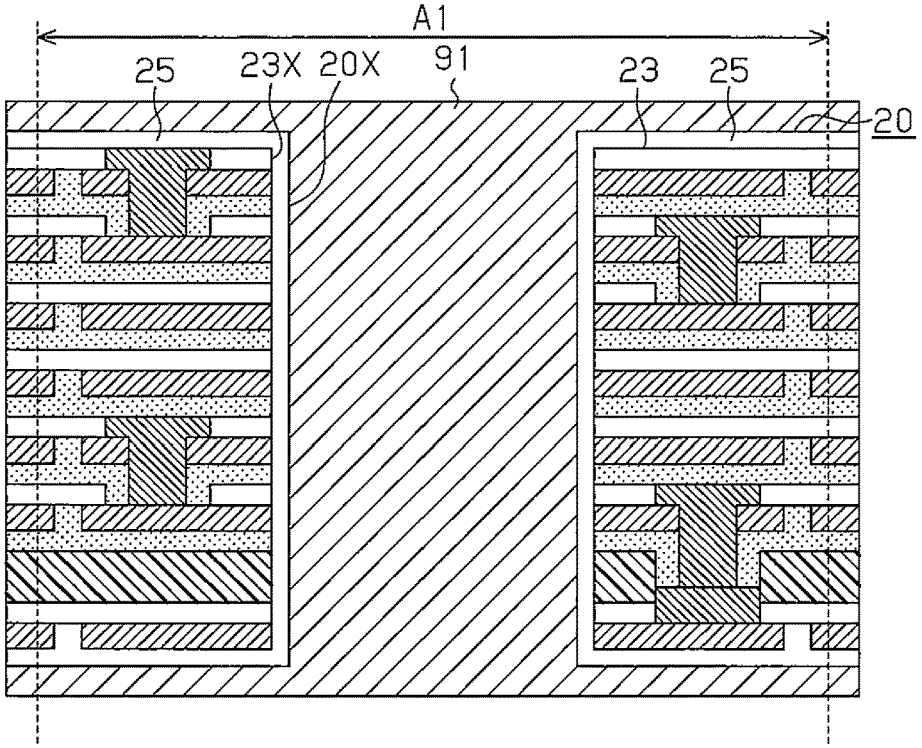
FIGS. 30B, 31A, and 31B are schematic cross-sectional views illustrating the manufacturing method of the inductor of FIG. 8B.

First, in the step illustrated in FIG. 30B, the encapsulation resin 91 is formed to encapsulate the entire coil substrate 20 in each individual region A1. This fills the through hole 20X of the coil substrate 20 with the encapsulation resin 91 and covers the outer wall surface of the coil substrate 20, the upper surface of the coil substrate 20 (upper surface of insulation film 25), and the lower surface of the coil substrate 20 (lower surface of insulation film 25) with the encapsulation resin 91. A method for filling the encapsulation resin 91 includes, for example, a transfer mold method, a compression mold method, and an injection mold method.

The structure (coil substrate 10) illustrated in FIG. 30B is cut along the position of the individual region A1 illustrated with a broken line. This removes the coupling portion 12 and the outer frame 13, and the coil substrate 10 is singulated into the coil substrate 20 (refer to FIG. 31A) encapsulated by the encapsulation resin 91. In this case, a plurality of coil substrates 20 is obtained. The connecting portion 61A is exposed at one side surface 20A of the coil substrate 20, and the connecting portion 67A is exposed at the other side surface 20B of the coil substrate 20.

Figure 31A:
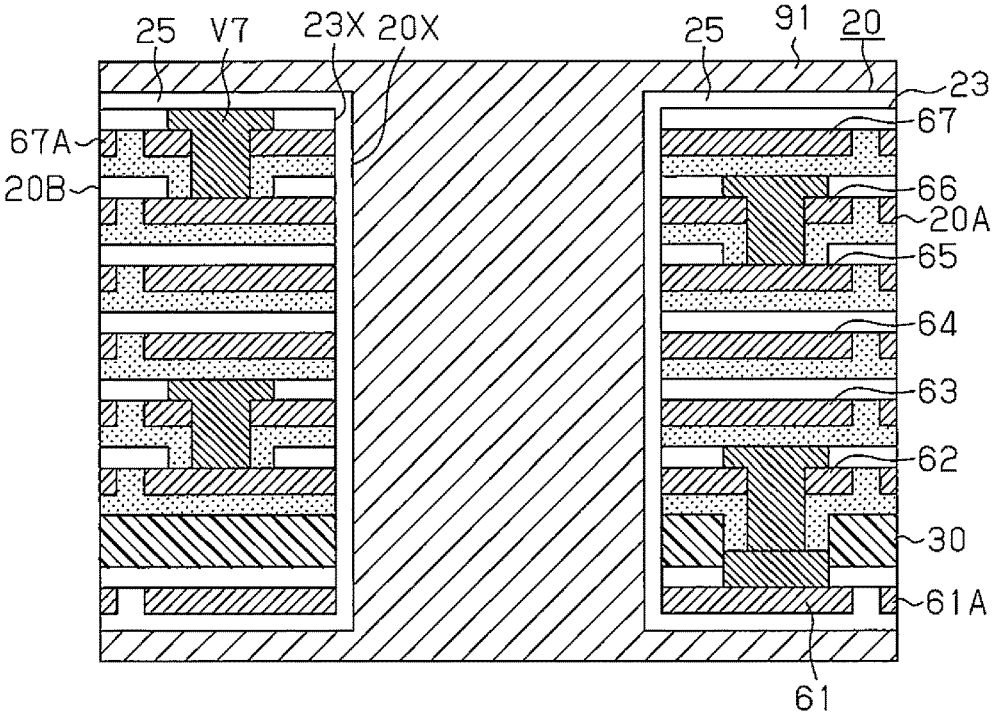

In the steps illustrated in FIGS. 30B and 31A, the coil substrate 10 is cut and singulated into a plurality of coil substrates 20 after forming the encapsulation resin 91 for encapsulating the coil substrate 20 in each individual region A1. Instead, for example, the coil substrate 10 may be singulated into the coil substrates 20, and then each coil substrate 20 may be encapsulated with the encapsulation resin 91 excluding the side surfaces 20A, 20B.

Figure 31B:
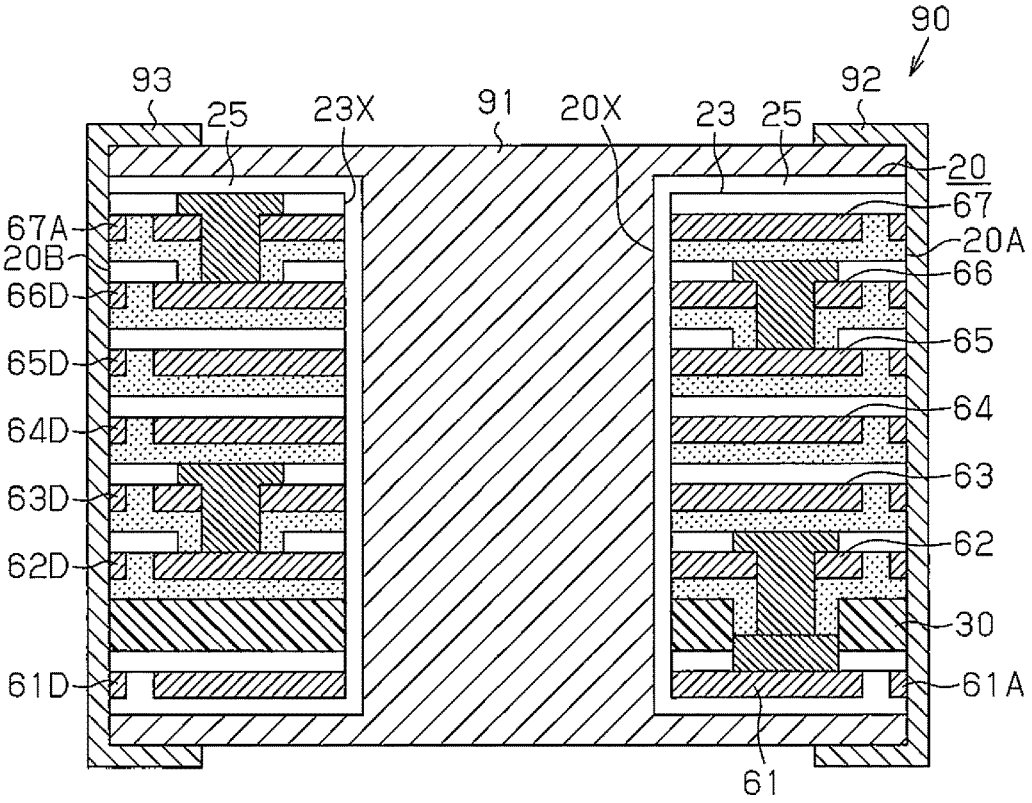

Then, in the step illustrated in FIG. 31B, the electrodes 92, 93 are formed. The electrode 92 continuously covers the side surface 20A of the coil substrate 20 and one side surface, the upper surface, and the lower surface of the encapsulation resin 91. The electrode 93 continuously covers the side surface 20B of the coil substrate 20, and the other side surface, the upper surface, and the lower surface of the encapsulation resin 91. The inner wall surface of the electrode 92 contact the side surface of the connecting portion 61A exposed at the side surface 20A of the coil substrate 20. Therefore, the wiring 61 including the connecting portion 61A is electrically connected to the electrode 92. In the same manner, the inner wall surface of the electrode 93 contacts the side surface of the connecting portion 67A exposed at the side surface 20B of the coil substrate 20. Therefore, the wiring 67 including the connecting portion 67A is electrically connected to the electrode 93.

The above manufacturing steps manufactures the inductor 90 illustrated in FIG. 8B.

The present embodiment has the advantages described below.

(1) The structural bodies 41 to 47 including the wirings 61 to 67 and the insulation layers 51 to 57 are stacked on the substrate 3, and the wirings 61 to 67 are connected in series by the via wirings V1 to V7 to form a single helical coil. In such a structure, the coil of any number of windings may be formed without changing the planar shape of the coil (inductor) by adjusting the number of structural bodies stacked on the substrate 30. This facilitates the formation of a coil having a smaller size (e.g., planar shape of 1.6 mm×0.8 mm) than the conventional size (e.g., planar shape of 1.6 mm×1.6 mm).

(2) The number of windings (number of turns) of the coil is increased without changing the planar shape of the coil (inductor) by increasing the number of structural bodies stacked on the substrate 30. This facilitates the formation of a small coil having a large inductance.

(3) In each structural body 42 to 47, the insulation layers 52 to 57 include the through holes 52X to 57X having larger planar shapes than the through holes 62X to 67X of the wirings 62 to 67. Furthermore, the through holes 62X, 52X are filled with the via wiring V2, the through holes 63X, 53X are filled with the via wiring V3, the through holes 64X, 54X are filled with the via wiring V4, the through holes 65X, 55X are filled with the via wiring V5, the through holes 66X, 56X are filled with the via wiring V6, and the through holes 67X, 57X are filled with the via wiring V7. The via wirings V2 to V7 are connected to the inner side surfaces of the through holes 62X to 67X, and connected to the upper surfaces of the wirings 62 to 67 exposed from the through holes 52X to 57X around the through holes 62X to 67X. In this structure, the contact area of the via wirings V2 to V7 and the wirings 62 to 67 is increased compared to when the through holes 52X to 57X have planar shapes with the same size as the through holes 62X to 67X. As a result, the connection reliability between the via wirings V2 to V7 and the wirings 62 to 67 is enhanced. Furthermore, the connection reliability of the wirings 62 to 67 is enhanced.

(4) When stacking the structural body 43 on the structural body 42, the structural body 43 including the metal layer 63E with the through hole 63X and the insulation layer 53 is stacked on the lower surface 103A of the support film 103, and the adhesive layer 72 including the through hole 72X that communicates with the through hole 63X is stacked on the structural body 43. The insulation layer 52 of the structural body 42 includes the through hole 52Y having a larger planar shape than the through holes 63X, 72X. The structural body 43 is stacked on the structural body 42 by way of the adhesive layer 72 with the support film 103 arranged on the outer side. This limits leakage of the adhesive layer 72 into the through hole 72X since the through hole 52Y has a larger planar shape than the through hole 72X. Therefore, even if a high pressure is applied to the structural bodies 42, 43 and the adhesive layer 72 or a material of high fluidity is used as the material of the adhesive layer 72 when stacking the structural body 43 on the structural body 42 by way of the adhesive layer 72, reduction in the size of the planar shape of the through hole 72X is limited. The same applied when stacking the other structural bodies 44 to 47.

(5) The through electrodes (via wirings V2 to V8) that electrically connect the wiring 62 to 67 extend through the insulation layer of the structural body at the lower side of the two adjacent structural bodies and the wiring and the insulation layer of the structural body at the upper side. Thus, the insulation layers 52 to 57 of the structural bodies 42 to 47 each include two through electrodes. In the present example, the via wirings V2, V3 are formed in the insulation layer 52, the via wirings V3, V4 are formed in the insulation layer 53, the via wirings V4, V5 are formed in the insulation layer 54, the via wirings V5, V6 are formed in the insulation layer 55, the via wirings V6, V7 are formed in the insulation layer 56, and the via wirings V7, V8 are formed in the insulation layer 57. In such a structure, the via wirings V2 to V8 function as support bodies and maintain the rigidity of the insulation layers 52 to 57. This limits twisting of the inductor 90.

(6) The substrate 30 having a lower thermal expansion coefficient than the insulation layers 51 to 57 of the structural bodies 41 to 47 is arranged in the stacked body 23. The thermal deformation (thermal contraction or thermal expansion) of the substrate 30 is thus small when a temperature change occurs in the coil substrate 20. Therefore, displacement of the wirings 61 to 67 is limited. In other words, deviation in the position of the coil (coil substrate 20) formed by the wirings 61 to 67 from the designed position is limited even if a temperature change occurs in the coil substrate 20. This improves the position accuracy of the coil formed by the wirings 61 to 67.

(7) The rigidity of the substrate 30 is higher than the insulation layers 51 to 57. For example, the substrate 30 is thicker than the insulation layers 51 to 57. Thermal deformation of the entire coil substrate 20 is limited by providing the substrate 30 with high rigidity.

(8) The structural bodies 41 to 47 are stacked on the substrate 30 to form the stacked body 23, and the wiring 61 is arranged on the lowermost layer of the stacked body 23. The wiring 61 (e.g., copper layer) has a higher adhesiveness to the insulation film 25 than the substrate 30 (e.g., polyimide film). Thus, the adhesiveness of the stacked body 23 and the insulation film 25 is increased compared to when the substrate 30 is arranged on the lowermost layer of the stacked body 23. If the substrate 30 is arranged on the lowermost layer of the stacked body 23, surface treatment (e.g., plasma process) needs to be performed on the lower surface of the substrate 30 before forming the insulation film 25 to increase the adhesiveness of the substrate 30 and the insulation film 25. In the present example, such surface treatment does not need to be performed since the adhesiveness of the wiring 61 and the insulation film 25 is high.

(9) In the coil substrate 10, the stacked body 23 and the outer frame 13 share the substrate 30, and the sprocket holes 13X are formed in the outer frame 13. Thus, the coil substrate 10 is easily conveyed using the sprocket holes 13X of the substrate 30 without using an additional member.

(10) Instead of the manufacturing method of the present embodiment, the wiring corresponding to the shape of the coil may be formed in each structural body before stacking the plurality of structural bodies. For example, the wirings 61 to 67 (with the through hole 23X) illustrated in FIG. 7 are formed in the structural bodies 41 to 47. Then, the structural bodies 41 to 47 are stacked on the substrate 30 to form the stacked body 23. In this method, however, the wirings 61 to 67 may be displaced in the planar direction (e.g., laterally), and the stacked wirings 61 to 67 may not completely overlap in a plan view. When the through hole and the like are formed in the stacked body, the displaced wirings may be partially removed. Such a problem is solved by narrowing the wiring to form in each structural body in advance, for example. However, this would increase the DC resistance of the coil.

To cope with such a problem, in the manufacturing method of the present embodiment, the metal layers 61E to 67E having larger planar shapes than the wiring 61 to 67, which have the shapes of a helical coil, are formed in each structural body 41 to 47 in advance. The structural bodies 41 to 47 are then stacked on the substrate 30 to form the stacked body 23. The stacked body 23 is shaped in the thickness direction, and the metal layers 61E to 67E are processed so that the wirings 61 to 67 are shaped into a helical coil. Thus, the wirings 61 to 67 that overlap each other in a plan view are stacked with high accuracy without being displaced in the planar direction. Therefore, the helical coil is accurately formed. As a result, the DC resistance of the helical coil becomes small. In other words, displacement of the wirings 61 to 67 in the planar direction does not need to be taken into consideration. Thus, each wiring 61 to 67 may be widened, and the DC resistance of the coil may be decreased.

(11) A reel-like (tape-like) flexible insulative resin film is used as the substrate 100 and the support films 102 to 107. This allows the coil substrate 10 to be manufactured reel-to-reel. Therefore, the cost of the coil substrate 10 may be decreased when mass-produced.

(12) The number of windings of each of the wirings 61 to 67 is less than or equal to a single winding of the coil. This allows wider wirings to be formed in a single structural body. In other words, the cross-sectional area in the widthwise direction of each wiring 61 to 67 may be increased, and the winding wiring resistance related with the inductor performance may be decreased.

(13) The metal layers 61D to 67D serving as dummy patterns are arranged in each structural body 41 to 47. Thus, the difference in the shape of the metal layer becomes small in the structural bodies 41 to 47. This limits the formation of valleys and ridges in the insulation layers 51 to 57 covering the metal layers that would be caused by differences in the shape of the metal layer.

(14) The metal layers 81 to 87 are stacked on the substrate 30 where the coupling portion 12 is located. This increases the mechanical strength of the entire coil substrate 10.

Modified Examples of First Embodiment

The first embodiment may be modified to the forms described below.

In the manufacturing steps of the first embodiment, the formation of the openings 201Y to 207Y may be omitted. In this case, for example, only the grooves 61Y, 61Z are formed in the metal foil 161 covering the entire lower surface of the insulation layer 51 in the step of patterning the metal foil 161 illustrated in FIG. 11B. In other words, the metal foil 161 (metal layer 61E) that covers the lower surface of the insulation layer 51 is formed excluding the grooves 61Y, 61Z. This is the same for the other layers. For example, the metal layer 62E that covers the lower surface of the insulation layer 52 is formed on the lower surface of the insulation layer 52 excluding the grooves 62Y, 62Z.

In the first embodiment and the modification described above, a recognition mark similar to the recognition mark 12X may be formed in the outer frame 13. In other words, a through hole for positioning may be formed in the outer frame 13. In this case, the recognition mark and the sprocket hole 13X may both be formed in the outer frame 13. Alternatively, only the recognition mark may be formed in the outer frame 13.

In the first embodiment, the via wiring V1 filling the through hole 51X of the insulation layer 51 and a portion of the through hole 30X of the substrate 30 is formed. Then, the structural body 42 is stacked on the upper surface 30B of the substrate 30 by way of the adhesive layer 71. Subsequently, the via wiring V2 for filling the through holes 71X, 62X, 52X is formed on the via wiring V1. Instead, the formation of the via wiring V1 may be omitted. In this case, the structural body 42 is stacked on the upper surface 30B of the substrate through the adhesive layer 71. Then, the via wiring V2 may be formed in the through holes 51X, 30X, 71X, 62X, and 52X.

Figure 32:
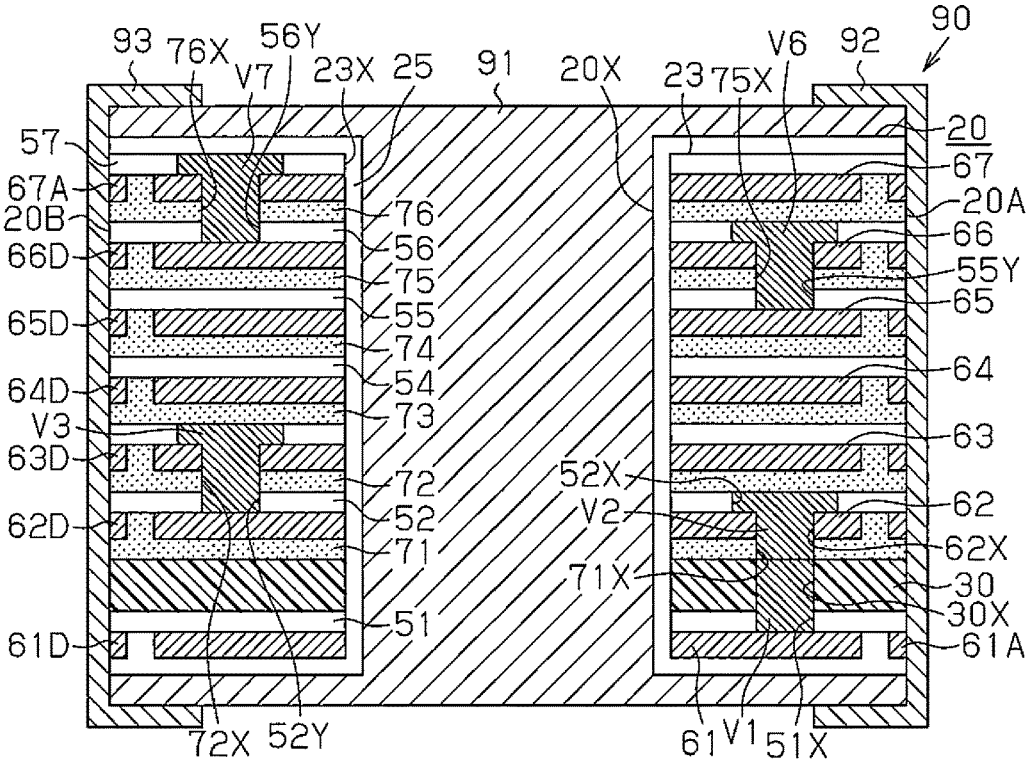
FIGS. 32 and 33 are schematic cross-sectional views illustrating an inductor of various modifications.

In the first embodiment and each modification described above, the through holes 52Y to 56Y of the insulation layers 52 to 56 have larger planar shapes than the through holes 72X to 76X of the adhesive layers 72 to 76 immediately above the insulation layers 52 to 56. Instead, for example, as illustrated in FIG. 32, the planar shapes of the through holes 52Y to 56Y (only through holes 52Y, 55Y, 56Y illustrated in FIG. 32) may be substantially the same size as the through holes 72X to 76X (through holes 72X, 75X, 76X in FIG. 32) of the adhesive layers 72 to 76. Such a structure also has advantages (1) to (3) and (5) to (14) of the embodiment described above.

In the first embodiment and each modification described above, the through hole 30X of the substrate 30 and the through hole 51X of the insulation layer 51 have larger planar shapes than the through hole 71X of the adhesive layer 71 stacked on the substrate 30. Instead, for example, as illustrated in FIG. 32, the planar shapes of the through holes 30X, 51X may be substantially the same size as the through hole 71X. In this case, for example, the through holes 51X, 30X may be filled with the via wiring V1. Alternatively, the via wiring V1 may be omitted, and the through holes 51X, 30X, 71X, 62X, and 52X may be filled with the via wiring V2.

In the first embodiment and each modification described above, the number of structural bodies stacked on the substrate 30 is not particularly limited. For example, two or more structural bodies may be stacked on the lower surface 30A of the substrate 30, or one to five or seven or more structural bodies may be stacked on the upper surface 30B of the substrate 30. Furthermore, the number of structural bodies stacked on the lower surface 30A of the substrate 30 and the number of structural bodies stacked on the upper surface 30B of the substrate 30 may be adjusted so that the substrate 30 is arranged near the center in the thickness direction of the stacked body 23.

Figure 33:
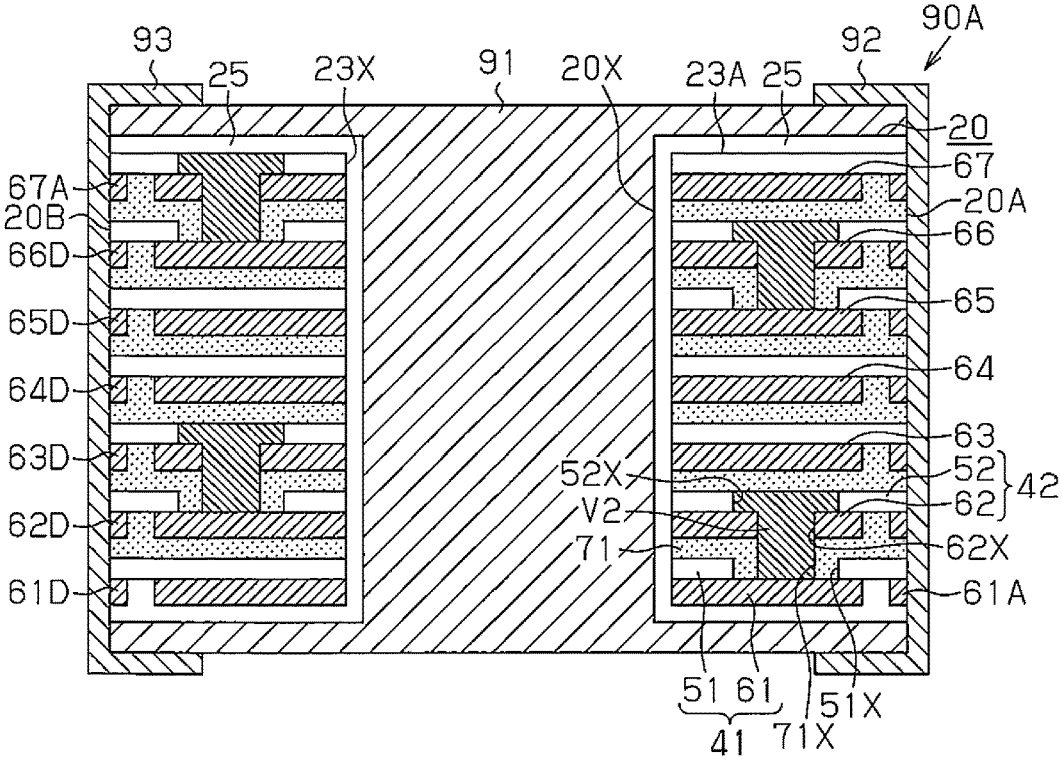

In the first embodiment and each modification described above, the substrate 30 may be omitted. For example, as illustrated in FIG. 33, the stacked body 23A of the inductor 90A does not include the structure corresponding to the substrate 30. In FIG. 33, the structural body 42 is stacked on the insulation layer 51 of the structural body 41 by way of the adhesive layer 71. In this case, the wiring 61 and the wiring 62 are electrically connected by the via wiring V2 in the through holes 71X, 62X, 52X. The inter-layer distance between the wirings 61, 62 can be shortened by omitting the substrate 30 to increase the inductance of the inductor 90A. The entire inductor 90 can be reduced in thickness by omitting the substrate 30. fill

Second Embodiment

A second embodiment will now be described with reference to FIGS. 34 to 38.

Figure 34:
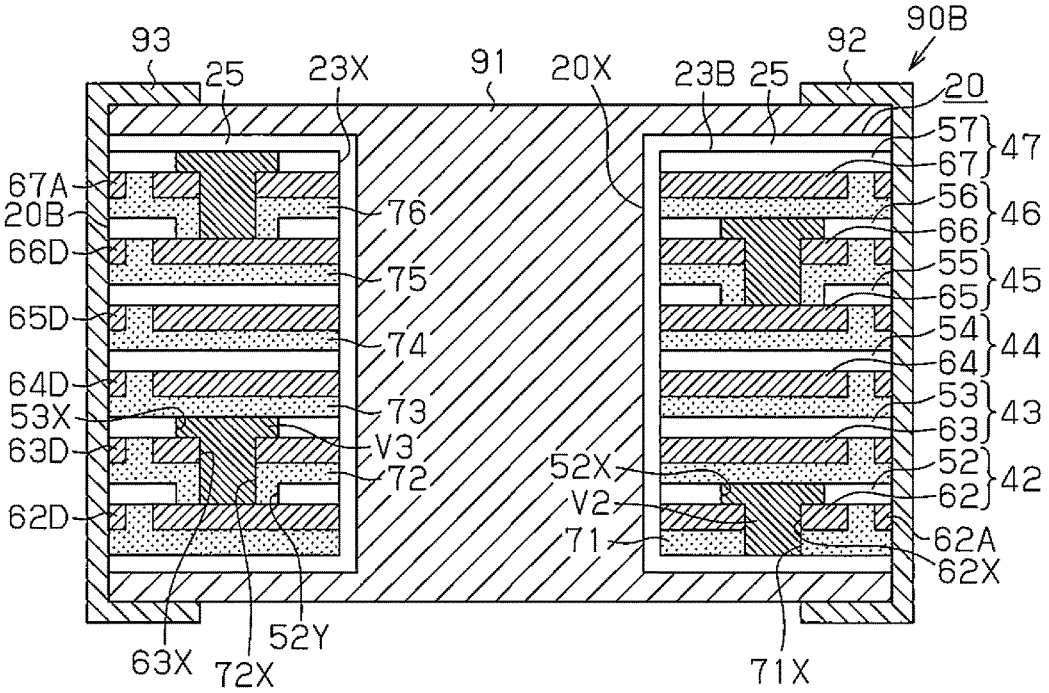
FIG. 34 is a schematic plan view illustrating a second embodiment of an inductor.

In a stacked body 23B of an inductor 90B illustrated in FIG. 34, the structural body 41 (insulation layer 51 and wiring 61), the substrate 30, and the via wiring V1 are omitted from the inductor 90 illustrated in FIG. 8B, and the structural body 42 is stacked on the adhesive layer 71. Thus, in the stacked body 23B, the lower surface of the adhesive layer 71 is the outermost surface (lowermost surface herein) of the stacked body 23B. In this case, for example, the through holes 71X, 62X, 52X are filled with the via wiring V2, and the lower end face of the via wiring V2 is exposed from the adhesive layer 71. The insulation film 25 is formed to cover the lower end face of the via wiring V2 and the lower surface of the adhesive layer 71. In the stacked body 23B, the wiring 62 is the lowermost wiring. Thus, the connecting portion 62A is formed at one end of the wiring 62 in place of the connecting portion 61A.

One example of a method for manufacturing the inductor 90B will now be described.

Figure 35A:
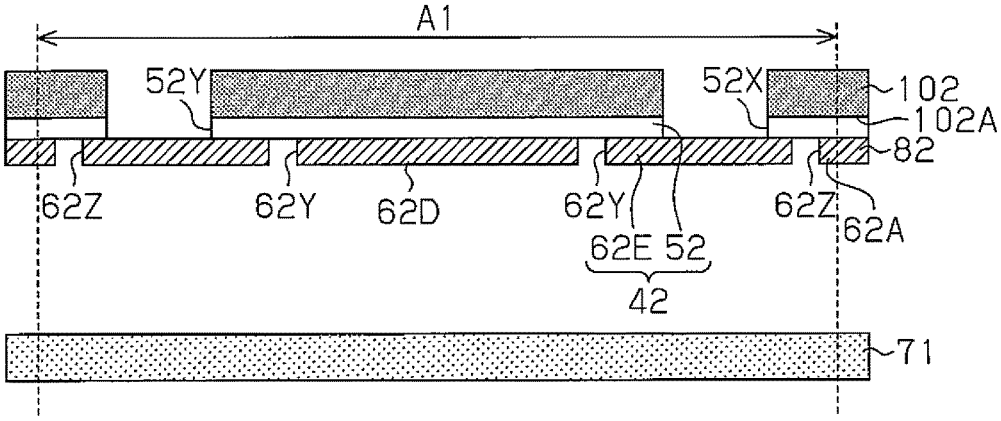
FIGS. 35A to 35C, 36A, 36B, 37A, 37B, and 38 are schematic cross-sectional views illustrating the manufacturing method of the inductor of FIG. 34.

First, in the step illustrated in FIG. 35A, the insulation layer 52 including the through holes 52X, 52Y is stacked on the lower surface 102A of the support film 102, and the metal foil including the metal layers 62D, 62E, 82 and the connecting portion 62A is stacked on the insulation layer 52 like the steps illustrated in FIGS. 12A and 12B. Then, the adhesive layer 71 is arranged on the lower side of the metal layers 62D, 62E, 82.

Figure 35B:
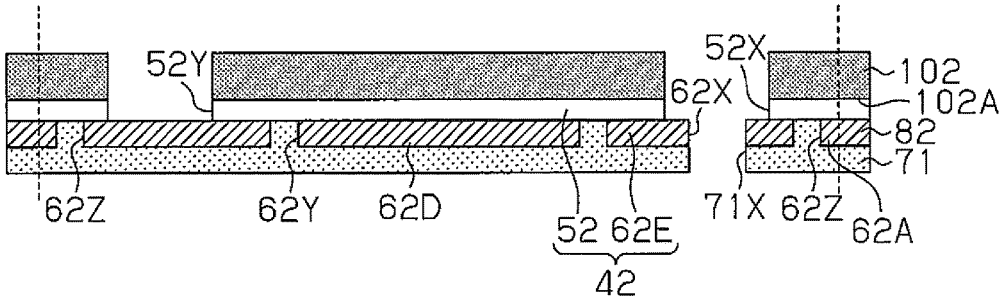

In the step illustrated in FIG. 35B, the adhesive layer 71 in the semi-cured state that covers the metal layers 62D, 62E, 82 and the entire surface of the connecting portion 62A is stacked on the lower surface of the insulation layer 52 like the step illustrated in FIG. 13A. Then, the through hole 62X, which extends through the metal layer 62E exposed from the through hole 52X, and the through hole 71X, which extends through the adhesive layer 71 and communicates with the through hole 62X, are formed like the step illustrated in FIG. 13B.

Figure 35C:
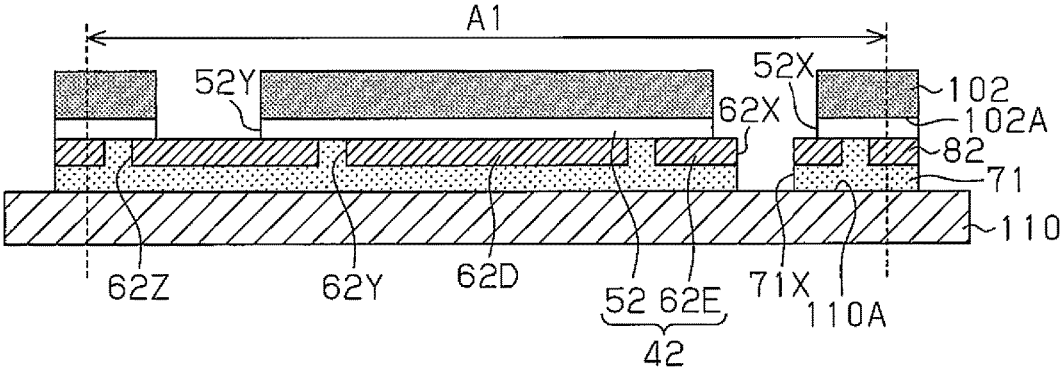

In the step illustrated in FIG. 35C, the structural body 42 is stacked on the upper surface 110A of the support substrate 110 by way of the adhesive layer 71. The structure illustrated in FIG. 35C is heated and pressurized from above and below through vacuum pressing, for example. Then, the adhesive layer 71 is cured. This adheres the adhesive layer 71 to the support substrate 110, and the adhesive layer 71 is adhered to the structural body 42. In this case, a portion of the upper surface 110A of the support substrate 110 is exposed from the through hole 71X. The metal plate and the metal foil, for example, may be used as the support substrate 110. A tape-like substrate of resin film such as polyimide film, PPS (polyphenylene sulfide) film, a glass plate, and the like may be used as the support substrate 110. In the present embodiment, a copper plate is used for the support substrate 110. The support substrate 110 is formed, for example, to be thicker than the wiring 62 and thicker than the insulation layer 52. The mechanical strength of the structural body 42 in the middle of manufacturing can be sufficiently ensured by using such support substrate 110. This limits degradation in the handling property of the structural body 42 during manufacturing even if the substrate 30 is omitted.

Figure 36A:
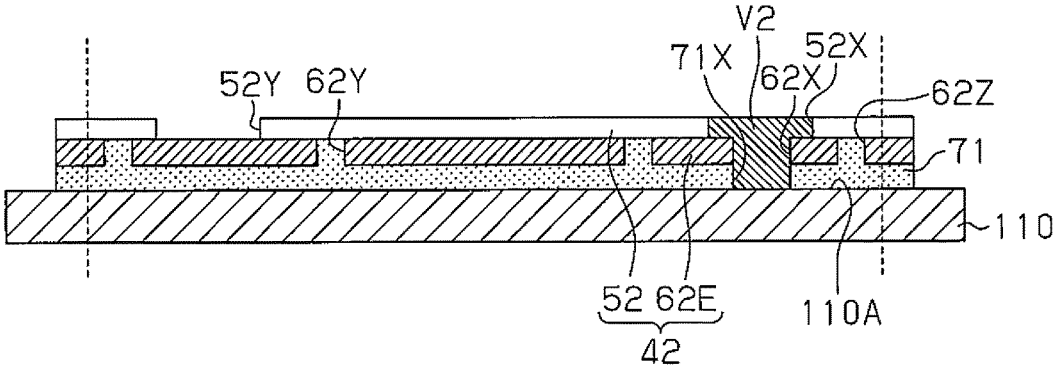

In the step illustrated in FIG. 36A, the via wiring V2 is formed on the upper surface 110A of the support substrate 110 exposed from the through hole 71X. The through holes 71X, 62X, 52X are filled with the via wiring V2. The via wiring V2 may be formed, for example, by performing electrolytic plating. For example, a first conductive layer (e.g., Ni layer) is formed on the support substrate 110 exposed from the through hole 71X through electrolytic plating that uses the support substrate 110 (copper plate herein) as the power supplying layer. Then, a second conductive layer (e.g., Cu layer) is formed on the first conductive layer through electrolytic plating. This forms the via wiring V2 having a two-layer structure. A material that functions as an etching stopper layer when removing the support substrate 110 through etching in a subsequent step is preferred as the material of the first conductive layer. Thus, the support substrate 110 functions as a supporting body in the manufacturing process and also functions as the power supplying layer in the electrolytic plating. The via wiring V2 can also be formed through other processes such as by filling a metal paste or the like.

Figure 36B:
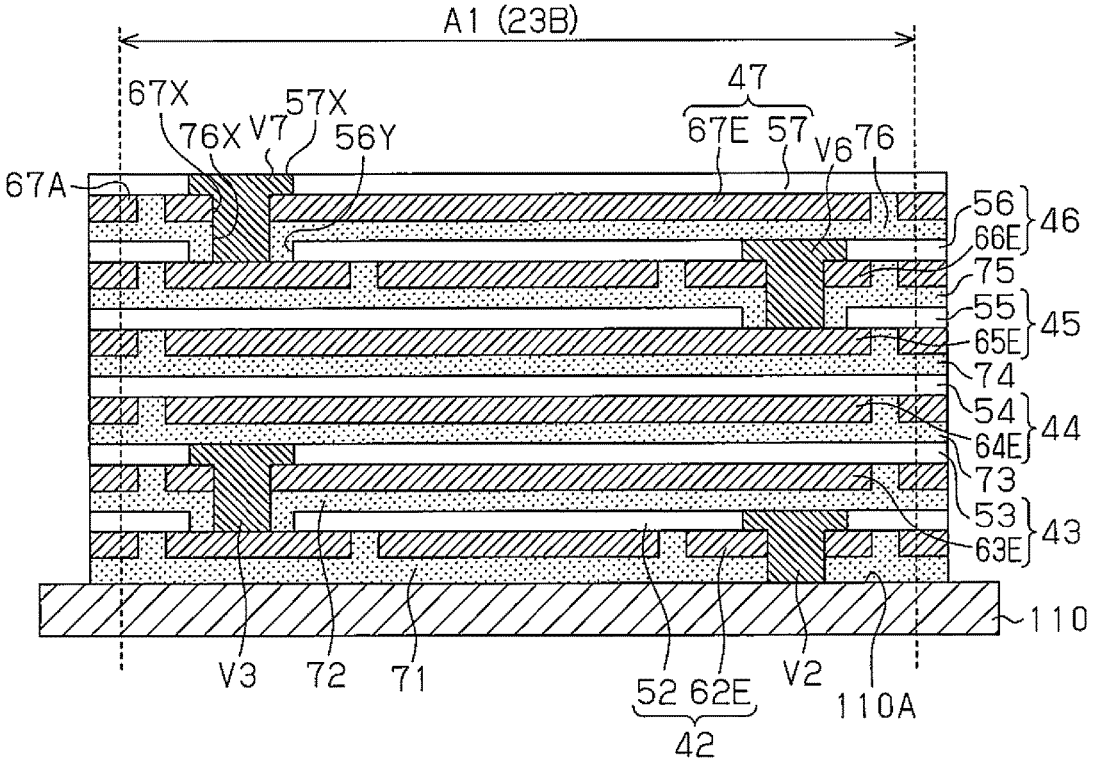

In the step illustrated in FIG. 36B, the structural bodies 43 to 47 are stacked on the structural body 42, which is stacked on the upper surface 110A of the support substrate 110, like the steps illustrated in FIGS. 15A to 25B. In the manufacturing steps described above, the stacked body 23B including the plurality of structural bodies 42 to 47 stacked in order on the upper surface 110A of the support substrate 110 in each individual region A1 can be manufactured. When forming the via wirings V3 to V7 through electrolytic plating, the support substrate 110 and the via wiring V2 may be used as power supplying layers.

Figure 37A:
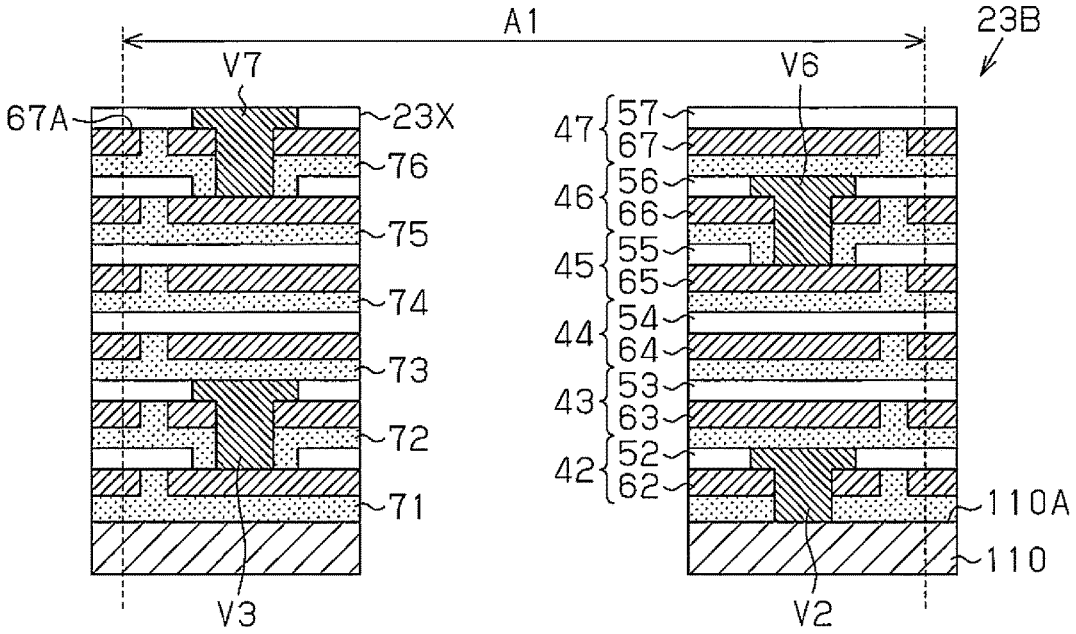

In the step illustrated in FIG. 37A, the metal layers 62E to 67E (refer to FIG. 36B) are shaped when punched out and processed to have the shapes of the wirings 62 to 67 of the helical coil like the steps illustrated in FIGS. 26A to 28B. In this step, the metal layers 62E to 67E are shaped with the stacked body 23B stacked on the support substrate 110, which has high rigidity. This limits displacement of the wirings 62 to 67 when shaped. The position accuracy of the wirings 62 to 67 may thus be improved. The wirings 62 to 67 improve the position accuracy of the coil.

Figure 37B:
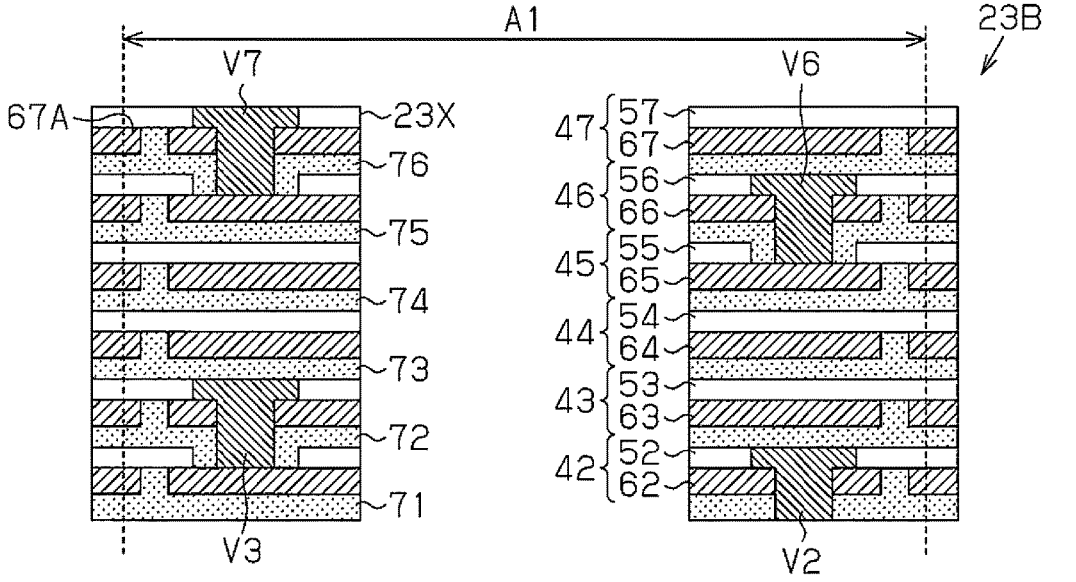

The support substrate 110 used as a temporary substrate is then removed. For example, if the copper plate is used for the support substrate 110, the via wiring V2 (specifically, first conductive layer, which is Ni layer) and the adhesive layer 71 are selectively etched by wet etching using aqueous ferric chloride, aqueous copper chloride, ammonium persulfate aqueous solution, or the like. This removes the support substrate 110. In this case, the first conductive layer (Ni layer) of the via wiring V2 and the adhesive layer 71 function as the etching stopper layers for when etching the support substrate 110. If the PI film, and the like are used for the support substrate 110 or if a stripping layer is arranged, the support substrate 110 may be mechanically removed from the stacked body 23B. As illustrated in FIG. 37B, the removal of the support substrate 110 exposes the lower end face of the via wiring V2 and the lower surface of the adhesive layer 71 to the outer side.

In this manner, the support substrate 110 is relatively thick to ensure the mechanical strength of the structural bodies 42 to 47 and the adhesive layers 71 to 76 in the manufacturing process, and the support substrate 110 is removed after stacking the structural bodies 42 to 47. Thus, each member of the stacked body 23B does not need to be thick. Therefore, the entire stacked body 23B can be thinned.

Figure 38:
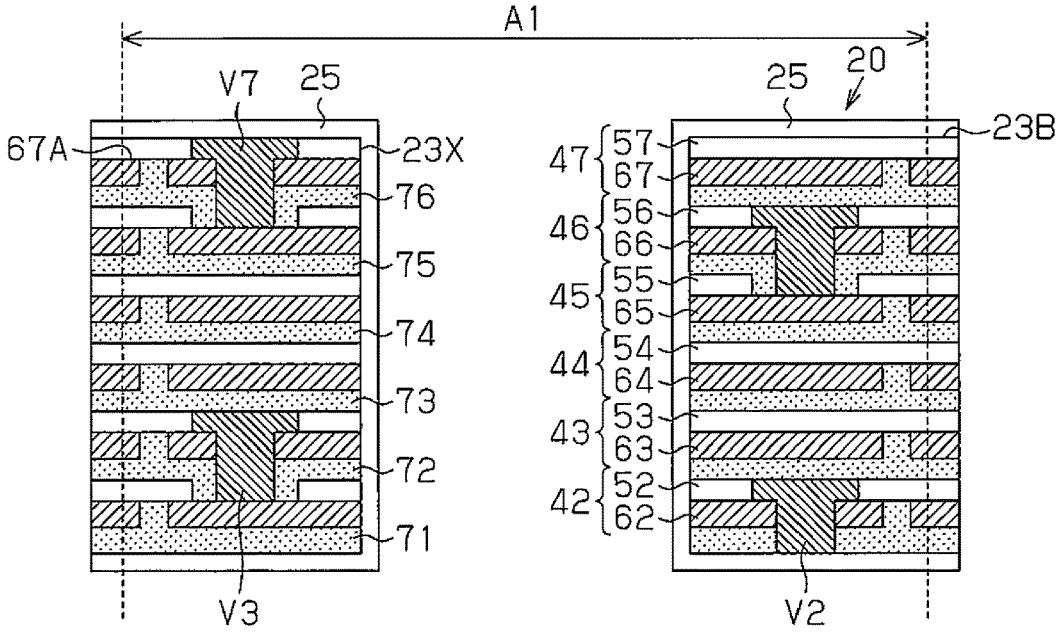

Then, in the step illustrated in FIG. 38, the insulation film 25 that covers the entire surface of the stacked body 23B including the inner wall surface of the through hole 23X is formed. This manufactures the coil substrate 20 in each individual region A1. Then, the inductor 90B illustrated in FIG. 34 can be manufactured by performing steps similar to the steps illustrated in FIGS. 30B to 31B.

The inductance of the inductor 90B may be improved by omitting the structural body 41 (insulation layer 51 and wiring 61), the substrate 30, and the via wiring V1.

Third Embodiment

A third embodiment will now be described with reference to FIGS. 39 to 45B.

Figure 39:
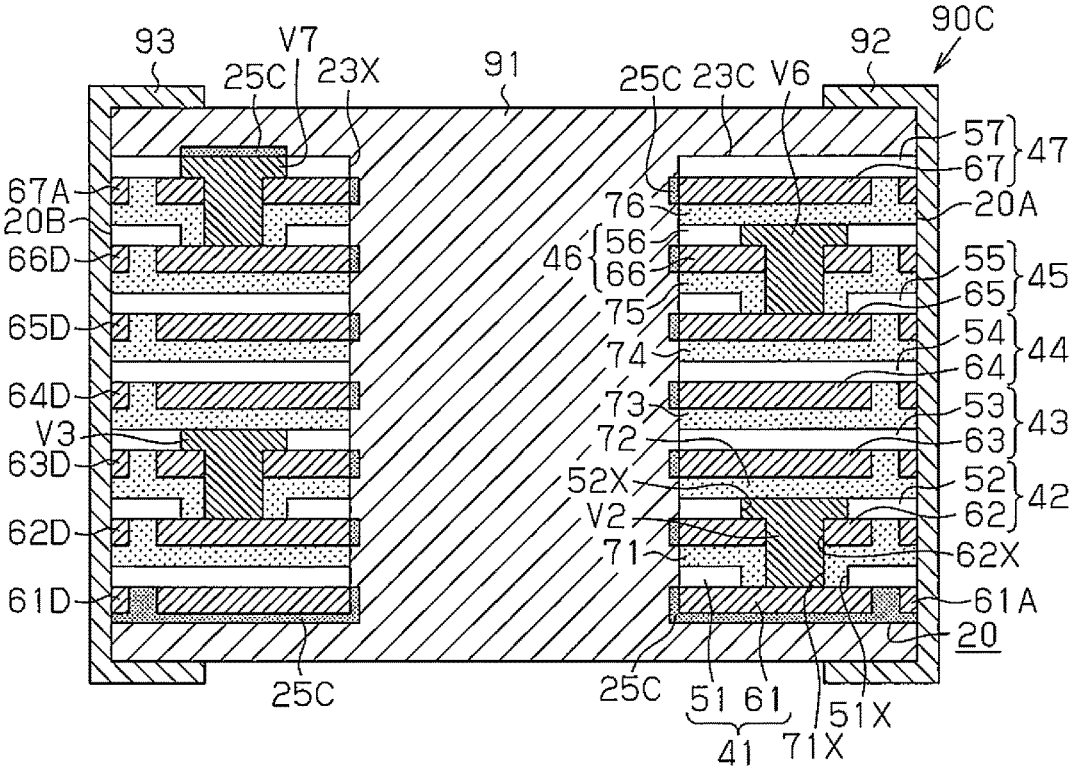
FIG. 39 is a schematic cross-sectional view illustrating a third embodiment of an inductor.

In a stacked body 23C of an inductor 90C illustrated in FIG. 39, the substrate 30 is omitted from the inductor 90 illustrated in FIG. 8B, and the structural body 42 is stacked on the insulation layer 51 of the structural body 41 with the adhesive layer 71 located in between. More specifically, the insulation layer 51, which includes the through hole 51X, is stacked on the upper surface of the wiring 61, which is the lowermost layer, and the adhesive layer 71 is stacked on the upper surface of the insulation layer 51. The adhesive layer 71 is partially located in the through hole 51X and covers the wall surface of the through hole 51X. Further, the adhesive layer 71 covers portions of the side surfaces of the wiring 62 and the metal layer 62D. The adhesive layer 71 includes the through hole 71X that extends through the adhesive layer 71 in the thickness direction of the adhesive layer 71. The upper surface of the wiring 61 is partially exposed through the through hole 71X. The through hole 71X extends from the upper surface of the adhesive layer 71 to the lower surface of the adhesive layer 71 formed in the through hole 51X. That is, the through hole 71X is partially formed in the through hole 51X. In other words, the through hole 51X has a larger planar shape than the through hole 71X.

The wiring 62 is stacked on the upper surface of the adhesive layer 71. The wiring 62 includes the through hole 62X, which is in communication with the through hole 71X. The insulation layer 52 is stacked on the upper surface of the wiring 62 and the upper surface of the adhesive layer 71. The insulation layer 52 includes the through hole 52X, which extends through the insulation layer 52 in the thickness direction and is in communication with the through holes 62X and 71X. The upper surface of the wiring 62 around the through hole 62X is exposed from the through hole 52X. Accordingly, the through hole 52X has a larger planar shape than the through holes 62X and 71X.

The via wiring V2 is formed in the through holes 52X, 62X, and 71X, which are in communication with one another. The via wiring V2 is formed on the wiring 61, which is exposed from the through hole 71X. The through holes 52X, 62X, and 71X are all filled with the via wiring V2. The via wiring V2 functions as a through electrode that connects the wiring 61 and the wiring 62 in series.

In the coil substrate 20 illustrated in FIG. 39, insulation films 25C that partially cover the surface of the stacked body 23C are formed in place of the insulation film 25 that covers the entire surface of the stacked body 23 illustrated in FIG. 8B. Each insulation film 25C covers the surface of a conductor exposed from the surface of the stacked body 23C. In the present example, the insulation films 25C cover the side surfaces of the wirings 62 to 67 that are exposed from the wall surface of the through hole 23X, the side surfaces of the wirings 62 to 67 exposed from the outer walls surface of the stacked body 23C, the side surfaces and lower surface of the wiring 61 in the lowermost layer, and the upper surfaces of the via wirings V7 and V8 (only via wiring V7 illustrated in FIG. 39) in the uppermost layer. In this manner, the insulation films 25C, which cover the wirings 61 to 67 and the via wirings V7 and V8, are discrete or spaced apart from one another. For example, the insulation film 25C that covers the side surfaces and the lower surface of the wiring 61 is discrete and spaced apart from the insulation film 25C that covers the side surface of the wiring 62 exposed from the wall surface of the through hole 23X. The insulation films 25C are formed from an electrodeposition resin, which is obtained through electrodeposition (electrodeposition coating). The material of the electrodeposition resin may be an insulative resin, such as an epoxy resin, an acrylic resin, or an imide resin. The insulation films 25C may also partially cover the insulation layers 51 to 57 and the adhesive layers 71 to 76 that are formed around the wirings 61 to 67 and the via wirings V7 and V8.

The surfaces of the connecting portions 61A and 67A, which are exposed through the side surfaces 20A and 20B of the stacked body 23C, are exposed from the insulation films 25C and thus not covered by the insulation films 25C.

In the same manner as the first and second embodiments, a magnetic material, which is formed from magnetic powder and a resin that serves as a bonding material, is used for the encapsulation resin 91. Thus, the encapsulation resin 91 functions as a magnetic body. For example, ferrite or a magnetic metal, such as iron or an iron-based alloy, may be used as the material of the magnetic powder. As the material of the bonding material, for example, a thermosetting resin such as an epoxy-based resin or a thermoplastic resin may be used.

The encapsulation resin 91 entirely covers the coil substrate 20 (stacked body 23C and insulation films 25C) excluding the side surfaces 20A and 20B where the connecting portions 61A and 67A are exposed. Accordingly, the gaps between the insulation films 25C are filled with the encapsulation resin 91. In other words, the encapsulation resin 91 contacts and directly covers portions of the surfaces of the insulation layers 51 to 57 and portions of the surfaces of the adhesive layers 71 to 76. This increases the volume of the encapsulation resin 91, which functions as the magnetic body, in, for example, the through hole 23X and increases the inductance of the inductor 90C. Further, the omission of the substrate 30 allows the inductor 90C to be entirely reduced in thickness.

In the third embodiment, the through hole 23X is one example of a first through hole, the through hole 52Y is one example of a second through hole, the through hole 72X is one example of a third through hole, the through hole 63X is one example of a fourth through hole, the through hole 53X is one example of a fifth through hole, the through hole 62X is one example of a sixth through hole, the through hole 52X is one example of a seventh through hole, the through hole 71X is one example of an eighth through hole, and the through hole 51X is one example of an ninth through hole. The wiring 62 is one example of a first wiring, the wiring 63 is one example of a second wiring, the wiring 61 is one example of a third wiring, the insulation layer 52 is one example of a first insulation layer, the insulation layer 53 is one example of a second insulation layer, and the insulation layer 51 is one example of a third insulation layer. The adhesive layer 72 is one example of a first adhesive layer, the adhesive layer 71 is one example of a second adhesive layer, the via wirings V2 to V8 are each one example of a through electrode, the via wiring V3 is one example of a first through electrode, and the via wiring V2 is one example of a second through electrode. The insulation films 25C are each one example of a discrete insulation film. The insulation films 25C that cover the surfaces of the wirings 61 to 67 exposed from the surface of the stacked body 23 correspond to first discrete insulation films. The insulation films 25C that cover the surfaces of the via wirings V7 and V8 exposed from the surface of the stacked body 23 correspond to second discrete insulation films.

One example of a method for manufacturing the inductor 90C will now be described.

Figure 40A:
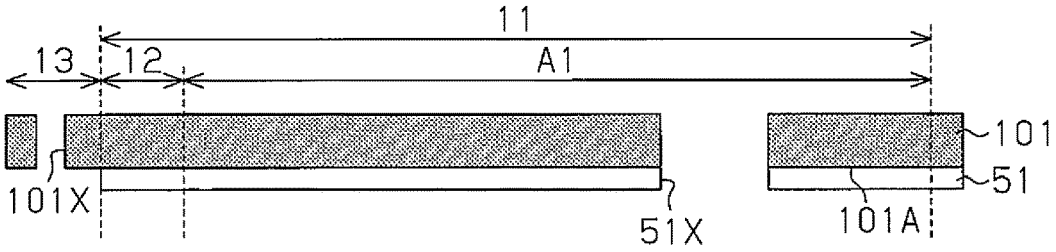
FIG. 40A is a schematic cross-sectional view illustrating a method for manufacturing the inductor of FIG. 39 and taken along line 40*a*-40*a* in FIG. 40C.
Figure 40B:
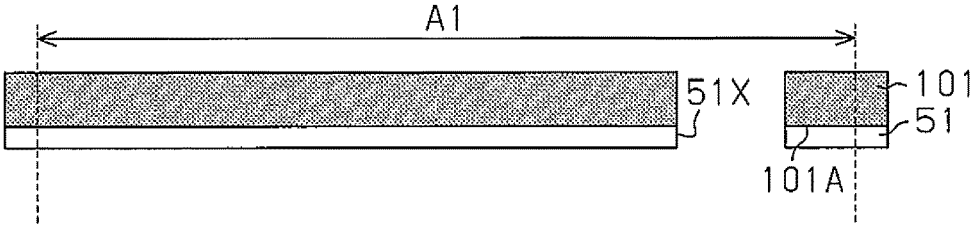
FIG. 40B is a schematic cross-sectional view illustrating the method for manufacturing the inductor and taken along line 40*b*-40*b* in FIG. 40C.
Figure 40C:
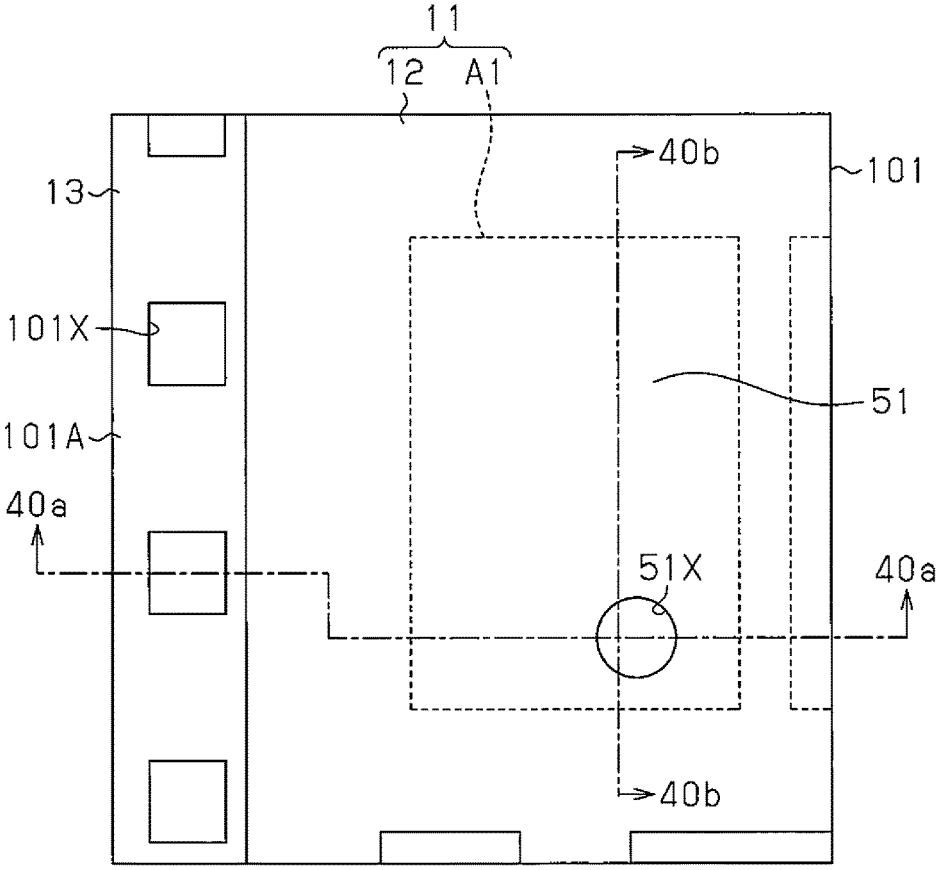
FIG. 40C is a schematic plan view illustrating the method for manufacturing the inductor.

In the step illustrated in FIGS. 40A to 40C, a support film 101 having a structure similar to the substrate 100 illustrated in FIG. 9 is first prepared. As illustrated in FIGS. 40A and 40C, the support film 101 includes a block 11 with a plurality of individual regions A1 (only one illustrated in FIGS. 40A to 40C) and an outer frame 13 projecting out of the block 11. A reel-like (tape-like) flexible insulative resin film may be used, for example, for the support film 101. For example, polyphenylene sulfide, polyimide film, and polyethylene naphtalate film may be used as the support film 101. The thickness of the support film 101 is, for example, approximately 12 to 50 μm.

Then, in the same manner as the step illustrated in FIG. 10A, the insulation layer 51 is stacked, in a semi-cured state, on a lower surface 101A of the support film 101 in a region excluding the outer frame 13 (i.e., in block 11). As illustrated in FIGS. 40A and 40B, a pressing process or a laser cutting process is performed to form the through hole 51X that extends through the support film 101 and the insulation layer 51 in the thickness direction. At the same time as when the through hole 51X is formed or before stacking the insulation layer 51, sprocket holes 101X are formed in the outer frame 13 of the support film 101.

Figure 41A:
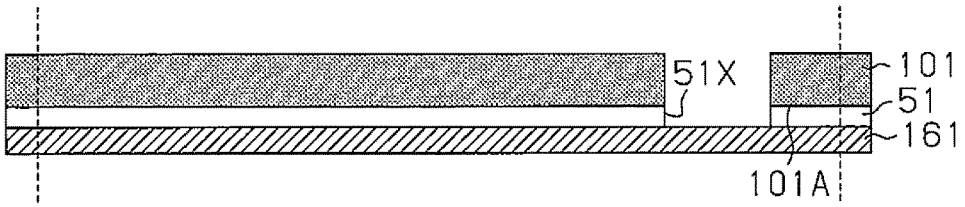
FIG. 41A is a schematic cross-sectional view illustrating the method for manufacturing the inductor.

In the step illustrated in FIG. 41A, the metal foil 161 is stacked on the lower surface of the semi-cured insulation layer 51. The metal foil 161 covers, for example, the entire lower surface of the insulation layer 51. For example, the metal foil 161 is laminated onto the lower surface of the semi-cured insulation layer 51 by thermal compression bonding. Then, a thermal curing process is performed under a temperature of approximately 150° C. to cure the semi-cured insulation layer 51.

Figure 41B:
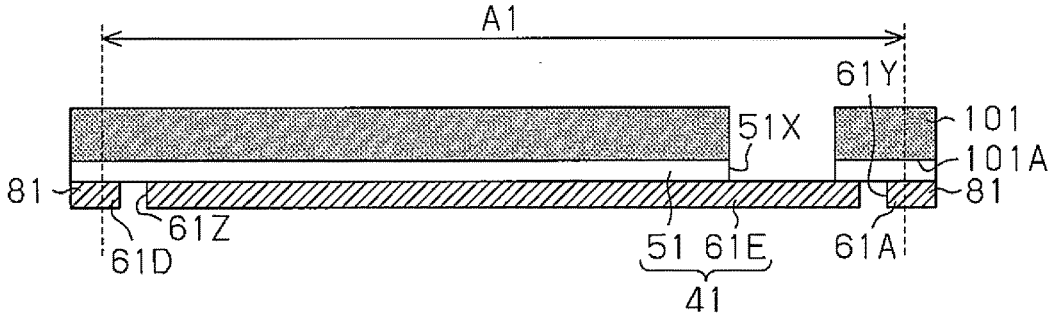
FIG. 41B is a schematic cross-sectional view illustrating the method for manufacturing the inductor and taken along line 41*b*-41*b* in FIG. 41C.
Figure 41C:
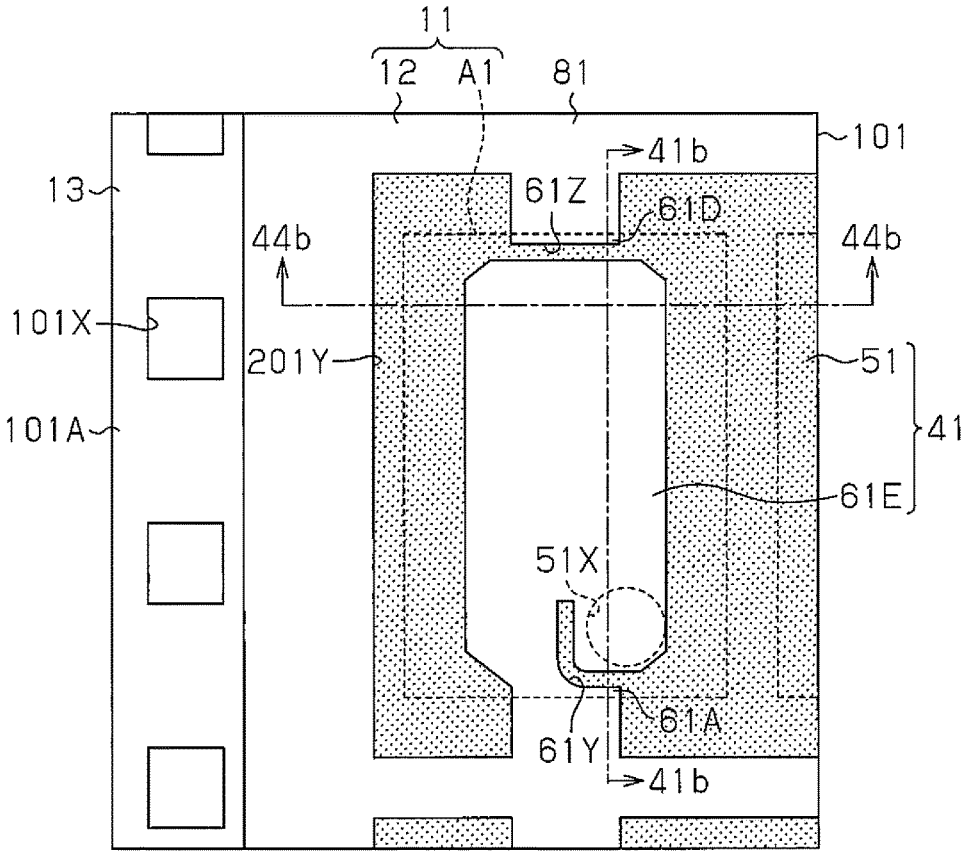
FIG. 41C is a schematic plan view illustrating the method for manufacturing the inductor.

In the same manner as the step illustrated in FIGS. 11B and 11C, the metal foil 161 is patterned using a wiring formation process such as a subtractive process. More specifically, as illustrated in FIGS. 41B and 41C, the metal foil 161 is patterned to form the metal layer 61E on the lower surface of the insulation layer 51 in the individual region A1. The patterning of the metal foil 161 forms the connecting portion 61A at one end of the metal layer 61E and forms the metal layer 61D, which serves as a dummy pattern. As a result, the structural body 41 that includes the insulation layer 51, the metal layer 61E, and the connecting portion 61A is stacked on the lower surface 101A of the support film 101. Further, in this step, as illustrated in FIG. 410, the metal layer 81, which is connected to the connecting portion 61A and the metal layer 61D, is formed on the lower surface of the insulation layer 51 at the location of the connecting portion 12. In other words, in this step, the metal foil 161 illustrated in FIG. 41A is patterned to form the opening 201Y and the grooves 61Y and 61Z. In FIG. 41C, the insulation layer 51 exposed from the opening 201Y and the grooves 61Y and 61Z is shaded.

Figure 42A:
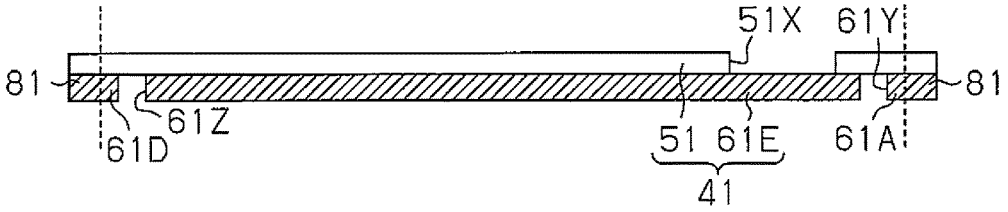
FIGS. 42A to 42D, 43A, 43B, 44A, 44B, 45A, and 45B are schematic cross-sectional views illustrating the method for manufacturing the inductor.

In the step illustrated in FIG. 42A, the support film 101 illustrated in FIG. 41B is removed from the insulation layer 51. For example, the support film 101 is mechanically removed from the insulation layer 51.

Figure 42B:
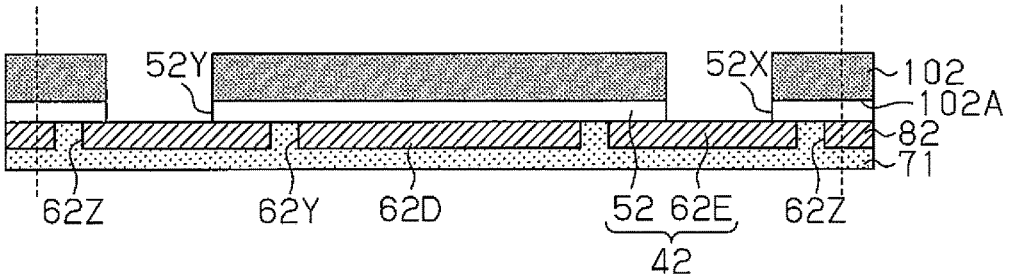

In the step illustrated in FIG. 42B, the insulation layer 52, which includes the through holes 52X and 52Y, is stacked on the lower surface 102A of the support film 102 and a metal foil, which includes the metal layers 62D, 62E, and 82, is stacked on the insulation layer 52 in the same manner as the step illustrated in FIG. 12B. Then, the semi-cured adhesive layer 71, which covers the entire surfaces of the metal layers 62D, 62E, and 82, is stacked on the lower surface of the insulation layer 52 in the same manner as the step illustrated in FIG. 13A.

Figure 42C:
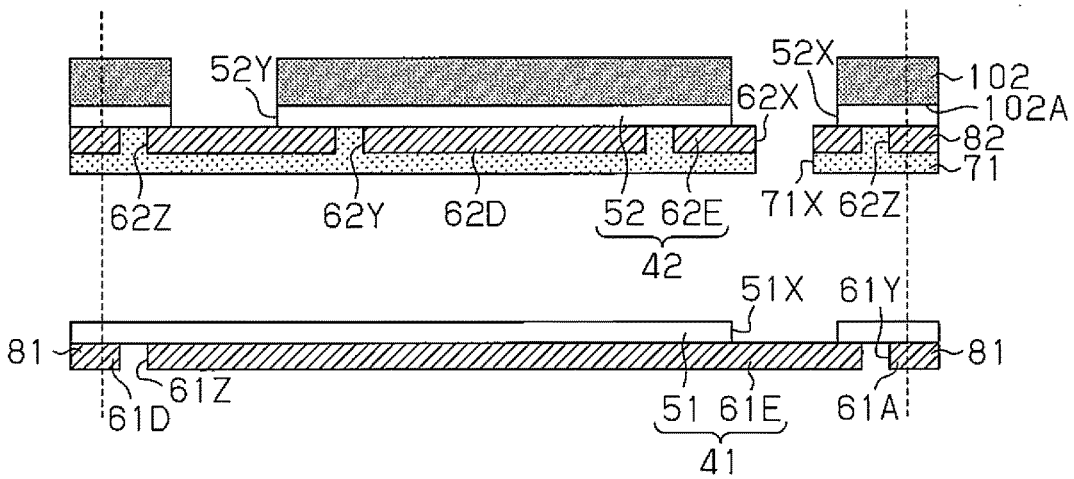

In the step illustrated in FIG. 42C, the through hole 62X, which extends through the metal layer 62E that is exposed from the through hole 52X, and the through hole 71X, which extends through the adhesive layer 71 and is in communication with the through hole 62X, are formed in the same manner as the step illustrated in FIG. 13B.

Figure 42D:
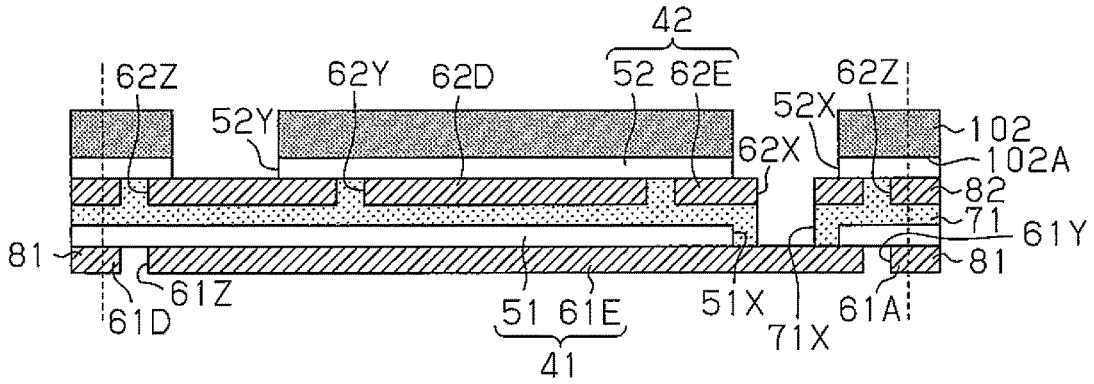

In the step illustrated in FIG. 42D, the structural body 42 and the support film 102 are stacked, with the adhesive layer 71 located in between, on the upper surface of the insulation layer 51 of the structural body 41 so that the structural body 41 and the support film 102 are arranged at the outer side. For example, the structure illustrated in FIG. 42D is heated and pressurized from above and below through vacuum pressing. As a result, the semi-cured adhesive layer 71 is pressed and spread in the planar direction by the lower surface of the metal layer 62E and the upper surface of the insulation layer 51. This spreads a portion of the adhesive layer 71 in the through hole 51X, and the spread adhesive layer 71 covers the wall surface of the through hole 51*x*. Consequently, the through hole 71X is partially formed in the through hole 51X.

Then, the adhesive layer 71 is cured. This keeps the through hole 71X, the through hole 62X, and the through hole 52X in communication with one another. Thus, the upper surface of the metal layer 61E is partially exposed from the through hole 71X. Then, the support film 102 is removed from the insulation layer 52.

Figure 43A:
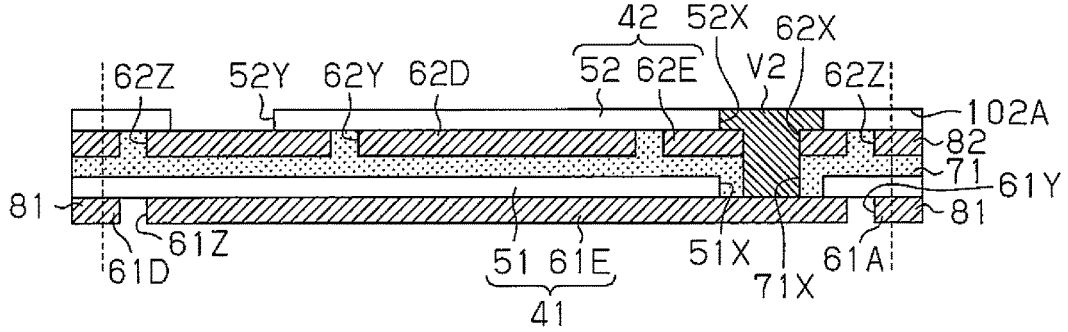

In the step illustrated in FIG. 43A, the via wiring V2 is formed on the upper surface of the metal layer 61E exposed from the through hole 71X. The through holes 71*x*, 62X, and 52X are filled with the via wiring V2. As a result, the via wiring V2 connects the metal layer 61E and the wiring layer 623 in series. The via wiring V2 may be formed, for example, by performing electrolytic plating that uses both of the metal layer 81 and the metal layer 61E as the power supplying layers or by filling metal paste or the like.

In the manufacturing steps described above, the metal layer 61E is connected in series to the metal layer 62E by the via wiring V2 in the stacked structure that includes the structural body 41 and the structural body 42.

Figure 43B:
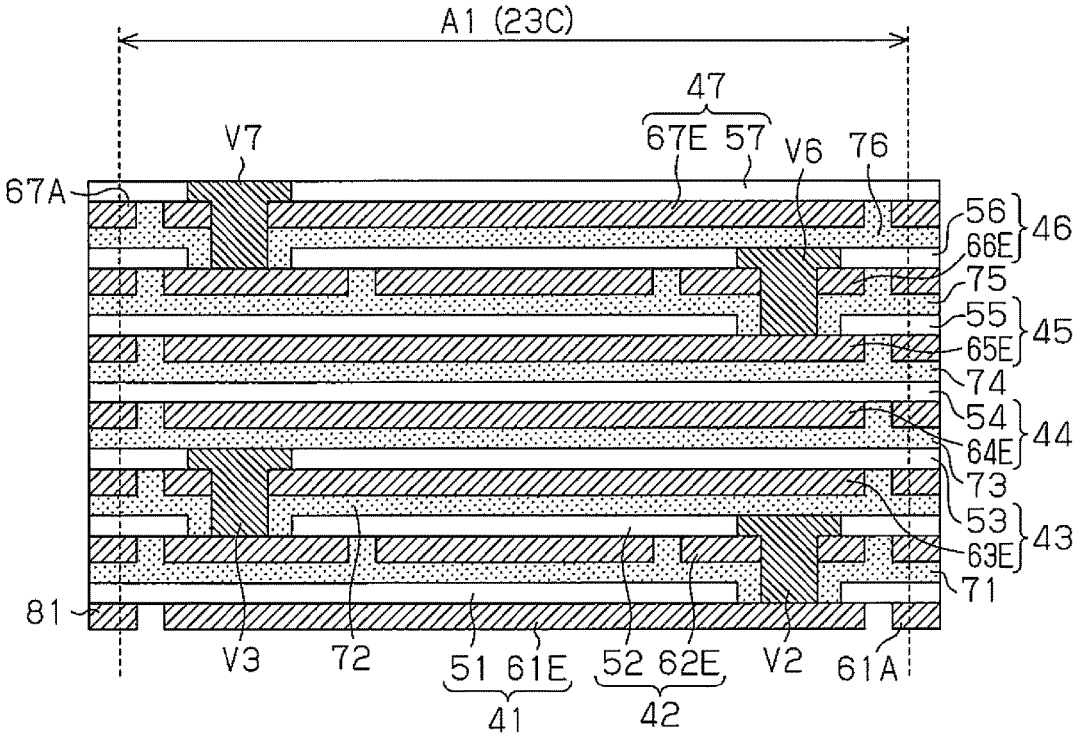

In the step illustrated in FIG. 43B, the structural bodies 43 to 47 are stacked on the structural body 42 in the same manner as the steps illustrated in FIGS. 15A to 25B. This manufactures the stacked body 23C, which includes the sequentially stacked structural bodies 41 to 47, in each individual region A1.

Figure 44A:
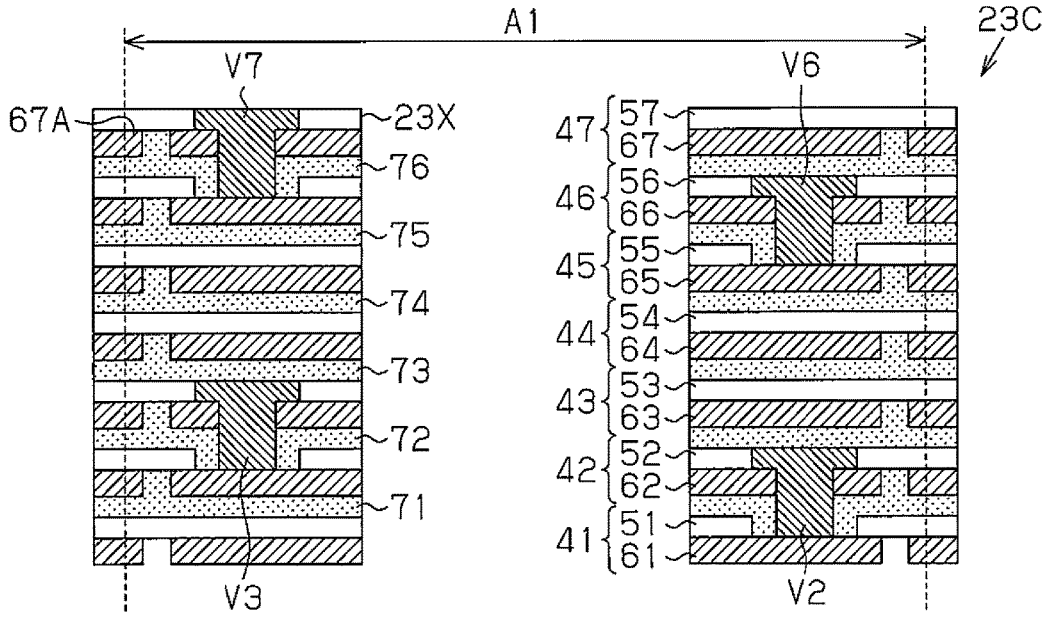
Figure 44B:
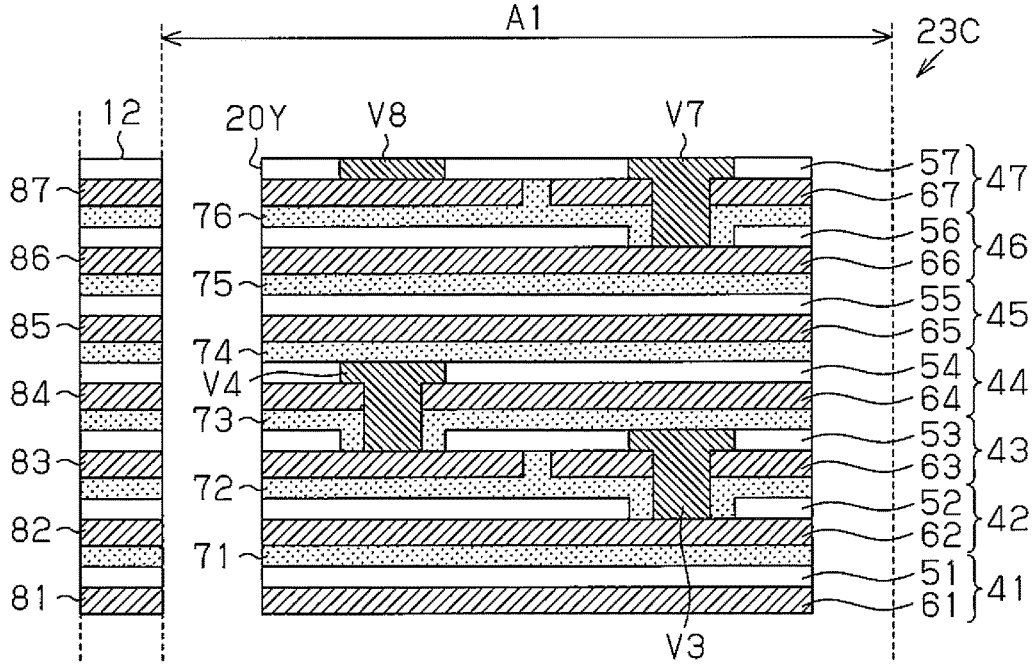

In the step illustrated in FIGS. 44A and 44B, the stacked body 23C is molded in the same manner as the steps illustrated in FIGS. 26A to 28B, and the metal layers 61E to 67E (refer to FIG. 43B) are shaped when punched out and processed to have the shapes of the wirings 61 to 67 of the helical coil. As a result, the through hole 23X is formed in the central portion of the stacked body 23C, as illustrated in FIG. 44A. The formation of the through hole 23X exposes the end surface of each of the wirings 61 to 67 from the wall surface of the through hole 23X. Further, in this step, as illustrated in FIG. 44B, the opening 20Y is formed at a predetermined location in each individual region A1, and the stacked body 23C is molded to be rectangular in a plan view. The formation of the opening 20Y exposes the end surface of each of the wirings 61 to 67 from the outer wall surface (side wall) of the stacked body 23C. FIG. 44B is a cross-sectional view of the coil substrate 20 taken along line 44*b*-44*b* in FIG. 41C.

When the stacked body 23C is punched in a pressing (stamping) process to form the through hole 23X and the opening 20Y, burrs may be produced at the end surfaces of the wirings 61 to 67 exposed from the wall surface of the through hole 23X and the end surfaces of the wirings 61 to 67 exposed from the outer wall surface of the stacked body 23C (wall surface of the opening 20Y). To remove such burrs, a burr removal step may be performed. For example, an etching process such as wet etching may be performed to remove the burrs from the end surfaces of the wirings 61 to 67. The burr removal step facilitates the covering of the end surfaces of the wirings 61 to 67 with the insulation films 25C in a subsequent step.

Further, in the burr removal step, the etching process (wet etching) may be performed so that the end surfaces of the wirings 61 to 67 are located inward to the stacked body 23C from the wall surface of the through hole 23X to form recesses in the wall surface of the through hole 23X at the location of the end surfaces of the wirings 61 to 67. In this case, in a subsequent step, the insulation films 25C are formed to fill the recesses. This reduces portions of the insulation films 25C protruding from the wall surface of the through hole 23X toward the through hole 23X. In other words, the surfaces of the insulation films 25C are substantially flush with the end surfaces of the insulation layers 51 to 57 and the end surfaces of the adhesive layers 71 to 76 on the wall surface of the through hole 23X. This facilitates the filling of the magnetic material (encapsulation resin 91) in a subsequent step and increases the volume (filling amount) of the magnetic material (encapsulation resin 91) to increase the inductance of the inductor 90C. In the same manner, recesses may be formed in the outer wall surface of the stacked body 23C (wall surface of the opening 20Y) at the location of the end surfaces of the wirings 61 to 67.

Figure 45A:
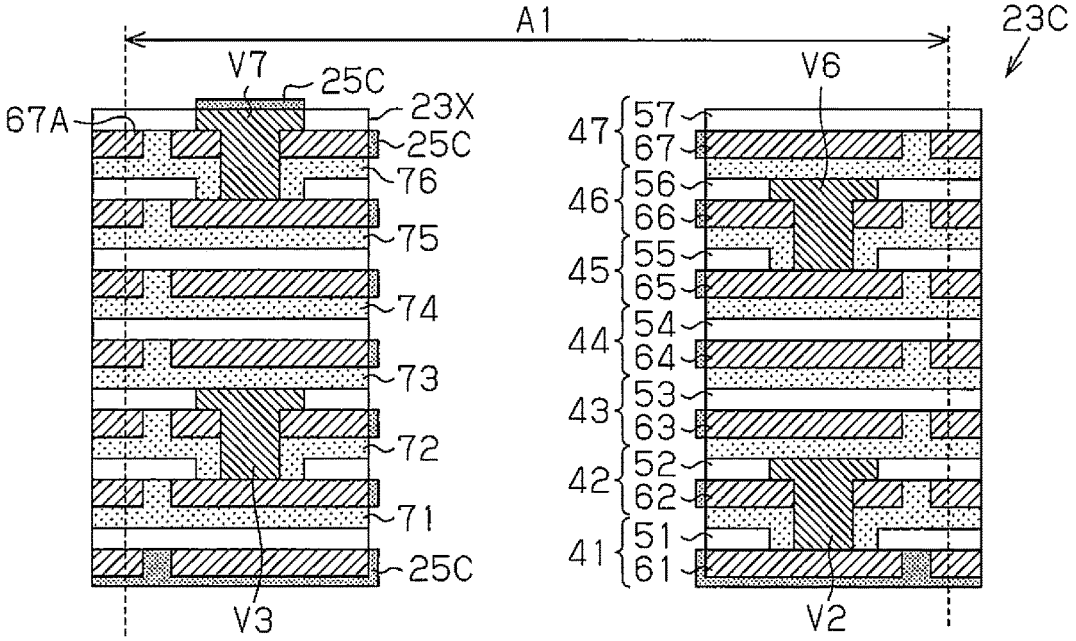
Figure 45B:
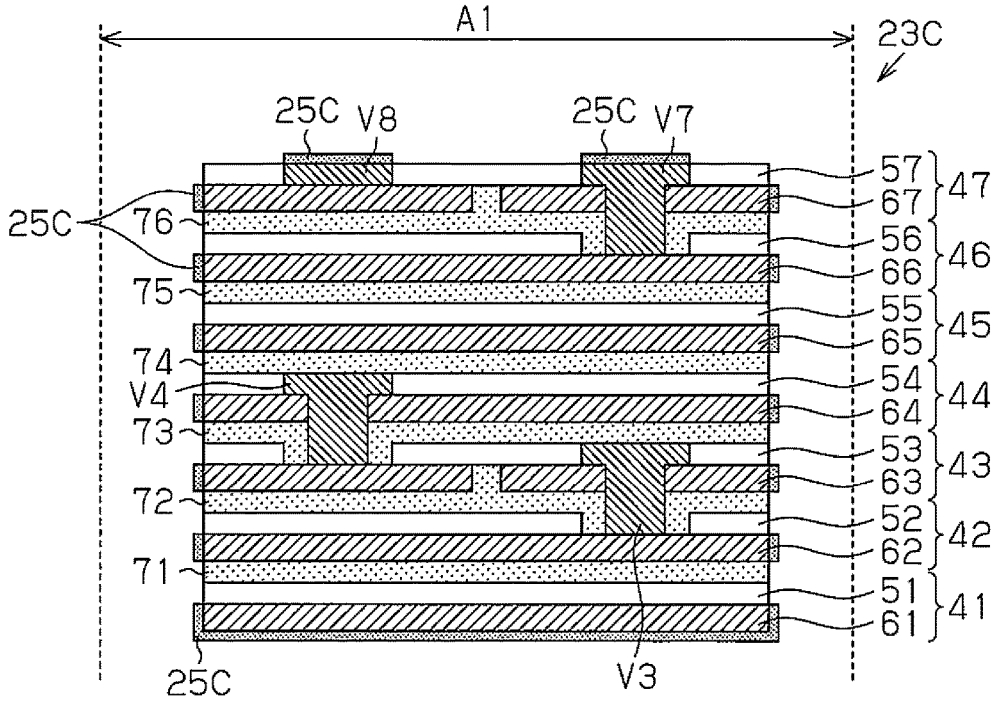

In the step illustrated in FIGS. 45A and 45B, electrodeposition is performed to form the insulation films 25C that cover the surfaces of the wirings 61 to 67 and the via wirings V7 and V8 that are exposed from the surface of the stacked body 23C. More specifically, the insulation films 25C cover the side surfaces (end surfaces) of the wirings 62 to 67 that are exposed from the inner wall surface of the through hole 23X, the side surfaces (end surfaces) of the wirings 62 to 67 that are exposed from the outer wall surface of the stacked body 23C, the side surfaces and the lower surface of the wiring 61, and the upper surfaces of the via wirings V7 and V8. The formation of the insulation films 25C through electrodeposition allows the thickness of the insulation films 25C to be easily controlled. That is, the insulation films 25*c* may be minimized in thickness. Further, electrodeposition selectively (partially) arranges the insulation films 25C on the surface of the stacked body 23C to cover the wirings 61 to 67 and the via wirings V7 and V8 with high accuracy. As a result, the region in which the insulation films 25C are formed may be minimized, and the formation of voids in each insulation film 25C may be limited. FIG. 45B is a cross-sectional view of the coil substrate 20 taken along line 44*b*-44*b* in FIG. 41C.

Then, steps that are the same as the steps 30B to 31B are performed to manufacture the inductor 90C illustrated in FIG. 39. In the third embodiment, the insulation films 25C are thin. Thus, the encapsulation resin 91 may be formed near the wirings 61 to 67, and the volume of the encapsulation resin 91 may be increased. This allows the inductance of the inductor 90C to be increased.

Modified Examples of Third Embodiment

In the inductor 90C of the third embodiment, the insulation film 25 of the inductor 90A illustrated in FIG. 33 is replaced by the insulation films 25C. The inductor 90 (FIG. 8B) and the inductor 90B (FIG. 34) may undergo the same modification.

Figure 46:
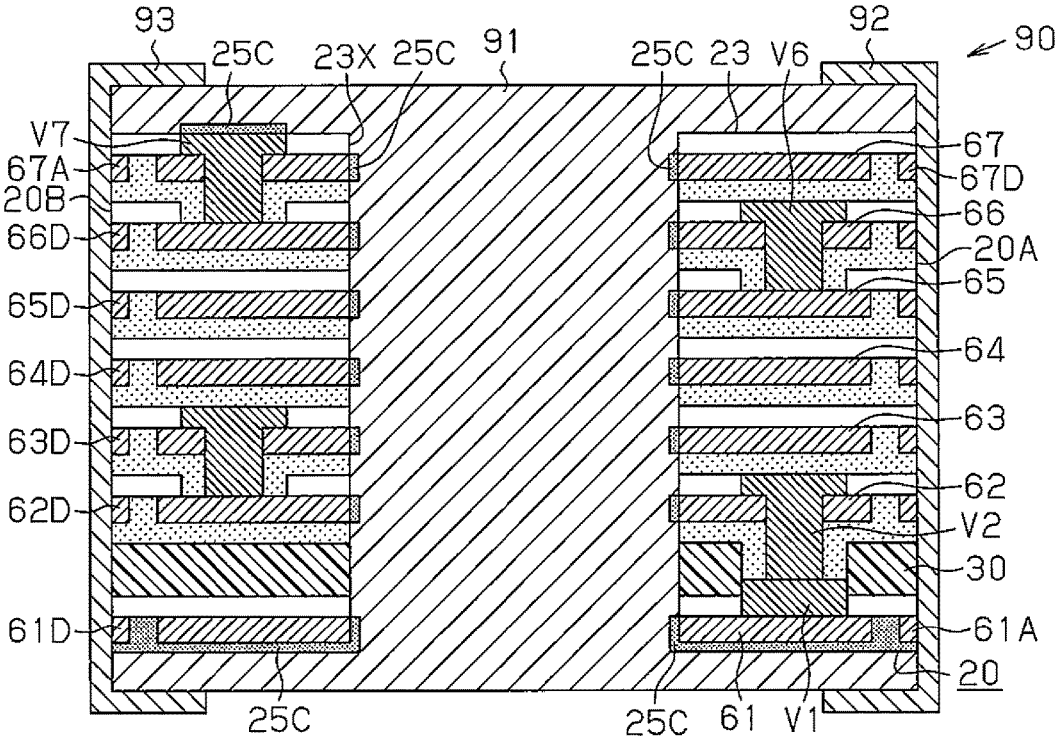
FIGS. 46 and 47 are schematic cross-sectional views illustrating inductors in modified examples of the third embodiment.

For example, as illustrated in FIG. 46, the insulation film 25 of the inductor 90 illustrated in FIG. 8B may be replaced by the insulation films 25C that cover the surfaces of the wirings 61 to 67 and the surfaces of the conductors, such as the via wiring V7, exposed from the surface of the stacked body 23.

Figure 47:
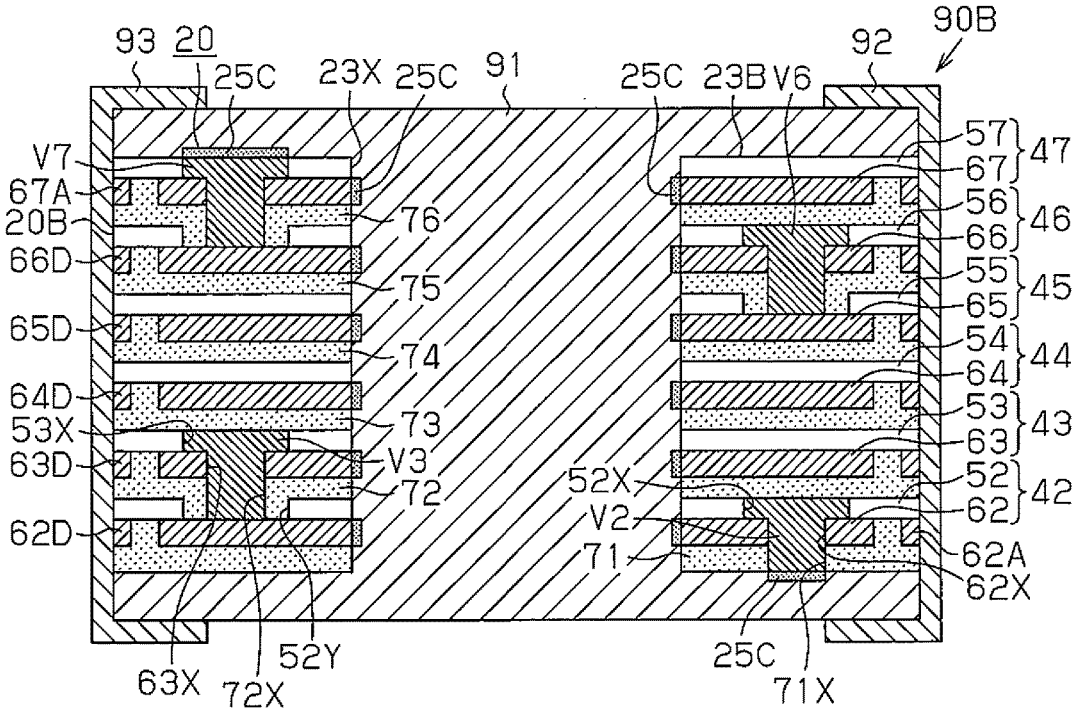

In the same manner, as illustrated in FIG. 47, the insulation film 25 of the inductor 90B illustrated in FIG. 34 may be replaced by the insulation films 25C that cover the surfaces of the wirings 62 to 67 and the surfaces of the conductors, such as the via wirings V2 and V7, exposed from the surface of the stacked body 23B. In this case, the lower surface of the via wiring V2 is covered by the insulation film 25C.

Although not illustrated in the drawings, the insulation film 25 of the inductor 90 illustrated in FIG. 32 may also be replaced by the insulation films 25C.

Fourth Embodiment

A fourth embodiment will now be described with reference to FIGS. 48 to 51B.

Figure 48:
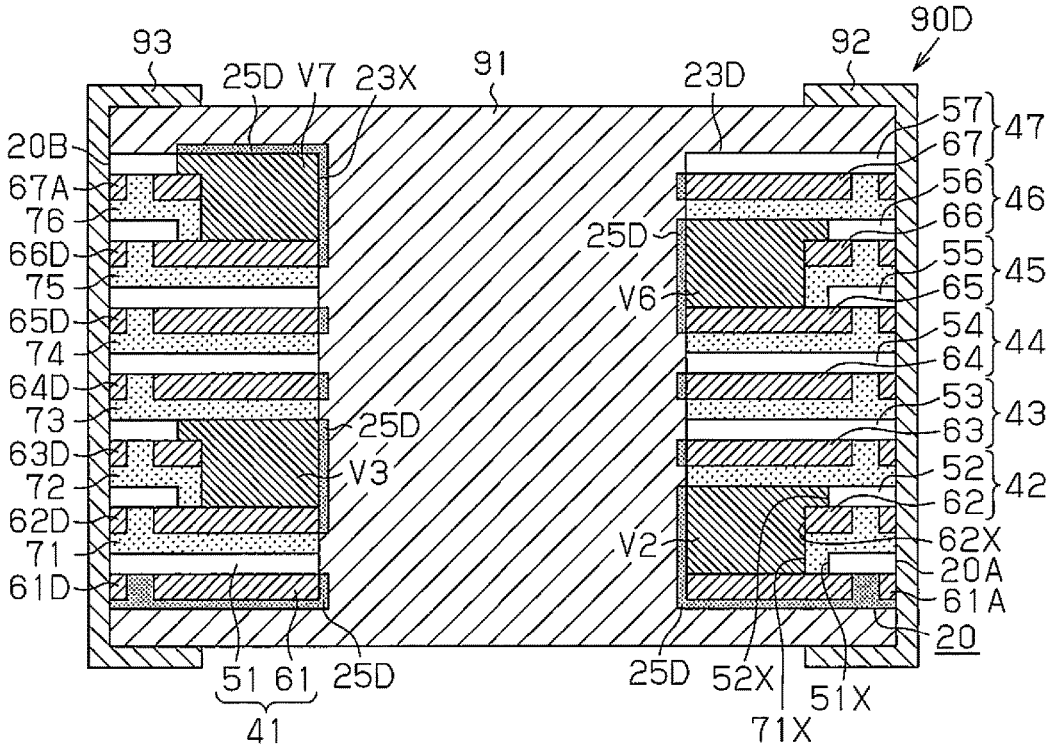
FIG. 48 is a schematic cross-sectional view illustrating a fourth embodiment of an inductor and taken along line 48-48 in FIG. 49.
Figure 49:
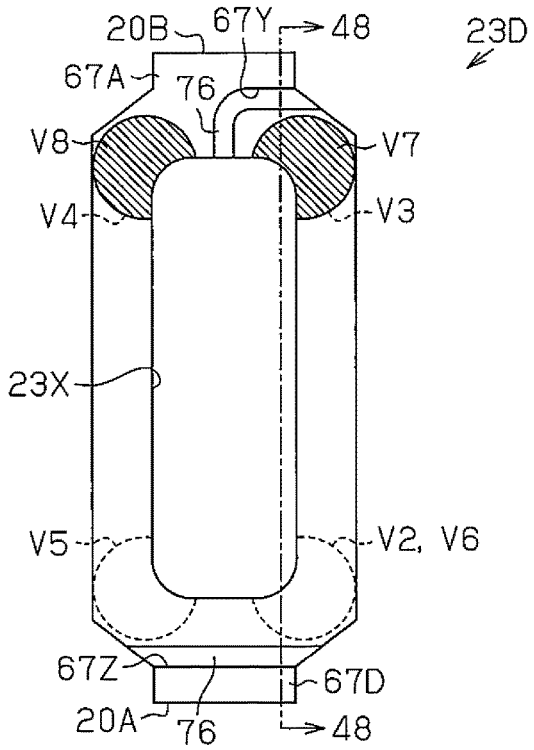
FIG. 49 is a schematic plan view illustrating a stacked body of the inductor of FIG. 48.

In a stacked body 23D illustrated in FIGS. 48 and 49, each of the via wirings V2 to V7 (only via wirings V2, V3, V6, and V7 illustrated in FIG. 48) is partially exposed from the wall surface of the through hole 23X. As illustrated in FIG. 49, in the present example, the through hole 23X of the stacked body 23D has a larger planar shape than the through hole 23X of the stacked body 23 illustrated in FIG. 2. In the example illustrated in FIG. 49, the through hole 23X eliminates a portion corresponding to approximately one-fourth of each of the via wirings V2 to V8, which are generally circular in a plan view. That is, the through hole 23X cuts away a portion of each of the via wirings V2 to V8 in the stacking direction. This exposes the cut surface (end surface) of each of the via wirings V2 to V8 from the wall surface of the through hole 23X. For example, in the via wiring V2, as illustrated in FIG. 48, the cut surface (end surface) of each of the via wiring V2, which extends through the insulation layers 51 and 52, the wiring 62, and the adhesive layer 71 in the thickness direction, is exposed from the wall surface of the through hole 23X. That is, the cut surface (end surface) of the via wiring V2 from the upper surface of the wiring 61 to the lower surface of the adhesive layer 72 is exposed from the wall surface of the through hole 23X. In other words, the through holes 51X, 52X, 62X, and 71X are in communication with the through hole 23X. The wiring 61 is located immediately below the via wiring V2 exposed from the wall surface of the through hole 23X. That is, the end surface of the via wiring V2 and the end surface of the wiring 61 immediately below the via wiring V2 are continuously exposed in the stacking direction from the wall surface of the through hole 23X. In the same manner as the via wiring V2 and the wiring 61, the via wirings V3 to V8 and the wirings 62 to 67 are also exposed from the wall surface of the through hole 23X.

The coil substrate 20 of the present example includes insulation films 25D that cover the surface of conductors exposed from the stacked body 23D. The insulation films 25D cover the end surfaces of the wirings 62 to 67 and the end surfaces of the via wirings V2 to V8 that are exposed from the wall surface of the through hole 23X, the end surfaces of the wirings 62 to 67 exposed from the outer wall surface of the stacked body 23D, the lower surface and the side surfaces of the wiring 61 in the lowermost layer, and the via wirings V7 and V8 in the uppermost layer (only via wiring V7 illustrated in FIG. 48). The insulation films 25D, which cover the wirings 61 to 67 and the via wirings V2 to V8, are spaced apart from one another. However, some of the insulation films 25D continuously cover the wirings 61 to 67 and the via wirings V2 to V8 that are continuously exposed from the wall surface of the through hole 23X. The insulation films 25D are formed from, for example, an electrodeposition resin, which is obtained through electrodeposition (electrodeposition coating). In the fourth embodiment, the insulation films 25D that cover the surfaces of the wirings 61 to 67 exposed from the surface of the stacked body 23D each correspond to first discrete insulation films. The insulation films 25D that cover the surfaces of the via wirings V2 to V8 exposed from the stacked body 23D correspond to second discrete insulation films.

In the inductor 90D, which includes the stacked body 23D, the through hole 23X has a large planar shape. Thus, the encapsulation resin 91 formed in the through hole 23X may be increased in volume. This allows the volume of the encapsulation resin 91, which functions as the magnetic body, to be increased and thus allows the inductance of the inductor 90D to be increased.

One example of a method for manufacturing the inductor 90D will now be described.

Figure 50A:
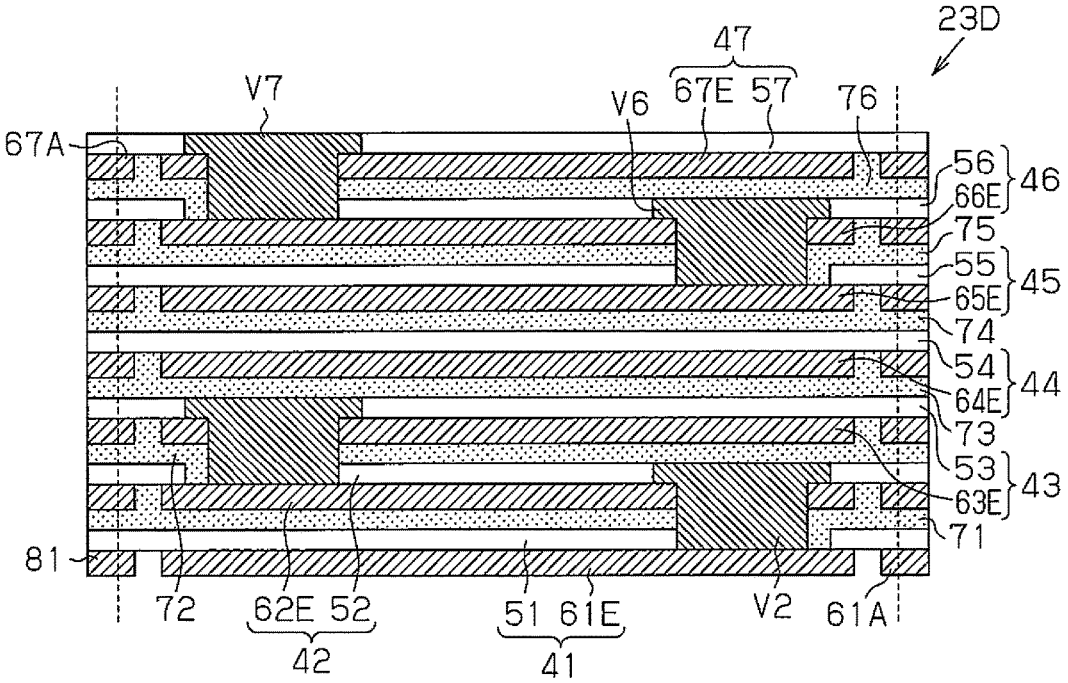
FIGS. 50A and 50B are schematic cross-sectional views illustrating a method for manufacturing the inductor of FIG. 48.

In the step illustrated in FIG. 50A, the structural bodies 41 to 47 are sequentially stacked in the same manner as the steps illustrated in FIGS. 40A to 43B to manufacture the stacked body 23D.

Figure 50B:
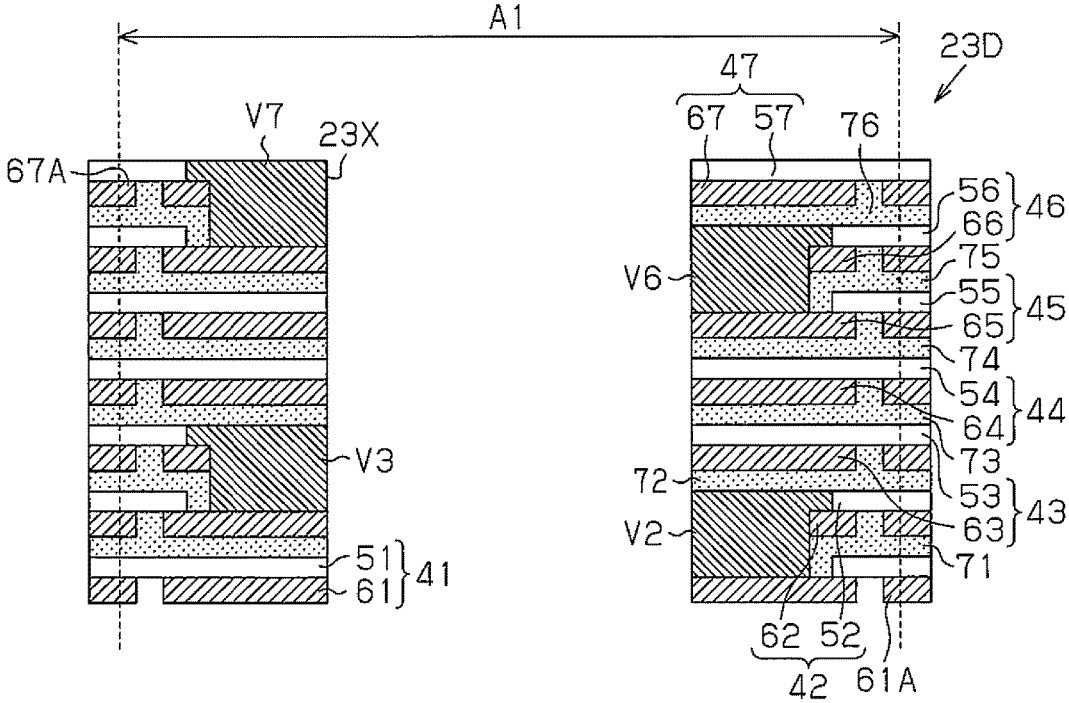
Figure 51A:
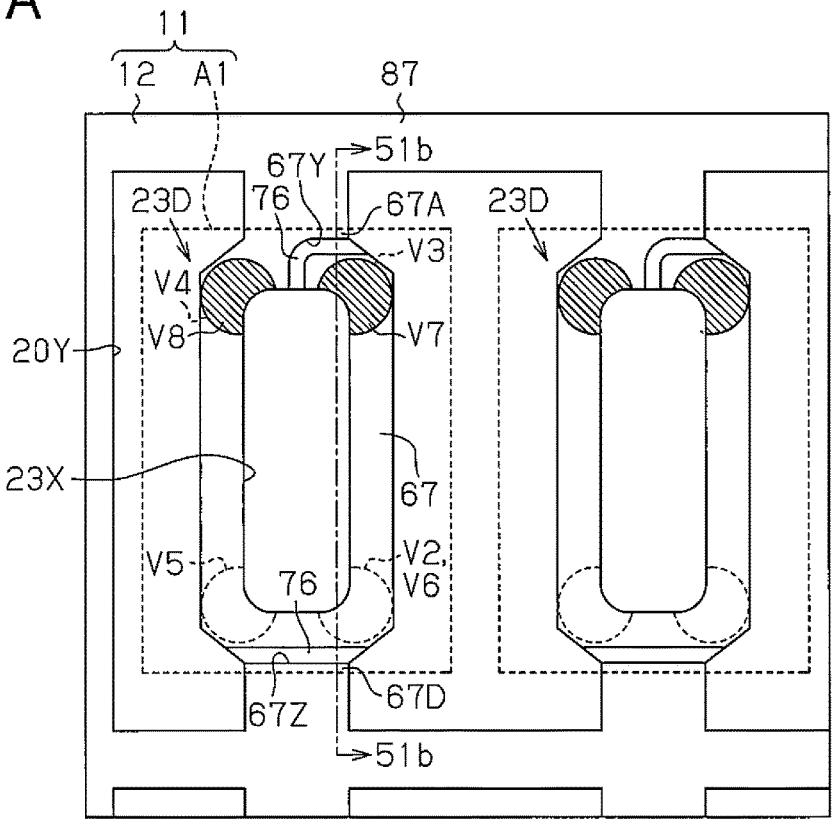
FIG. 51A is a schematic plan view illustrating the method for manufacturing the inductor.

In the step illustrated in FIG. 50B, the stacked body 23D is molded in the same manner as the steps illustrated in FIGS. 26A to 28B, and the metal layers 61E to 67E (refer to FIG. 50A) are processed into wirings 61 to 67 to form a helical coil. As a result, the through hole 23X is formed in the central portion of the stacked body 23D at a location partially overlapping each of the via wirings V2 to V8 (only via wirings V2, V3, V6, and V7 illustrated in FIG. 50B). The formation of the through hole 23X exposes the end surface of each of the wirings 61 to 67 and the end surface of each of the via wirings V2 to V8 from the wall surface of the through hole 23X. That is, each of the via wirings V2 to V8 is partially cut away in the stacking direction by the through hole 23X, and the cut surface of each of the via wirings V2 to V8 is exposed from the wall surface of the through hole 23X. In this step, as illustrated in FIG. 51A, each individual region A1 includes the opening 20Y at a certain location, and the stacked body 23D is formed to be rectangular in a plan view. The formation of the opening 20Y exposes the end surface of each of the wirings 61 to 67 (only wiring 67 illustrated in FIG. 51A) from the outer wall surface of the stacked body 23D.

Figure 51B:
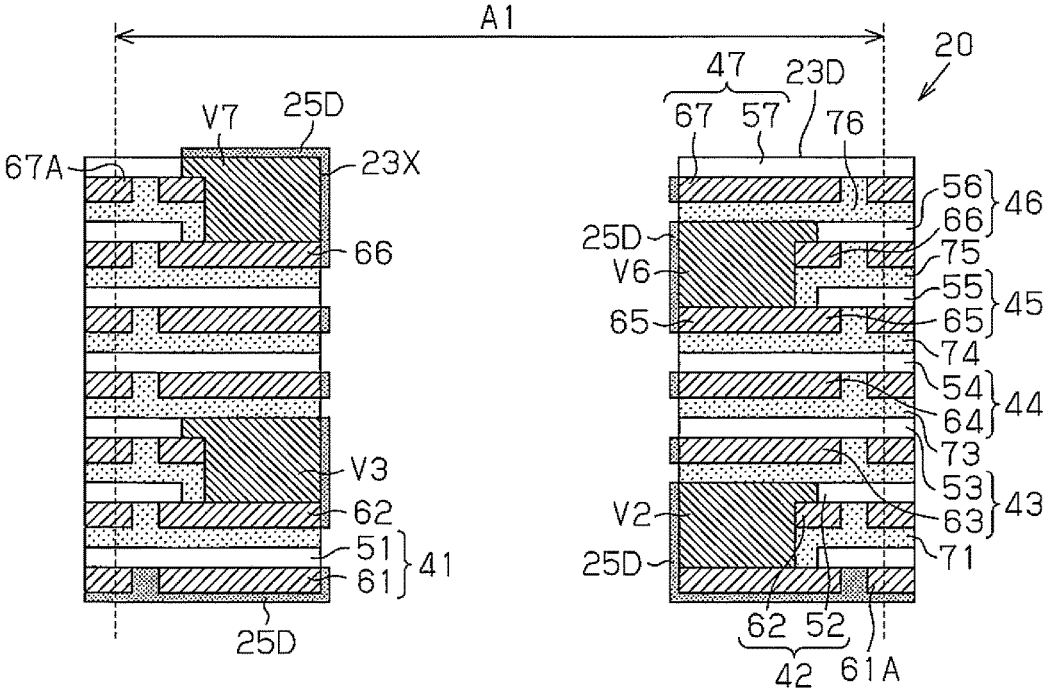
FIG. 51B is a schematic cross-sectional view illustrating the method for manufacturing the inductor.

Then, in the step illustrated in FIG. 51B, electrodeposition is performed to form the insulation films 25D that cover the surfaces of the conductors exposed from the surface of the stacked body 23D. More specifically, the insulation films 25D cover the end surfaces of the wirings 62 to 67 and the end surfaces of the via wirings V2 to V8 exposed from the wall surface of the through hole 23X, the end surfaces of the wirings 62 to 67 exposed from the outer wall surface of the stacked body 23D, the lower surface and side surfaces of the wiring 61, and the upper surfaces of the via wirings V7 and V8 (only via wiring V7 illustrated in FIG. 51B). The thickness of the insulation films 25D may be easily controlled by forming the insulation films 25D through electrodeposition. Further, the formation of voids in the insulation films 25D may be limited by performing electrodeposition. FIG. 51B is a cross-sectional view of the coil substrate 20 taken along line 51*b*-51*b* in FIG. 51A.

Subsequently, steps that are the same as the steps illustrated in FIGS. 30B to 31B are performed to manufacture the inductor 90D illustrated in FIG. 48.

Modified Examples of Fourth Embodiment

In the inductor 90D of the fourth embodiment (FIG. 48), the formation of the through hole 23X, which has a larger planar shape than the inductor 900 illustrated in FIG. 39, partially exposes each of the via wirings V2 to V8 from the wall surface of the through hole 23X. The same modification may be applied to the inductor 90 (FIG. 8B) and the inductor 90B (FIG. 34).

Figure 52:
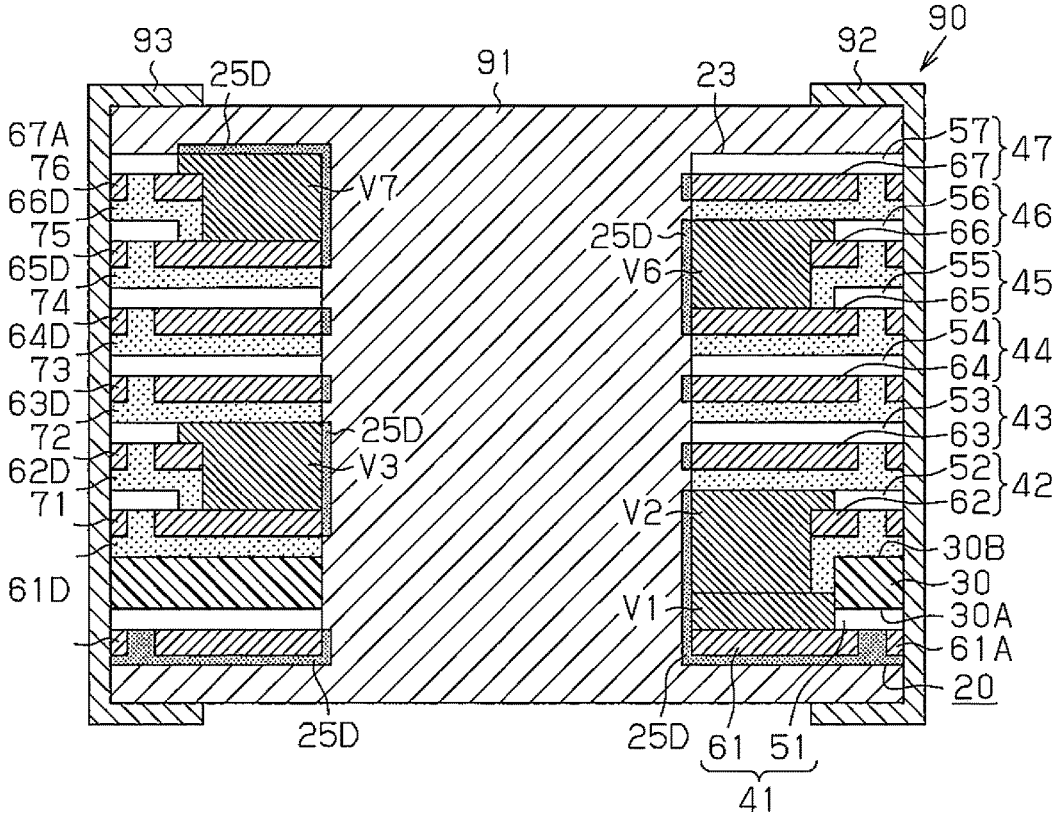
FIGS. 52 and 53 are schematic cross-sectional views illustrating inductors in modified examples of the fourth embodiment.

For example, as illustrated in FIG. 52, each of the via wirings V1 to V8 (only via wirings V1 to V3, V6, and V7 are illustrated in FIG. 52) in the inductor 90 of FIG. 46 may be partially exposed from the wall surface of the through hole 23X.

Figure 53:
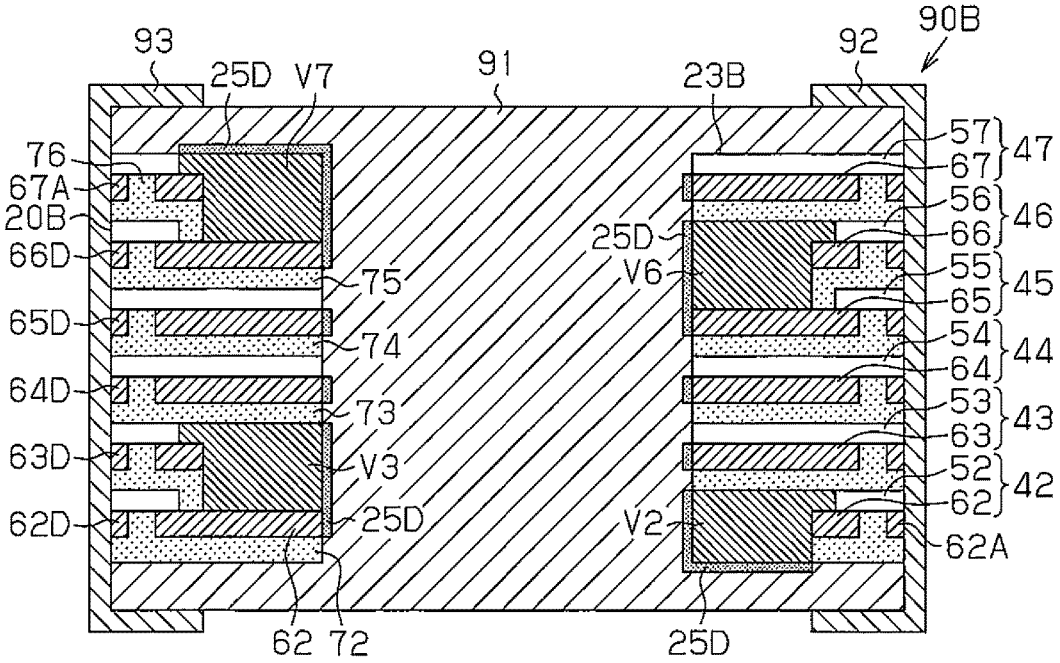

Further, as illustrated in FIG. 53, each of the via wirings V2 to V8 (only via wirings V2, V3, V6, and V7 are illustrated in FIG. 53) in the inductor 90B of FIG. 47 may be partially exposed from the wall surface of the through hole 23X.

In the inductors 90D, 90, and 90B illustrated in FIGS. 48, 52, and 53, the opening 20Y may be formed at a location partially overlapping the via wirings V1 to V8 in a plan view. That is, in the inductors 90D, 90, and 90B illustrated in FIGS. 48, 52, and 53, the cut surface (end surfaces) of each of the via wirings V1 to V8 may be exposed from the outer wall surfaces of the stacked bodies 23D, 23, and 23B. For example, in the inductor 90D illustrated in FIG. 48, the planar shape (profile in a plan view) of the stacked body 23D illustrated in FIG. 49 may be reduced in size so that the end surfaces of the wirings 61 to 67 and the end surfaces of the via wirings V1 to V8 (through electrodes) are exposed from the outer wall surface of the stacked body 23D. In this case, the insulation films 25D may be partially arranged on the outer wall surface of the stacked body 23D to cover the end surfaces of the wirings 61 to 67 and the end surfaces of the via wirings V1 to V8 that are exposed from the outer wall surface of the stacked body 23D. This structure allows for further reduction in the size of the inductors 90D, 90, and 90B.

In the inductors 90D, 90, and 90B illustrated in FIGS. 48, 52, and 53, the insulation films 25D (discrete insulation films) may be replaced by the insulation film 25 that entirely covers the surface of each of the stacked bodies 23D, 23, and 23B.

It should be apparent to those skilled in the art that the present invention may be embodied in many other specific forms without departing from the spirit or scope of the invention. Particularly, it should be understood that the present invention may be embodied in the following forms.

In each embodiment and each modification described above, the metal layers 81 to 87 may be omitted.

In each embodiment and each modification described above, the metal layers 61D to 67D (dummy patterns) may be omitted.

In the first and second embodiments, the insulation film 25 may be omitted. Further, in the fourth embodiment, the insulation film 25D may be omitted. For example, if the encapsulation resin 91 does not contain the magnetic body (i.e., magnetic material), the insulation film 25 (or insulation films 25D) for covering the coil substrate 20 is not necessary. Thus, the insulation film 25 (or insulation films 25D) may be omitted. In this case, the encapsulation resin 91 does not contain a magnetic body that may cause short-circuiting. Thus, the encapsulation resin 91 may be formed directly on the coil substrate 20.

In the first embodiment, the insulation layer 51 may be omitted. In this case, surface treatment such as the plasma process or the like is preferably performed on the lower surface 30A of the substrate 30 to increase the adhesiveness of the substrate 30 and the wiring 61. This also sufficiently ensures insulation between the wiring 61 and the wiring 62 with the substrate 30.

In each embodiment and each modification described above, the number of windings of the wirings in the structural bodies 41 to 47 may be combined in any manner. The wiring of approximately one winding and the wiring of approximately ¾ of a winding may be combined as in the embodiment described above. Alternatively, the wiring of approximately one winding and the wiring of approximately ½ of a winding may be combined. The wiring of four types of patterns (wirings 62, 63, 64, 65 in the example of the embodiment described above) becomes necessary if the wiring of approximately ¾ of a winding is used, and the helical coil can be formed with only the wirings of two types of patterns if the wiring of approximately ½ of a winding is used.

In the third embodiment, it has been described that the burr removal step may be performed after the stacked body 23C is punched in a pressing (stamping) process to form the through hole 23X and the opening 20Y. In the same manner, the burr removal step may be performed in each of the first, second, and fourth embodiments. For example, in the first embodiment, the burr removal step may be performed after the steps illustrated in FIGS. 28A and 28B.

Clauses

This disclosure further encompasses various embodiments described below.

1. A method for manufacturing an inductor, the method including:

preparing a plurality of structural bodies, wherein each of the plurality of structural bodies includes a metal layer and an insulation layer formed on the metal layer;

forming a stacked body by sequentially stacking the plurality of structural bodies while connecting the metal layers of the plurality of structural bodies in series;

molding the stacked body to shape the metal layers of the plurality of structural bodies into wirings so that the wirings that are connected in series form a helical coil; and forming a plurality of first discrete insulation films by performing electrodeposition so that the plurality of first discrete insulation films are spaced apart from each other and cover surfaces of the wirings exposed from a surface of the stacked body.

2. The method according to clause 1, wherein the forming a stacked body includes electrically connecting the metal layers of the plurality of structural bodies that are adjacent in a stacking direction of the stacked body with a plurality of through electrodes, the method further including forming a plurality of second discrete insulation films by performing the electrodeposition so that the plurality of second discrete insulation films are spaced apart from each other and cover surfaces of at least two of the plurality of through electrodes that are exposed from the surface of the stacked body.

The present examples and embodiments are to be considered as illustrative and not restrictive, and the invention is not to be limited to the details given herein, but may be modified within the scope and equivalence of the appended claims.

The invention claimed is:

1. An inductor comprising:

a stacked body that includes a plurality of structural bodies that are stacked, wherein each of the plurality of structural bodies includes a wiring and an insulation layer formed on the wiring, and the wirings of the plurality of structural bodies that are adjacent in a stacking direction of the stacked body are connected in series to form a helical coil;

a first through hole that extends through the stacked body in the stacking direction; and a plurality of first discrete insulation films that are spaced apart from each other and cover entire surfaces of the wirings of the plurality of structural bodies that are exposed from a surface of the stacked body, wherein the stacked body includes:

a first wiring;

a first insulation layer stacked on an upper surface of the first wiring and including a second through hole partially covering the upper surface of the first wiring;

a first adhesive layer stacked on an upper surface of the first insulation layer and including a third through hole that is in communication with the second through hole;

a second wiring stacked on an upper surface of the first adhesive layer and including a fourth through hole that is in communication with the third through hole;

a second insulation layer stacked on an upper surface of the second wiring and including a fifth through hole that is in communication with the fourth through hole; and a first through electrode, wherein the second through hole, the third through hole, the fourth through hole, and the fifth through hole are filled with the first through electrode, wherein the first through electrode connects the first wiring and the second wiring in series, and the fifth through hole has a larger planar shape than the fourth through hole.

2. The inductor according to claim 1, wherein at least some of the plurality of first discrete insulation films cover end surfaces of the wirings of the plurality of structural bodies that are exposed from an outer wall surface of the stacked body.

3. The inductor according to claim 1, wherein the plurality of first discrete insulation films are formed from an electrodeposition resin.

4. The inductor according to claim 1, further comprising a plurality of adhesive layers, each located between two of the plurality of structural bodies that are stacked, wherein the insulation layers of the plurality of structural bodies and the plurality of adhesive layers are exposed from the plurality of first discrete insulation films arranged on the surface of the stacked body.

5. The inductor according to claim 1, wherein the second through hole has a larger planar shape than the third through hole, the first adhesive layer covers a portion of a side surface of the second wiring and covers a wall surface of the second through hole, and the third through hole is partially located in the second through hole.

6. The inductor according to claim 1, wherein:

the first wiring includes a sixth through hole;

the first insulation layer further includes a seventh through hole that is in communication with the sixth through hole and has a larger planar shape than the sixth through hole;

the stacked body includes a second adhesive layer stacked on a lower surface of the first wiring and including an eighth through hole that is in communication with the sixth through hole, a third insulation layer stacked on a lower surface of the second adhesive layer and including a ninth through hole that is in communication with the eighth through hole, a third wiring stacked on a lower surface of the third insulation layer and formed in a lowermost layer of the stacked body, and a second through electrode formed on an upper surface of the third wiring exposed from the eighth through hole and the ninth through hole, wherein the sixth through hole, the seventh through hole, the eighth through hole, and the ninth through hole are filled with the second through electrode;

one of the plurality of first discrete insulation films covers a lower surface and a side surface of the third wiring; and the second through electrode connects the third wiring and the first wiring in series.

7. The inductor according to claim 1, wherein the helical coil includes two connecting portions respectively located at two ends of the helical coil, and the two connecting portions are exposed from the plurality of first discrete insulation films, the inductor further comprising:

a magnetic material that covers the stacked body, excluding the two connecting portions, and the plurality of first discrete insulation films, wherein the first through hole is filled with the magnetic material; and two electrodes that cover the magnetic material and are electrically connected to the two connecting portions, respectively.

8. The inductor according to claim 1, further comprising:

a plurality of through electrodes that electrically connect the wirings of the plurality of structural bodies that are adjacent in the stacking direction; and a plurality of second discrete insulation films that are spaced from each other and cover surfaces of at least two of the plurality of through electrodes that are exposed from the surface of the stacked body.

9. The inductor according to claim 8, wherein at least some of the plurality of second discrete insulation films cover end surfaces of the through electrodes that are exposed from an outer wall surface of the stacked body.

10. The inductor according to claim 8, wherein the plurality of second discrete insulation films are formed from an electrodeposition resin.

11. The inductor according to claim 8, wherein the plurality of through electrodes are exposed from a wall surface of the first through hole, and at least some of the plurality of second discrete insulation films cover end surfaces of the plurality of through electrodes that are exposed from the wall surface of the first through hole.

12. The inductor according to claim 11, wherein the end surfaces of the plurality of through electrodes and end surfaces of associated wirings among the wirings of the plurality of structural bodies that are located immediately below the plurality of through electrodes, respectively, are exposed continuously in the stacking direction from the wall surface of the first through hole, and the second discrete insulation films that cover the end surfaces of the plurality of through electrodes are formed continuously and integrally with associated first discrete insulation films among the plurality of first discrete insulation films that cover the end surfaces of the associated wirings.

13. An inductor comprising:

a stacked body that includes a plurality of structural bodies that are stacked, wherein each of the plurality of structural bodies includes a wiring and an insulation layer formed on the wiring, the wirings of the plurality of structural bodies that are adjacent in a stacking direction of the stacked body are connected in series to form a helical coil, and the helical coil includes two connecting portions respectively located at two ends of the helical coil;

a first through hole that extends through the stacked body in the stacking direction;

a plurality of first discrete insulation films that are spaced apart from each other and cover surfaces of the wirings of the plurality of structural bodies that are exposed from a surface of the stacked body, wherein the two connecting portions of the helical coil are exposed from the plurality of first discrete insulation films;

a magnetic material that covers the stacked body, excluding the two connecting portions, and the plurality of first discrete insulation films, wherein the first through hole is filled with the magnetic material; and two electrodes that cover the magnetic material and are electrically connected to the two connecting portions, respectively.

14. The inductor according to claim 13, wherein at least some of the plurality of first discrete insulation films cover end surfaces of the wirings of the plurality of structural bodies that are exposed from an outer wall surface of the stacked body.

15. The inductor according to claim 13, wherein the plurality of first discrete insulation films are formed from an electrodeposition resin.

16. The inductor according to claim 13, further comprising a plurality of adhesive layers, each located between two of the plurality of structural bodies that are stacked, wherein the insulation layers of the plurality of structural bodies and the plurality of adhesive layers are exposed from the plurality of first discrete insulation films arranged on the surface of the stacked body.

17. The inductor according to claim 13, further comprising:

a plurality of through electrodes that electrically connect the wirings of the plurality of structural bodies that are adjacent in the stacking direction; and a plurality of second discrete insulation films that are spaced from each other and cover surfaces of at least two of the plurality of through electrodes that are exposed from the surface of the stacked body.

18. The inductor according to claim 17, wherein the plurality of second discrete insulation films are formed from an electrodeposition resin.

19. The inductor according to claim 13, wherein the stacked body includes:

a first wiring;

a first insulation layer stacked on an upper surface of the first wiring and including a second through hole partially covering the upper surface of the first wiring;

a first adhesive layer stacked on an upper surface of the first insulation layer and including a third through hole that is in communication with the second through hole;

a second wiring stacked on an upper surface of the first adhesive layer and including a fourth through hole that is in communication with the third through hole;

a second insulation layer stacked on an upper surface of the second wiring and including a fifth through hole that is in communication with the fourth through hole; and a first through electrode, wherein the second through hole, the third through hole, the fourth through hole, and the fifth through hole are filled with the first through electrode, wherein the first through electrode connects the first wiring and the second wiring in series, and the fifth through hole has a larger planar shape than the fourth through hole.

20. The inductor according to claim 19, wherein the second through hole has a larger planar shape than the third through hole, the first adhesive layer covers a portion of a side surface of the second wiring and covers a wall surface of the second through hole, and the third through hole is partially located in the second through hole.

21. The inductor according to claim 19, wherein:

the first wiring includes a sixth through hole;

the first insulation layer further includes a seventh through hole that is in communication with the sixth through hole and has a larger planar shape than the sixth through hole;

the stacked body includes a second adhesive layer stacked on a lower surface of the first wiring and including an eighth through hole that is in communication with the sixth through hole, a third insulation layer stacked on a lower surface of the second adhesive layer and including a ninth through hole that is in communication with the eighth through hole, a third wiring stacked on a lower surface of the third insulation layer and formed in a lowermost layer of the stacked body, and a second through electrode formed on an upper surface of the third wiring exposed from the eighth through hole and the ninth through hole, wherein the sixth through hole, the seventh through hole, the eighth through hole, and the ninth through hole are filled with the second through electrode;

one of the plurality of first discrete insulation films covers a lower surface and a side surface of the third wiring; and the second through electrode connects the third wiring and the first wiring in series.

* * * * *